US010568428B2

(12) United States Patent
Marshall et al.

(10) Patent No.: US 10,568,428 B2
(45) Date of Patent: Feb. 25, 2020

(54) FURNITURE MEMBER HAVING FLEXIBLE SEATBACK

(71) Applicant: La-Z-Boy Incorporated, Monroe, MI (US)

(72) Inventors: Richard E. Marshall, Monroe, MI (US); Eugene O. Cole, II, Maumee, OH (US); Chandrasekar Ramasubramanian, Dayton, TN (US); Stephen Brown, Hixson, TN (US); Jason Rains, Evensville, TN (US); Jason Bryson, Athens, TN (US)

(73) Assignee: LA-Z-BOY INCORPORATED, Monroe, MI (US)

( * ) Notice: Subject to any disclaimer, the term of this patent is extended or adjusted under 35 U.S.C. 154(b) by 213 days.

(21) Appl. No.: 15/831,865

(22) Filed: Dec. 5, 2017

(65) Prior Publication Data

US 2018/0289156 A1 Oct. 11, 2018

Related U.S. Application Data

(63) Continuation-in-part of application No. 15/481,642, filed on Apr. 7, 2017.

(51) Int. Cl.
*A47C 1/035* (2006.01)
*A47C 7/50* (2006.01)
(Continued)

(52) U.S. Cl.
CPC ..... *A47C 1/0352* (2013.01); *A47C 1/0242* (2013.01); *A47C 1/0345* (2013.01); *A47C 7/506* (2013.01); *A47C 17/04* (2013.01)

(58) Field of Classification Search
CPC ..... A47C 1/0352; A47C 1/0345; A47C 1/024; A47C 7/00; A47C 7/24; A47C 17/04; A47C 7/72; A47C 1/03211; A47C 1/0242
(Continued)

(56) References Cited

U.S. PATENT DOCUMENTS 203,602 A 5/1878 Dietsch
2,473,895 A 6/1949 Mednick
(Continued)

FOREIGN PATENT DOCUMENTS

CN 200976974 Y 11/2007
DE 623960 C 1/1936
(Continued)

OTHER PUBLICATIONS

International Search Report and Written Opinion of the International Searching Authority for Application No. PCT/US2016/021361, dated May 30, 2016.
(Continued)

*Primary Examiner* — Milton Nelson, Jr.
(74) *Attorney, Agent, or Firm* — Harness, Dickey & Pierce, P.L.C.

(57) ABSTRACT

A furniture member may include a stationary frame assembly and a seatback cushion. The stationary frame assembly may include a stationary base frame, a pair of stationary armrest frames and a stationary seatback frame that is fixed relative to the stationary base frame and the stationary armrest frames. The seatback cushion may include upholstery attached to at least one of the armrest frames. The upholstery may include a portion disposed between the at least one of the armrest frames and the seatback cushion. The portion of the upholstery may be expandable to allow movement of the seatback cushion relative to the stationary base frame, the stationary armrest frames and the stationary seatback frame between an upright position and a reclined position.

20 Claims, 45 Drawing Sheets

(51) Int. Cl.

| | |
|---|---|
| ***A47C 1/034*** | (2006.01) |
| ***A47C 7/72*** | (2006.01) |
| ***A47C 17/04*** | (2006.01) |
| ***A47C 1/024*** | (2006.01) |

(58) Field of Classification Search
USPC ..... 297/218.1, 463.2, 85 M, 217.3
See application file for complete search history.

(56) References Cited

U.S. PATENT DOCUMENTS 2,677,412 A * 5/1954 Thomas ..... A47C 1/032 297/284.4
2,719,572 A 10/1955 Goldberg
2,772,723 A 12/1956 Tunnell
3,096,121 A 7/1963 Knabusch et al.
3,179,466 A 4/1965 Garrett
3,191,990 A 6/1965 Rugg et al.
3,302,969 A 2/1967 Mizelle et al.
3,352,601 A 11/1967 Cycowicz
3,637,255 A 1/1972 Re
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A 12/1975 Evans
3,941,417 A 3/1976 Re
4,099,776 A 7/1978 Crum
4,140,342 A 2/1979 Jones
4,179,157 A 12/1979 Shoemaker et al.
4,212,494 A 7/1980 Dabney
4,216,991 A 8/1980 Holobaugh
4,216,992 A 8/1980 Crum
4,226,468 A 10/1980 Johnson
4,244,620 A 1/1981 Harrison et al.
4,352,523 A 10/1982 Holobaugh, Jr.
4,364,603 A 12/1982 Johnson
4,367,895 A 1/1983 Pacitti et al.
4,373,602 A 2/1983 Tomita et al.
4,451,084 A 5/1984 Seeley
4,492,407 A 1/1985 Broadhead
4,519,647 A 5/1985 Rogers, Jr.
4,570,996 A 2/1986 Rogers, Jr.
4,582,435 A 4/1986 Davis
4,601,513 A 7/1986 Pine
4,650,211 A 3/1987 Tanahashi
4,662,597 A 5/1987 Uecker et al.
4,740,031 A 4/1988 Rogers, Jr.
4,805,960 A 2/1989 Tacker
4,861,101 A 8/1989 Hartline
4,932,927 A 6/1990 Fillar
4,989,914 A 2/1991 Pine
5,011,220 A 4/1991 LaPointe
5,044,692 A * 9/1991 Tidwell, Jr. ..... A47C 7/38 297/391
5,064,244 A 11/1991 Sproule
5,072,988 A 12/1991 Plunk
5,088,789 A 2/1992 LaPointe et al.
5,123,705 A 6/1992 Johnson
5,141,284 A 8/1992 LaPointe
5,147,108 A 9/1992 LaPointe
5,156,441 A 10/1992 Byersmith et al.
5,171,000 A 12/1992 LaPointe et al.
5,217,276 A 6/1993 LaPointe et al.
5,234,253 A 8/1993 LaPointe et al.
5,238,295 A 8/1993 Harrell
5,328,235 A 7/1994 Saul et al.
5,360,255 A 11/1994 Cook et al.
5,423,591 A 6/1995 LaPointe et al.
5,435,621 A 7/1995 Komorowski et al.
5,435,622 A 7/1995 Fay et al.
5,480,209 A 1/1996 May
5,480,213 A 1/1996 Sproule
5,527,095 A 6/1996 Marshall et al.
5,567,009 A 10/1996 Fay et al.
5,570,927 A 11/1996 LaPointe et al.
5,570,930 A 11/1996 LaPointe et al.
5,597,209 A 1/1997 Bart et al.
5,664,832 A * 9/1997 Stevens ..... A47C 31/11 297/225
5,765,913 A 6/1998 LaPointe et al.
5,772,278 A 6/1998 Kowalski
5,775,775 A 7/1998 Hoffman
5,806,920 A 9/1998 Blount
5,806,921 A 9/1998 LaPointe et al.
5,823,614 A 10/1998 Johnson et al.
5,857,739 A 1/1999 Smith
5,865,457 A 2/1999 Knabusch et al.
5,954,392 A 9/1999 Liss et al.
5,971,475 A 10/1999 Lawson
5,975,627 A 11/1999 LaPointe et al.
6,000,754 A 12/1999 Lawson
6,179,328 B1 1/2001 Kawagoe et al.
6,309,015 B1 10/2001 Pine
6,330,995 B1 12/2001 Mangeiga et al.
6,467,845 B1 10/2002 Chen
6,488,332 B1 12/2002 Markwald
6,491,342 B1 12/2002 Smith
6,827,401 B2 12/2004 Marshall et al.
6,939,076 B2 9/2005 LaPointe
7,261,367 B2 8/2007 Duncan et al.
7,275,789 B2 10/2007 LaPointe
7,357,450 B2 4/2008 Rogers
7,475,944 B2 1/2009 Griepentrog et al.
7,637,571 B2 12/2009 Okano et al.
7,673,933 B2 3/2010 Lawson
7,731,276 B2 6/2010 Hoffman et al.
7,828,380 B2 11/2010 Olarte
7,850,232 B2 12/2010 Casteel
8,132,855 B2 3/2012 Richard
8,308,228 B2 11/2012 Lawson et al.
8,573,687 B2 11/2013 Lawson et al.
8,590,964 B2 11/2013 Murphy et al.
8,616,627 B2 12/2013 Murphy et al.
8,622,467 B2 1/2014 Murphy et al.
9,314,101 B2 4/2016 Harwood et al.
9,357,847 B2 6/2016 Murphy
9,433,295 B2 9/2016 Crum
9,635,943 B2 5/2017 Lawson
9,655,450 B2 5/2017 Marshall et al.
9,655,451 B2 5/2017 Harwood et al.
9,808,090 B2 11/2017 Carrera
9,986,832 B2 6/2018 LaPointe et al.
9,986,835 B2 6/2018 LaPointe et al.
10,092,106 B2 10/2018 LaPointe et al.
2001/0026088 A1* 10/2001 Robinson ..... A47C 3/029 297/260.2
2003/0057743 A1 3/2003 May
2004/0000803 A1 1/2004 Guillot et al.
2005/0067867 A1 3/2005 May
2006/0061147 A1 3/2006 Johnson
2006/0103202 A1 5/2006 Maki et al.
2006/0249992 A1 11/2006 LaPointe et al.
2006/0249993 A1 11/2006 Rogers
2007/0040419 A1 2/2007 LaPointe et al.
2007/0085395 A1 4/2007 LaPointe
2007/0241589 A1 10/2007 LaPointe
2008/0129006 A1* 6/2008 Johnson ..... A61G 5/045 280/149.2
2008/0150329 A1 6/2008 Lawson
2009/0284054 A1 11/2009 Humer et al.
2011/0016627 A1* 1/2011 Blevins ..... A61G 7/1007 5/83.1
2011/0175426 A1 7/2011 Lawson
2011/0233972 A1 9/2011 Weicek
2011/0248544 A1 10/2011 Adams et al.
2011/0248547 A1 10/2011 LaPointe et al.
2011/0304193 A1 12/2011 Murphy et al.
2012/0193946 A1 8/2012 Robertson
2013/0062914 A1 3/2013 Marshall et al.
2013/0140855 A1 6/2013 Murphy et al.
2013/0175847 A1 7/2013 Lawson
2014/0049079 A1 2/2014 Lawson et al.

(56) References Cited

U.S. PATENT DOCUMENTS

| | | | |
|---|---|---|---|
| 2014/0049084 | A1 | 2/2014 | Lawson et al. |
| 2014/0070585 | A1 | 3/2014 | LaPointe |
| 2014/0103688 | A1 | 4/2014 | Wilson |
| 2014/0312660 | A1 | 10/2014 | Natuzzi et al. |
| 2014/0333099 | A1 | 11/2014 | Lu et al. |
| 2015/0196123 | A1 | 7/2015 | Buehrer |
| 2015/0250320 | A1 | 9/2015 | Arceci et al. |
| 2015/0272329 | A1 | 10/2015 | Lawson |
| 2015/0282619 | A1 | 10/2015 | Lawson |
| 2016/0058195 | A1 | 3/2016 | Huang et al. |
| 2016/0100687 | A1 | 4/2016 | Murphy |
| 2016/0302573 | A1 | 10/2016 | Garland et al. |
| 2016/0376007 | A1 | 12/2016 | Meindlhumer |
| 2017/0013961 | A1 | 1/2017 | LaPointe et al. |
| 2017/0042330 | A1 | 2/2017 | Bruce et al. |
| 2017/0101188 | A1 | 4/2017 | Auge et al. |
| 2017/0150818 | A1 | 6/2017 | Contreras |
| 2017/0367483 | A1 | 12/2017 | Fecker et al. |
| 2018/0070725 | A1 | 3/2018 | LaPointe et al. |
| 2018/0078039 | A1 | 3/2018 | LaPointe et al. |
| 2018/0289157 | A1 | 10/2018 | Marshall et al. |
| 2018/0289158 | A1 | 10/2018 | Marshall et al. |
| 2019/0116981 | A1 | 4/2019 | LaPointe et al. |

FOREIGN PATENT DOCUMENTS

| | | | |
|---|---|---|---|
| EP | 1504697 | A1 | 2/2005 |
| JP | 2001054443 | A | 2/2001 |
| JP | 2003070583 | A | 3/2003 |
| KR | 102006003613 | | 4/2006 |
| KR | 100807370 | B1 | 2/2008 |
| KR | 101245357 | B1 | 3/2013 |
| WO | WO-9611612 | A1 | 4/1996 |
| WO | WO-2011094478 | A1 | 8/2011 |
| WO | WO-2012162499 | A1 | 11/2012 |
| WO | WO-2015-066030 | A1 | 5/2015 |

OTHER PUBLICATIONS

International Search Report and Written Opinion of the International Searching Authority for Application No. PCT/US2017/035976, dated Aug. 25, 2017.
International Search Report for Application No. PCT/US2019/021568, dated Jun. 20, 2019.
Written Opinion of the International Searching Authority for Application No. PCT/US2019/021568, dated Jun. 20, 2019.
European Search Report for Application No. 19158581.9, dated May 3, 2019.
First Examination Report for New Zealand Application No. 738919, dated Mar. 14, 2019.
International Search Report for Application No. PCT/US2016/032967 dated Aug. 19, 2016.
Written Opinion of the International Searching Authority for Application No. PCT/US2016/032967 dated Aug. 19, 2016.
International Search Report and Written Opinion of the International Searching Authority for Application No. PCT/US2018/025467, dated Jul. 17, 2018.
International Search Report for EP Application No. 18159817.8 dated Sep. 26, 2018.
International Search Report for Application No. PCT/US2006/031852, dated Jun. 17, 2008.
Written Opinion of the International Searching Authority for Application No. PCT/US2006/031852, dated Jun. 17, 2008.
International Search Report for Application No. PCT/US2014/019455, dated May 26, 2014.
Written Opinion of the International Searching Authority for Application No. PCT/US2014/019455, dated May 26, 2014.
International Search Report for Application No. PCT/US2017/043899, dated Nov. 8, 2017.
Written Opinion of the International Searching Authority for Application No. PCT/US2017/043899, dated Nov. 8, 2017.
European Search Report for Application No. 16824840.9, dated Dec. 7, 2018.

* cited by examiner

FURNITURE MEMBER HAVING FLEXIBLE SEATBACK

CROSS-REFERENCE TO RELATED APPLICATIONS

This application is a continuation-in-part of U.S. patent application Ser. No. 15/481,642 filed on Apr. 7, 2017. The entire disclosure of the above application is incorporated herein by reference.

FIELD

The present disclosure relates to a furniture member having a flexible seatback.

BACKGROUND

This section provides background information related to the present disclosure and is not necessarily prior art.

Furniture members (e.g., chairs, sofas, loveseats, etc.) can include a legrest that can be extended and retracted and a seatback that can be reclined. Such functionality is often a tradeoff with aesthetic design. That is, the aesthetic design options of conventional motion furniture members are often limited to accommodate mechanisms that enable deploying and stowing the legrest and moving the seatback and seat bottom. Conventional recliner and legrest mechanisms prohibit certain aesthetic design features and styles that are popular in modern stationary furniture members. The present disclosure provides furniture members that incorporate recliner and legrest features in a manner that allow for a wider range of desirable aesthetic design features that are not feasible with conventional mechanisms.

SUMMARY

This section provides a general summary of the disclosure, and is not a comprehensive disclosure of its full scope or all of its features.

The present disclosure provides a furniture member that may include a stationary frame assembly, a seat bottom assembly, a legrest mechanism, and a backrest support spring. The stationary frame assembly may include a base frame and a seatback frame that is fixed relative to the base frame. The seat bottom assembly may be supported by the base frame and movable relative to the base frame and the seatback frame between a nominal position and a tilt position. The legrest mechanism may be supported by the base frame and movable relative to the base frame and the seatback frame among a retracted position, a first extended position and a second extended position. A portion of the legrest mechanism may contact the seat bottom assembly when the legrest mechanism is in the first extended position and push the seat bottom assembly from the nominal position to the tilt position as the legrest mechanism moves from the first extended position to the second extended position. The portion of the legrest mechanism may be out of contact with the seat bottom assembly when the legrest mechanism is in the retracted position. The backrest support spring may include a first end and a second end. The first end may be attached to the seatback frame. The second end may be attached to the seat bottom assembly and movable with the seat bottom assembly relative to the base frame and the seatback frame.

In some configurations, the backrest support spring has a first shape when the seat bottom assembly is in the nominal position and has a second shape when the seat bottom assembly is in the tilt position.

In some configurations, the base frame and the seatback frame remain stationary relative to a ground surface upon which the furniture member is disposed during movement of the seat bottom assembly between the nominal and tilt positions and during movement of the legrest mechanism among the retracted, first extended and second extended positions.

In some configurations, the furniture member includes a plurality of backrest support springs having first ends attached to the seatback frame and second ends attached to the seat bottom assembly.

In some configurations, the legrest mechanism includes a first support member, a second support member, a legrest platform, torsion springs, and a cross member. The legrest platform may be attached to first ends of the first and second support members and may be rotatable relative to the first and second support members between a deployed position and a stowed position. The legrest platform is in the deployed position when the legrest mechanism is in the first and second extended positions. The legrest platform is in the stowed position when the legrest mechanism is in the retracted position. The torsion springs engage the legrest platform and the first and second support members and rotationally bias the legrest platform toward the deployed position. The cross member may be attached to second ends of the first and second support members.

In some configurations, the furniture member includes a motor assembly mounted to the base frame and including a block that moves relative to the base frame along a guide rail, wherein the block is attached to the cross member and moves the cross member and the first and second support members among the retracted position and the first and second extended positions.

In some configurations, the first and second support members include first and second inserts, respectively, and first and second springs, respectively. The first insert is slidably received within the first support member through an opening at the second end of the first support member. The first insert is rotatably coupled to the cross member. The first spring is disposed within the first support member. The first spring is attached at one end to the first insert and is attached at another end to the first support member. The first spring biases the first insert toward the first end of the first support member. The second insert is slidably received within the second support member through an opening at the second end of the second support member. The second insert is rotatably coupled to the cross member. The second spring is disposed within the second support member. The second spring is attached at one end to the second insert and is attached at another end to the second support member. The second spring biases the second insert toward the first end of the second support member.

In some configurations, the first and second inserts are rotatably connected to the cross member by first and second pins, respectively. The first pin extends through a cutout in the first support member, and the second pin extends through a cutout in the second support member.

In some configurations, the first and second springs include cables that limit an amount that the first and second springs can stretch, thereby limiting a range of motion of the first and second support members relative to the first and second inserts.

In some configurations, the seat bottom assembly includes first and second cams that include inclined surfaces that engage and move along rollers mounted to the base frame.

The rollers are in contact with first ends of the inclined surfaces when the seat bottom assembly is in the nominal position. The rollers are in contact with second ends of the inclined surfaces when the seat bottom assembly is in the tilt position.

In some configurations, the portion of the legrest mechanism includes first and second spring-loaded bumpers that come into contact with the first and second cams, respectively, when the legrest mechanism moves from the retracted position to the first extended position. The first and second spring-loaded bumpers transmit motion of the legrest mechanism to the seat bottom assembly such that movement of the legrest mechanism into the second extended position moves the seat bottom into the tilt position.

In some configurations, springs of the spring-loaded bumpers compress from a first length to a second shorter length during initial movement of the legrest mechanism from the first extended position toward the second extended position such that the spring-loaded bumpers transmit motion of the legrest mechanism to the seat bottom assembly only when the springs are at the second length.

In some configurations, the legrest mechanism moves relative to the seat bottom assembly between the first and second extended positions. In other configurations, there is no relative movement between the legrest mechanism and the seat bottom assembly when the legrest mechanism moves between the first and second extended positions.

In some configurations, the furniture member includes a pulley mounted to the stationary frame assembly and a cable engaging the pulley. The cable may include a first end connected to the seat bottom assembly and a second end connected to an intermediate portion of the backrest support. The intermediate portion is disposed between the first and second ends of the backrest support spring. Movement of the seat bottom assembly toward the tilt position causes the cable to move the intermediate portion of the backrest support spring relative to the first and second ends of the backrest support spring, thereby elastically bending the backrest support spring.

The present disclosure also provides a furniture member that may include a base frame, a seat bottom assembly, and a legrest mechanism. The seat bottom assembly may be supported by the base frame and may be movable relative to the base frame between a nominal position and tilt position. The legrest mechanism may be supported by the base frame and movable relative to the base frame among a retracted position, a first extended position and a second extended position. A portion of the legrest mechanism may move into contact with the seat bottom assembly when the legrest mechanism moves into the first extended position from the retracted position. The portion of the legrest mechanism pushes the seat bottom assembly from the nominal position to the tilt position as the legrest mechanism moves from the first extended position to the second extended position.

In some configurations, the legrest mechanism includes a first support member, a second support member, a legrest platform, torsion springs, and a cross member. The legrest platform may be attached to first ends of the first and second support members and may be rotatable relative to the first and second support members between a deployed position and a stowed position. The legrest platform is in the deployed position when the legrest mechanism is in the first and second extended positions. The legrest platform is in the stowed position when the legrest mechanism is in the retracted position. The torsion springs engage the legrest platform and the first and second support members and rotationally bias the legrest platform toward the deployed position. The cross member may be attached to second ends of the first and second support members.

In some configurations, the furniture member includes a motor assembly mounted to the base frame and including a block that moves relative to the base frame along a guide rail, wherein the block is attached to the cross member and moves the cross member and the first and second support members among the retracted position and the first and second extended positions.

In some configurations, the first and second support members include first and second inserts, respectively, and first and second springs, respectively. The first insert is slidably received within the first support member through an opening at the second end of the first support member. The first insert is rotatably coupled to the cross member. The first spring is disposed within the first support member. The first spring is attached at one end to the first insert and is attached at another end to the first support member. The first spring biases the first insert toward the first end of the first support member. The second insert is slidably received within the second support member through an opening at the second end of the second support member. The second insert is rotatably coupled to the cross member. The second spring is disposed within the second support member. The second spring is attached at one end to the second insert and is attached at another end to the second support member. The second spring biases the second insert toward the first end of the second support member.

In some configurations, the first and second inserts are rotatably connected to the cross member by first and second pins, respectively. The first pin extends through a cutout in the first support member, and the second pin extends through a cutout in the second support member.

In some configurations, the first and second springs include cables that limit an amount that the first and second springs can stretch, thereby limiting a range of motion of the first and second support members relative to the first and second inserts.

In some configurations, the seat bottom assembly includes first and second cams that include inclined surfaces that engage and move along rollers mounted to the base frame. The rollers are in contact with first ends of the inclined surfaces when the seat bottom assembly is in the nominal position. The rollers are in contact with second ends of the inclined surfaces when the seat bottom assembly is in the tilt position.

In some configurations, the portion of the legrest mechanism includes first and second spring-loaded bumpers that come into contact with the first and second cams, respectively, when the legrest mechanism moves from the retracted position to the first extended position. The first and second spring-loaded bumpers transmit motion of the legrest mechanism to the seat bottom assembly such that movement of the legrest mechanism into the second extended position moves the seat bottom into the tilt position.

In some configurations, springs of the spring-loaded bumpers compress from a first length to a second shorter length during initial movement of the legrest mechanism from the first extended position toward the second extended position such that the spring-loaded bumpers transmit motion of the legrest mechanism to the seat bottom assembly only when the springs are at the second length.

In some configurations, the furniture member includes a backrest support spring having a first end and a second end. The first end may be attached to a stationary seatback frame. The second end may be attached to the seat bottom assembly and movable with the seat bottom assembly relative to the base frame and the seatback frame as the legrest mechanism moves from the first extended position to the second extended position.

In some configurations, the legrest mechanism moves relative to the seat bottom assembly between the first and second extended positions. In other configurations, there is no relative movement between the legrest mechanism and the seat bottom assembly when the legrest mechanism moves between the first and second extended positions.

The present disclosure also provides a furniture member that may include a base frame, a seat bottom assembly, and a legrest mechanism. The seat bottom assembly may be supported by the base frame. The legrest mechanism may be supported by the base frame and movable relative to the base frame among a retracted position, a first extended position and a second extended position. The legrest mechanism may include a first support member, a second support member, a legrest platform, a cross member, and a motor assembly. The first support member may include a first insert and a first spring. The second support member may include a second insert and a second spring. The legrest platform may be attached to first ends of the first and second support members and may be rotatable relative to the first and second support members between a deployed position and a stowed position. The legrest platform is in the deployed position when the legrest mechanism is in the first and second extended positions, and the legrest platform is in the stowed position when the legrest mechanism is in the retracted position. The cross member may be attached to second ends of the first and second support members. The motor assembly may be mounted to the base frame and may include a block that moves relative to the base frame along a guide rail, wherein the block is attached to the cross member and moves the cross member and the first and second support members among the retracted position and the first and second extended positions. The first insert may be slidably received within the first support member through an opening at the second end of the first support member. The first insert may be rotatably coupled to the cross member. The first spring may be disposed within the first support member. The first spring may be attached at one end to the first insert and attached at another end to the first support member. The first spring may bias the first insert toward the first end of the first support member. The second insert may be slidably received within the second support member through an opening at the second end of the second support member. The second insert may be rotatably coupled to the cross member. The second spring may be disposed within the second support member. The second spring may be attached at one end to the second insert and attached at another end to the second support member. The second spring may bias the second insert toward the first end of the second support member.

In some configurations, the legrest mechanism contacts the seat bottom assembly when the legrest mechanism is in the first extended position and moves seat bottom assembly relative to the base frame from a nominal position to a tilt position as the legrest mechanism moves from the first extended position to the second extended position.

In some configurations, the first and second inserts are rotatably connected to the cross member by first and second pins, respectively. The first pin may extend through a cutout in the first support member, and the second pin may extend through a cutout in the second support member.

In some configurations, the first and second springs include cables that limit an amount that the first and second springs can stretch, thereby limiting a range of motion of the first and second support members relative to the first and second inserts.

In some configurations, the seat bottom assembly includes first and second cams that include inclined surfaces that engage and move along rollers mounted to the base frame. The rollers may be in contact with first ends of the inclined surfaces when the seat bottom assembly is in the nominal position. The rollers may be in contact with second ends of the inclined surfaces when the seat bottom assembly is in the tilt position.

In some configurations, the legrest mechanism includes first and second spring-loaded bumpers that come into contact with the first and second cams, respectively, when the legrest mechanism moves from the retracted position to the first extended position. The first and second spring-loaded bumpers may transmit motion of the legrest mechanism to the seat bottom assembly such that movement of the legrest mechanism into the second extended position moves the seat bottom into the tilt position.

In some configurations, springs of the spring-loaded bumpers compress from a first length to a second shorter length during initial movement of the legrest mechanism from the first extended position toward the second extended position such that the spring-loaded bumpers transmit motion of the legrest mechanism to the seat bottom assembly only when the springs are at the second length.

In some configurations, the furniture member includes a backrest support spring having a first end and a second end. The first end may be attached to a stationary seatback frame. The second end may be attached to the seat bottom assembly and movable with the seat bottom assembly relative to the base frame and the seatback frame as the legrest mechanism moves from the first extended position to the second extended position.

In some configurations, the legrest mechanism moves relative to the seat bottom assembly between the first and second extended positions. In other configurations, there is no relative movement between the legrest mechanism and the seat bottom assembly when the legrest mechanism moves between the first and second extended positions.

In some configurations, the legrest mechanism is movably supported by the seat bottom assembly.

In some configurations, the legrest mechanism can be moved to and maintained at any position between the retracted position and the second extended position, and wherein the seat bottom assembly can be moved to and maintained at any position between the nominal position and the tilt position.

The present disclosure also provides a furniture member that may include a stationary frame assembly and a seat bottom assembly. The stationary frame assembly may include a stationary base frame and a stationary seatback frame that is fixed relative to the base frame. The seat bottom assembly may be supported by the base frame and movable relative to the base frame and the seatback frame between a first position and a second position. The seatback frame is disposed vertically higher than the base frame and the seat bottom assembly.

In some configurations, the stationary frame assembly includes a pair of stationary armrest frames that are fixed relative to the base frame and the seatback frame.

In some configurations, the armrest frames extend vertically between the base frame and the seatback frame, and wherein the seatback frame is disposed vertically higher than the armrest frames.

In some configurations, the seatback frame extends from one of the armrest frames to the other of the armrest frames.

In some configurations, the furniture member further comprises a backrest support spring having a first end and a second end, the first end fixedly attached to the seatback frame, the second end movable relative to the base frame and the seatback frame in response to movement of the seat bottom assembly relative to the base frame In some configurations, the second end of the backrest support spring is attached to the seat bottom assembly and is movable with the seat bottom assembly.

In some configurations, the furniture member further comprises a legrest mechanism supported by the base frame and movable relative to the base frame and the seatback frame among a retracted position, a first extended position and a second extended position.

In some configurations, a portion of the legrest mechanism is spaced apart from the seat bottom assembly when the legrest mechanism is in the retracted position, wherein the portion of the legrest mechanism contacts the seat bottom assembly when the legrest mechanism is in the first extended position and pushes the seat bottom assembly from a nominal position to the a position as the legrest mechanism moves from the first extended position to the second extended position.

The present disclosure also provides a furniture member that may include a stationary frame assembly, a seat bottom assembly, a legrest mechanism, and a back support spring. The stationary frame assembly may include a base frame and a seatback frame that is fixed relative to the base frame. The seat bottom assembly may be supported by the base frame and movable relative to the base frame and the seatback frame between a nominal position and a tilt position. The legrest mechanism may be supported by the base frame and movable relative to the base frame and the seatback frame. The backrest support spring may have a first end and a second end. The first end may be fixedly attached to the seatback frame. The second end may be movable relative to the base frame and the seatback frame in response to movement of the seat bottom assembly relative to the base frame.

In some configurations, the seatback frame is disposed vertically higher than the base frame and the seat bottom assembly.

In some configurations, the stationary frame assembly includes arm rests that are fixedly attached to the base frame and the seatback frame. The seat bottom assembly and the legrest mechanism are movable relative to the arm rests.

In some configurations, the armrest frames extend vertically between the base frame and the seatback frame. The seatback frame is disposed vertically higher than the armrest frames.

In some configurations, the legrest mechanism is movable relative to the base frame and the seatback frame among a retracted position, a first extended position and a second extended position.

In some configurations, the seatback frame extends from one of the armrest frames to the other of the armrest frames.

In some configurations, a portion of the legrest mechanism is spaced apart from the seat bottom assembly when the legrest mechanism is in the retracted position. The portion of the legrest mechanism contacts the seat bottom assembly when the legrest mechanism is in the first extended position and pushes the seat bottom assembly from the nominal position to the tilt position as the legrest mechanism moves from the first extended position to the second extended position.

The present disclosure also provides a furniture member that may include a stationary frame assembly, a seat bottom assembly, and a backrest support member. The stationary frame assembly may include a stationary base frame and a stationary seatback frame that is fixed relative to the base frame. The seat bottom assembly may be supported by the base frame. The seatback frame is disposed vertically higher than the base frame and the seat bottom assembly. The backrest support member may be attached to the seatback frame and movable between a first position and a second position.

In some configurations, the stationary frame assembly includes a pair of stationary armrest frames that are fixed relative to the base frame and the seatback frame.

In some configurations, the armrest frames extend vertically between the base frame and the seatback frame. The seatback frame is disposed vertically higher than the armrest frames.

In some configurations, the seatback frame extends from one of the armrest frames to the other of the armrest frames.

In some configurations, the backrest support member is a spring having a first end and a second end. The first end may be fixedly attached to the seatback frame. The second end may be movable relative to the base frame and the seatback frame in response to movement of the seat bottom assembly relative to the base frame.

In some configurations, the backrest support member has a first shape in the first position and a second shape in the second position.

In some configurations, the seat bottom assembly is movable relative to the base frame and the seatback frame between a nominal position and a tilt position. The backrest support member is in the first position when the seat bottom assembly is in the nominal position. The backrest support member is in the second position when the seat bottom assembly is in the tilt position.

In some configurations, the furniture member includes a legrest mechanism supported by the base frame and movable relative to the base frame and the seatback frame between a retracted position and an extended position.

The present disclosure also provides a furniture member that may include a stationary frame assembly, a seat bottom assembly, and a legrest mechanism. The stationary frame assembly may include a stationary base frame and a stationary seatback frame that is fixed relative to the base frame. The seat bottom assembly may be supported by the base frame. The seatback frame is disposed vertically higher than the base frame and the seat bottom assembly. The legrest mechanism may be supported by the base frame and movable relative to the base frame among a retracted position, a first extended position and a second extended position. The legrest mechanism may include a first support member, a second support member, a legrest platform, a cross member, and a motor assembly. The legrest platform may be attached to first ends of the first and second support members and rotatable relative to the first and second support members between a deployed position and a stowed position. The legrest platform is in the deployed position when the legrest mechanism is in the first and second extended positions, and the legrest platform is in the stowed position when the legrest mechanism is in the retracted position. The cross member may be attached to second ends of the first and second support members. The motor assembly may be mounted to the base frame attached to the cross member. The motor assembly may move the cross member and the first and second support members among the retracted position and the first and second extended positions.

In some configurations, the first support member includes a first insert and a first spring.

In some configurations, the first insert is slidably received within the first support member through an opening at the second end of the first support member, the first insert is rotatably coupled to the cross member, the first spring is disposed within the first support member, the first spring is attached at one end to the first insert and is attached at another end to the first support member, the first spring biases the first insert toward the first end of the first support member.

In some configurations, the second support member includes a second insert and a second spring.

In some configurations, the second insert is slidably received within the second support member through an opening at the second end of the second support member, the second insert is rotatably coupled to the cross member, the second spring is disposed within the second support member, the second spring is attached at one end to the second insert and is attached at another end to the second support member, the second spring biases the second insert toward the first end of the second support member.

In some configurations, the first and second inserts are rotatably connected to the cross member by first and second pins, respectively. The first pin extends through a cutout in the first support member, and the second pin extends through a cutout in the second support member.

In some configurations, a backrest support member is attached to the seatback frame and movable between a first position and a second position.

In some configurations, the stationary frame assembly includes a pair of stationary armrest frames that are fixed relative to the base frame and the seatback frame.

In some configurations, the armrest frames extend vertically between the base frame and the seatback frame. The seatback frame is disposed vertically higher than the armrest frames.

In some configurations, the seatback frame extends from one of the armrest frames to the other of the armrest frames.

In some configurations, the backrest support member is a spring having a first end and a second end, the first end fixedly attached to the seatback frame, the second end movable relative to the base frame and the seatback frame in response to movement of the seat bottom assembly relative to the base frame.

In some configurations, the backrest support member has a first shape in the first position and a second shape in the second position.

In some configurations, the seat bottom assembly is movable relative to the base frame and the seatback frame between a nominal position and a tilt position. The backrest support member is in the first position when the seat bottom assembly is in the nominal position. The backrest support member is in the second position when the seat bottom assembly is in the tilt position.

The present disclosure also provides a furniture member that may include a stationary frame assembly and a seatback cushion. The stationary frame assembly may include a stationary base frame, a pair of stationary armrest frames and a stationary seatback frame that is fixed relative to the stationary base frame and the stationary armrest frames. The seatback cushion may include upholstery attached to at least one of the armrest frames. The upholstery may include a portion disposed between the at least one of the armrest frames and the seatback cushion. The portion of the upholstery may be expandable to allow movement of the seatback cushion relative to the stationary base frame, the stationary armrest frames and the stationary seatback frame between an upright position and a reclined position.

In some configurations, the furniture member includes a seat bottom assembly supported by the stationary base frame and movable relative to the stationary base frame between a nominal position and a tilted position.

In some configurations, the furniture member includes another seat bottom assembly and another seatback cushion. The seat bottom assemblies may be movable between the nominal and tilted positions independently of each other. The seatback cushions may be movable independently of each other between the upright and reclined positions. The stationary seatback frame may include a single, continuous seatback rail that extends from one of the stationary armrest frames to the other of the stationary armrest frames such that the furniture member lacks split lines between the seatback cushions and lacks split lines between the seatback cushions and the stationary armrest frames.

In some configurations, the seatback rail is disposed vertically higher than the stationary armrest frames.

In some configurations, the seatback cushion moves between the upright and reclined positions in response to movement of the seat bottom assembly between the nominal and tilted positions.

In some configurations, the furniture member includes backrest support springs that flex in response to movement of the seat bottom assembly between the nominal and tilted positions. The seatback cushion is mounted to the backrest support springs.

In some configurations, each of the backrest support springs includes a first end and a second end. The first end may be fixedly attached to the seatback frame. The second end may be movable relative to the seatback frame in response to movement of the seat bottom assembly between the nominal and tilted positions.

In some configurations, the second end of each of the backrest support springs is fixedly attached to the seat bottom assembly.

In some configurations, the stationary base frame includes a plurality of rollers. The seat bottom assembly may be supported by the base frame and may be rollingly movable on the plurality of rollers relative to the base frame and the seatback frame between the nominal and tilted positions.

In some configurations, the furniture member includes a legrest mechanism supported by the base frame and movable relative to the base frame and the seatback frame among a retracted position, a first extended position and a second extended position.

In some configurations, a portion of the legrest mechanism is spaced apart from the seat bottom assembly when the legrest mechanism is in the retracted position. The portion of the legrest mechanism contacts the seat bottom assembly when the legrest mechanism is in the first extended position and pushes the seat bottom assembly from the nominal position to the tilted position as the legrest mechanism moves from the first extended position to the second extended position.

In some configurations, the legrest mechanism includes a legrest platform, a mid-ottoman platform, and legrest upholstery attached to and extending between the legrest platform and the mid-ottoman platform. The legrest upholstery folds and unfolds as the legrest platform rotates relative to the mid-ottoman platform.

The present disclosure also provides a furniture member that may include a stationary frame assembly, a motor, a battery, and a battery tray assembly. The stationary frame assembly may include a motor bracket pin. The motor may be pivotably mounted to the motor bracket pin. The battery may be electrically connected to the motor. The battery tray assembly may include a bracket and a shelf. The bracket may pivotably engage the motor bracket pin. The shelf is attached to the bracket and defines a shelf surface configured to support the battery.

In some configurations, the battery tray assembly is disposed below a seat bottom assembly of the furniture member and hangs downward from the motor bracket pin.

In some configurations, the bracket includes a base and a pair of ears extending from the base. The ears may include slots that rotatably receive the motor bracket pin. The base is attached to the shelf.

In some configurations, the bracket includes a protrusion that abuts a cross member of the stationary frame assembly. Contact between the protrusion and the cross member restricts rotation of the battery tray assembly relative to the stationary frame assembly.

In some configurations, the motor engages the motor bracket pin between the ears.

In some configurations, the furniture member includes a dust cover attached to the stationary frame assembly below the seat bottom assembly. The dust cover may include an aperture providing access to the battery tray assembly.

In some configurations, the shelf includes a plurality of lips that at least partially define a periphery of the shelf surface.

In some configurations, the furniture member includes a seat bottom assembly and a legrest mechanism. The motor may drive movement of the seat bottom assembly and the legrest mechanism relative to the stationary frame assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
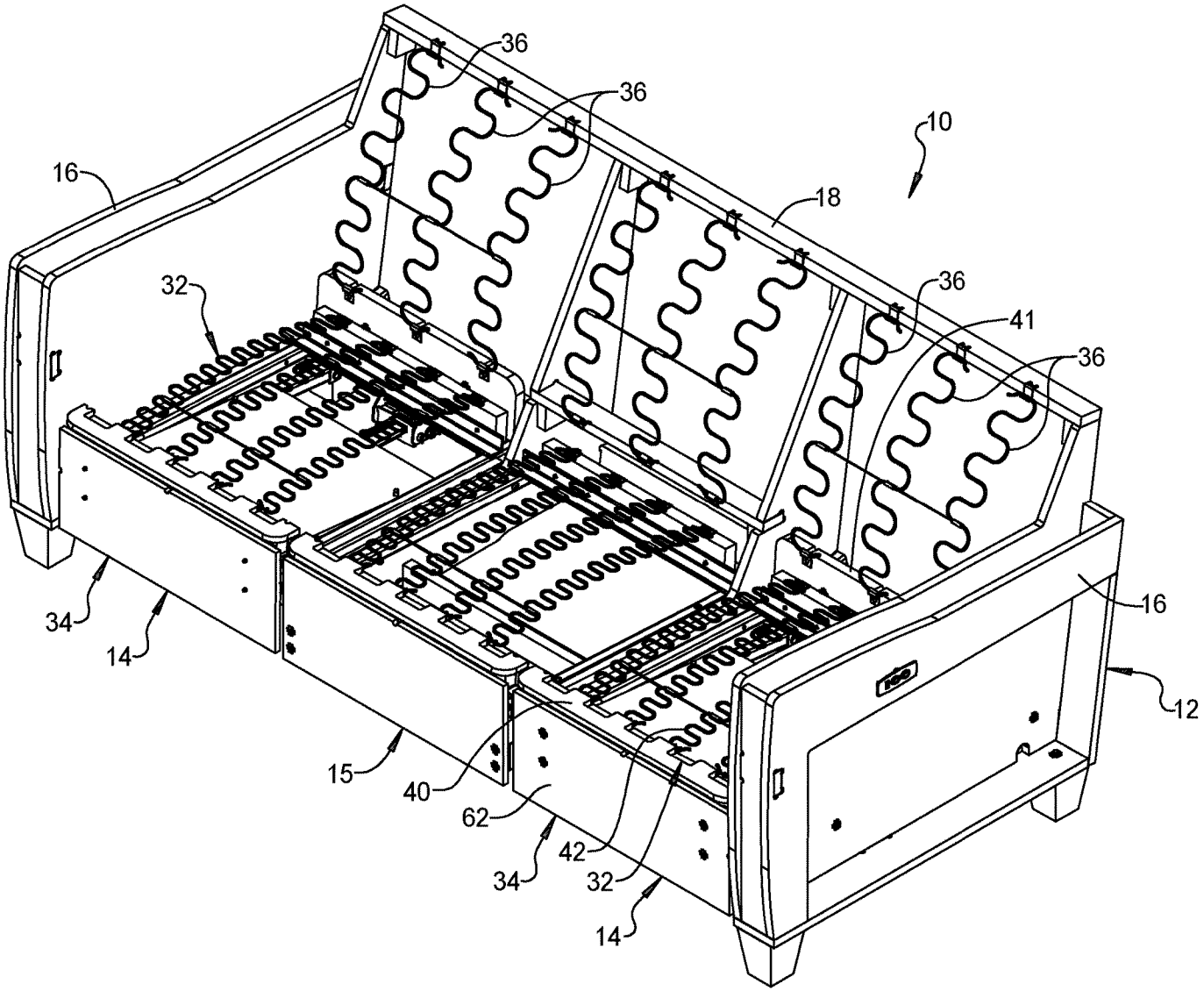
FIG. 1 is a perspective view of a furniture member having a seat bottom assembly in a nominal position and a legrest mechanism in a retracted position.
Figure 2:
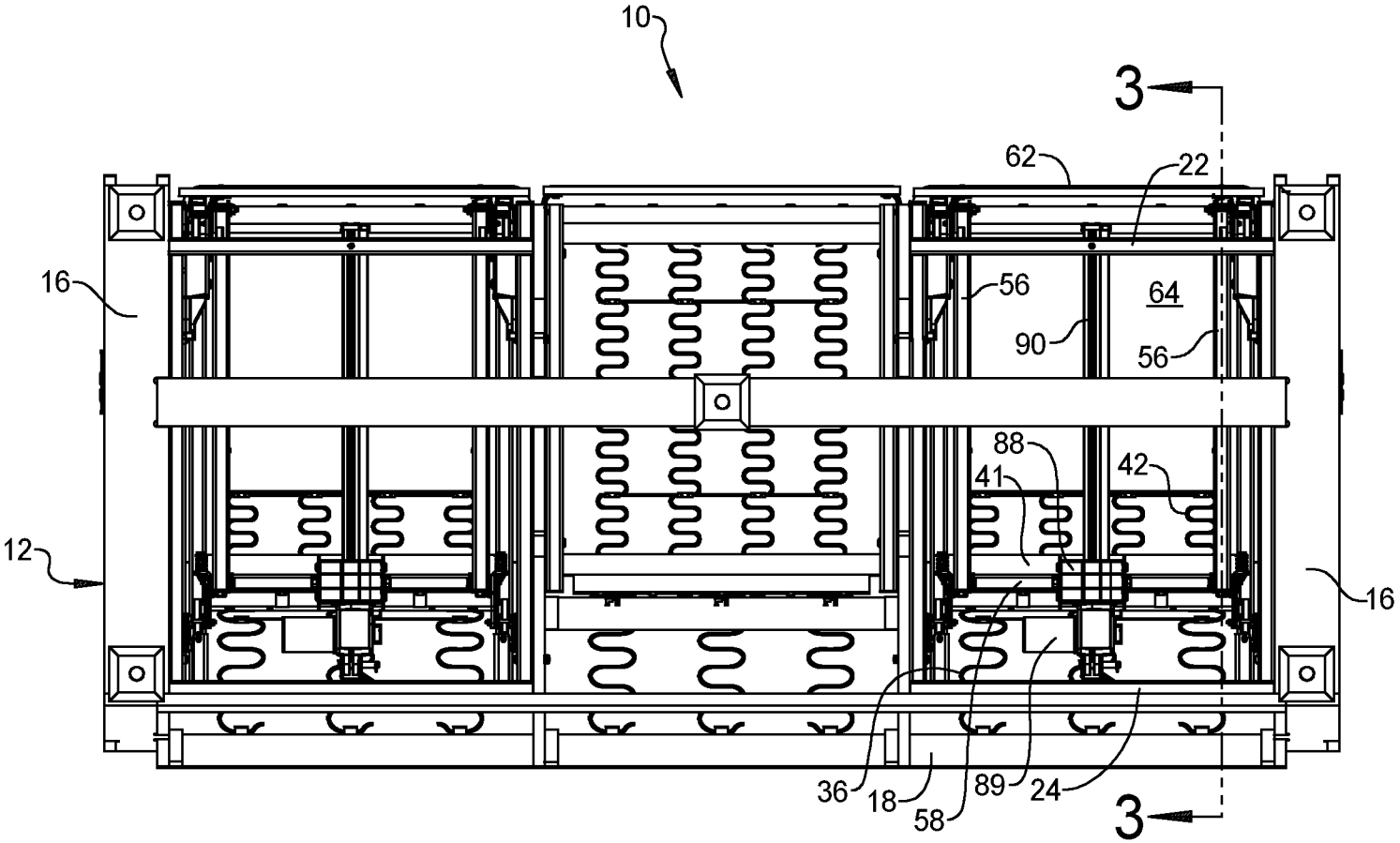
FIG. 2 is a bottom view of the furniture member with the seat bottom assembly in the nominal position and the legrest mechanism in the retracted position.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-28, a furniture member 10 is provided that may include a stationary frame assembly 12 (FIG. 1) and one or more movable seat assemblies 14 (FIG. 1) that are supported by the stationary frame assembly 12 and movable relative to the stationary fame assembly 12. In some configurations, the furniture member 10 may include a stationary seat assembly 15 (e.g., a middle seat assembly disposed between two movable seat assemblies 14; as shown in FIG. 1). It will be appreciated that the furniture member 10 could include any number of stationary seat assemblies 15 (e.g., zero, one, or more than one).

Figure 5:
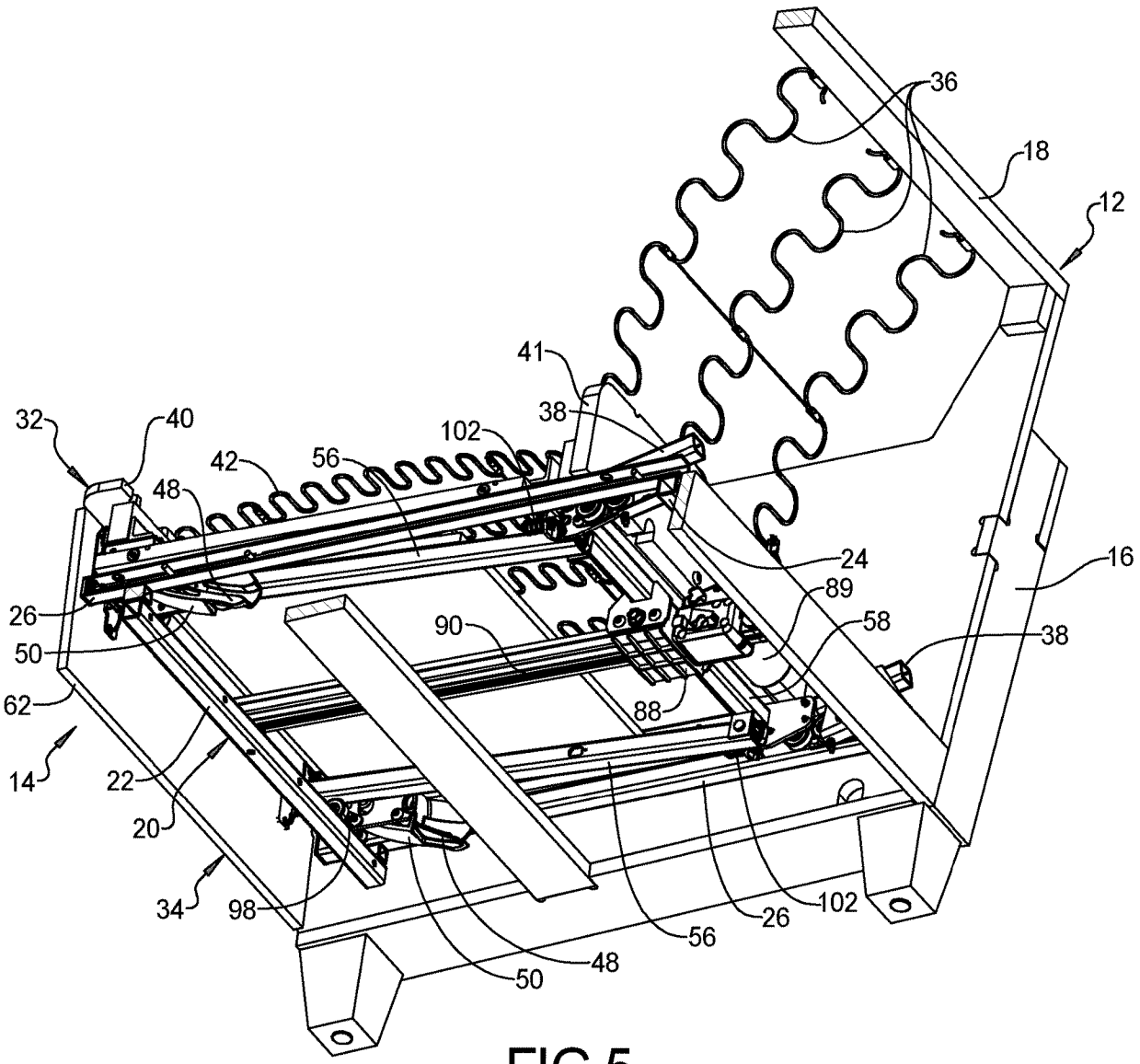
FIG. 5 is a partial perspective view of the furniture member with the seat bottom assembly in the nominal position and the legrest mechanism in the retracted position.
Figure 14:
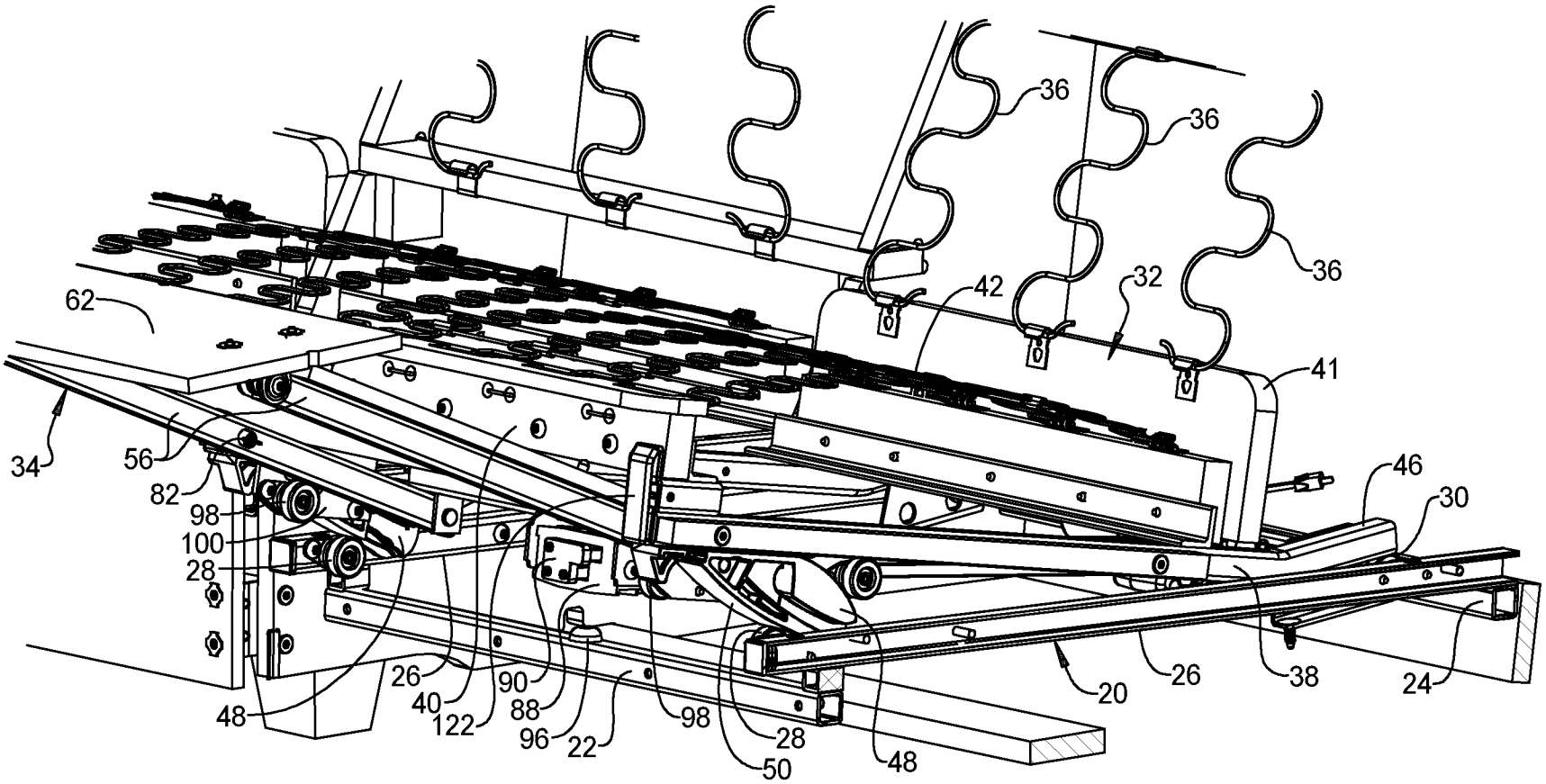
FIG. 14 is a partial perspective view of the furniture member with the seat bottom assembly in the tilt position and the legrest mechanism in the second extended position.

The stationary frame assembly 12 may include a pair of armrest frames 16 (FIG. 1), a seatback frame 18 (FIG. 1), and one or more base frames 20 (FIGS. 5 and 14). The armrest frames 16 may be fixedly relative to the seatback frame 18. The base frames 20 are fixed relative to each other and relative to the armrest frames 16 and the seatback frame 18. Each of the base frames 20 supports a corresponding one of the movable seat assemblies 14. As shown in FIGS. 5, 14-16, each base frame 20 may include a front cross member 22, a rear cross member 24, and a pair of base support members 26 that are fixed to and extend between the front and rear cross members 22, 24. As shown in FIG. 16, each of the base support members 26 may include one or more front rollers or wheels 28 disposed at or near a front end of the base support member 26 and one or more rear rollers or wheels 30 disposed at or near a rear end of the base support member 26.

Each of the movable seat assemblies 14 may include a seat bottom assembly 32, a legrest mechanism 34, and one or more backrest support springs 36. As will be described in more detail below, the movable seat assemblies 14 are individually movable relative to the stationary frame assembly 12 among a first position (FIGS. 1-5), a second position (FIGS. 6-9), and a third position (FIGS. 10-14) while the stationary frame assembly 12 remains stationary relative to a ground surface (e.g., a floor) upon which the furniture member 10 is disposed. In the first position, the seat bottom assembly 32 is in a nominal position, the legrest mechanism 34 is in a retracted position, and the backrest support springs 36 have a first shape. In the second position, the seat bottom assembly 32 is in the nominal position, the legrest mechanism 34 is in a first extended position, and the backrest support springs 36 have the first shape. In the third position, the seat bottom assembly 32 is in a tilt position, the legrest mechanism 34 is in a second extended position, and the backrest support springs 36 have a second shape that is different than the first shape.

Movement of the seat assembly 14 from the first position to the second position may include movement of the legrest mechanism 34 relative to the stationary frame assembly 12 and the seat bottom assembly 32 from the retracted position to the first extended position while the seat bottom assembly 32 remains stationary relative to the stationary frame assembly 12. Movement of the seat assembly 14 from the second position to the third position may include movement of the legrest mechanism 34 relative to the stationary frame assembly 12 from the first position to the second extended position and movement of the seat bottom assembly 32 relative to the stationary frame assembly 12 from the nominal positon to the tilt position. In some configurations, the legrest mechanism 34 moves relative to the seat bottom assembly 32 between the first and second extended positions. In other configurations, there is no relative movement between the legrest mechanism 34 and the seat bottom assembly 32 when the legrest mechanism 34 moves between the first and second extended positions.

Figure 15:
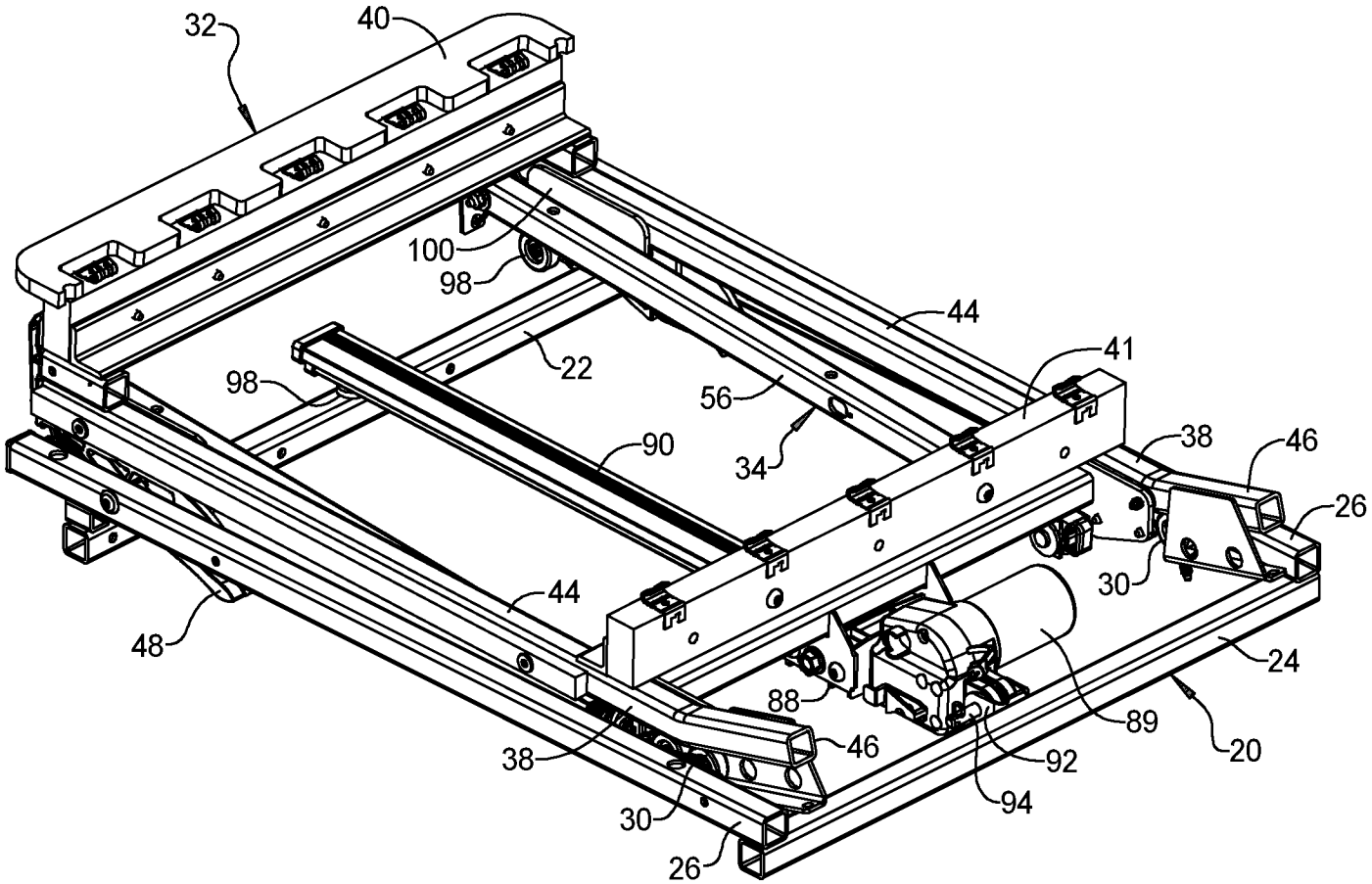
FIG. 15 is a perspective view of a base frame, the seat bottom assembly in the nominal position, and a portion of the legrest mechanism in the retracted position.
Figure 16:
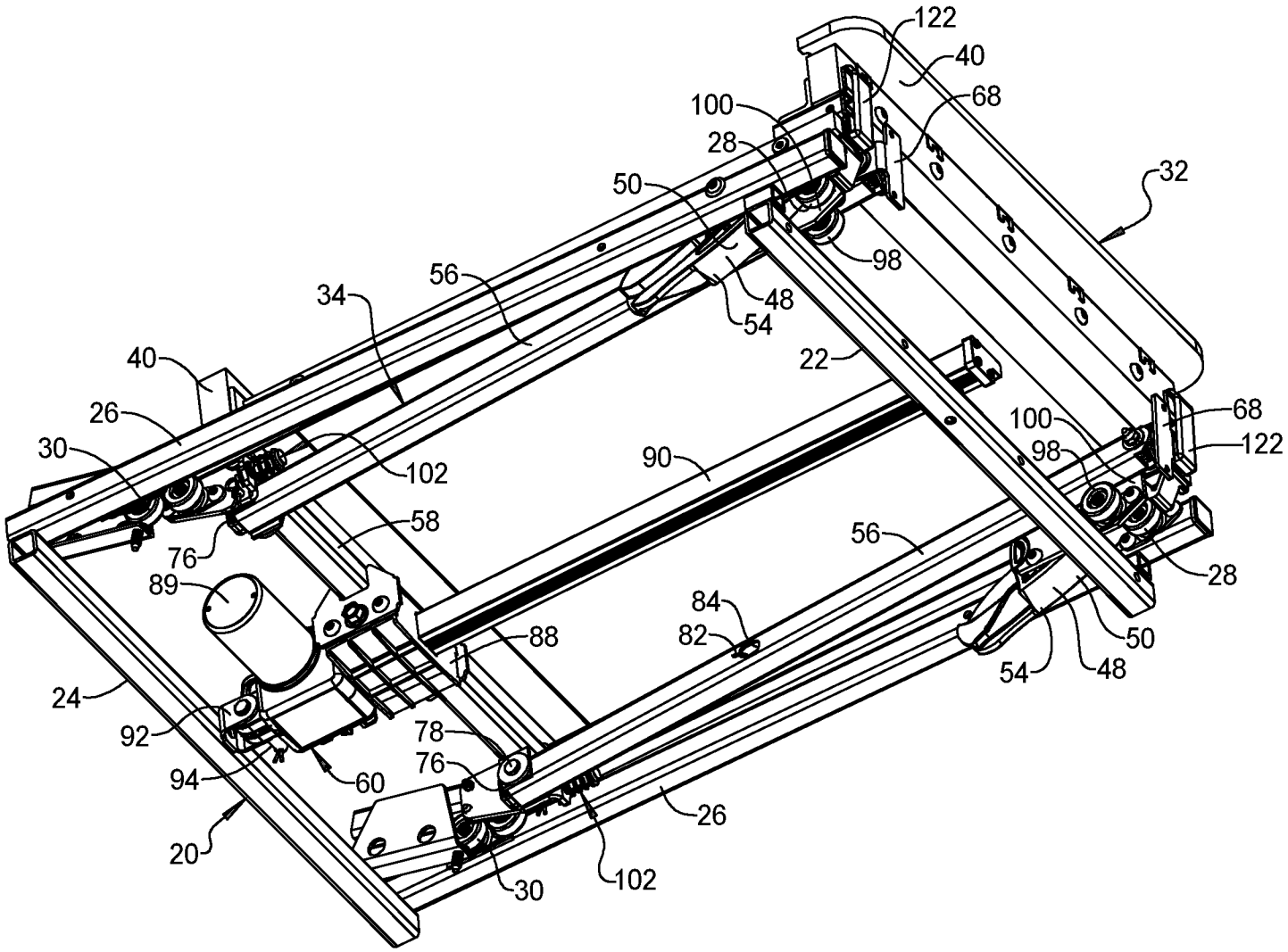
FIG. 16 is another perspective view of a base frame, the seat bottom assembly in the nominal position, and a portion of the legrest mechanism in the retracted position.

As shown in FIG. 15, the seat bottom assembly 32 may include a pair of seat bottom support members 38 and front and rear cross members 40, 41 extending between and fixedly attached to the seat bottom support members 38. As shown in FIG. 1, a plurality of seat bottom springs 42 may be attached to the front and rear cross members 40, 41. The backrest support springs 36 are connected at one end to the stationary seatback frame 18 and are connected at the other end to the rear cross member 41. The seat bottom support members 38 may include an elongated straight portion 44 and an inclined portion 46 that is angled relative to the elongated straight portion 44. The inclined portions 46 define rear ends of the seat bottom support members 38.

Figure 17:
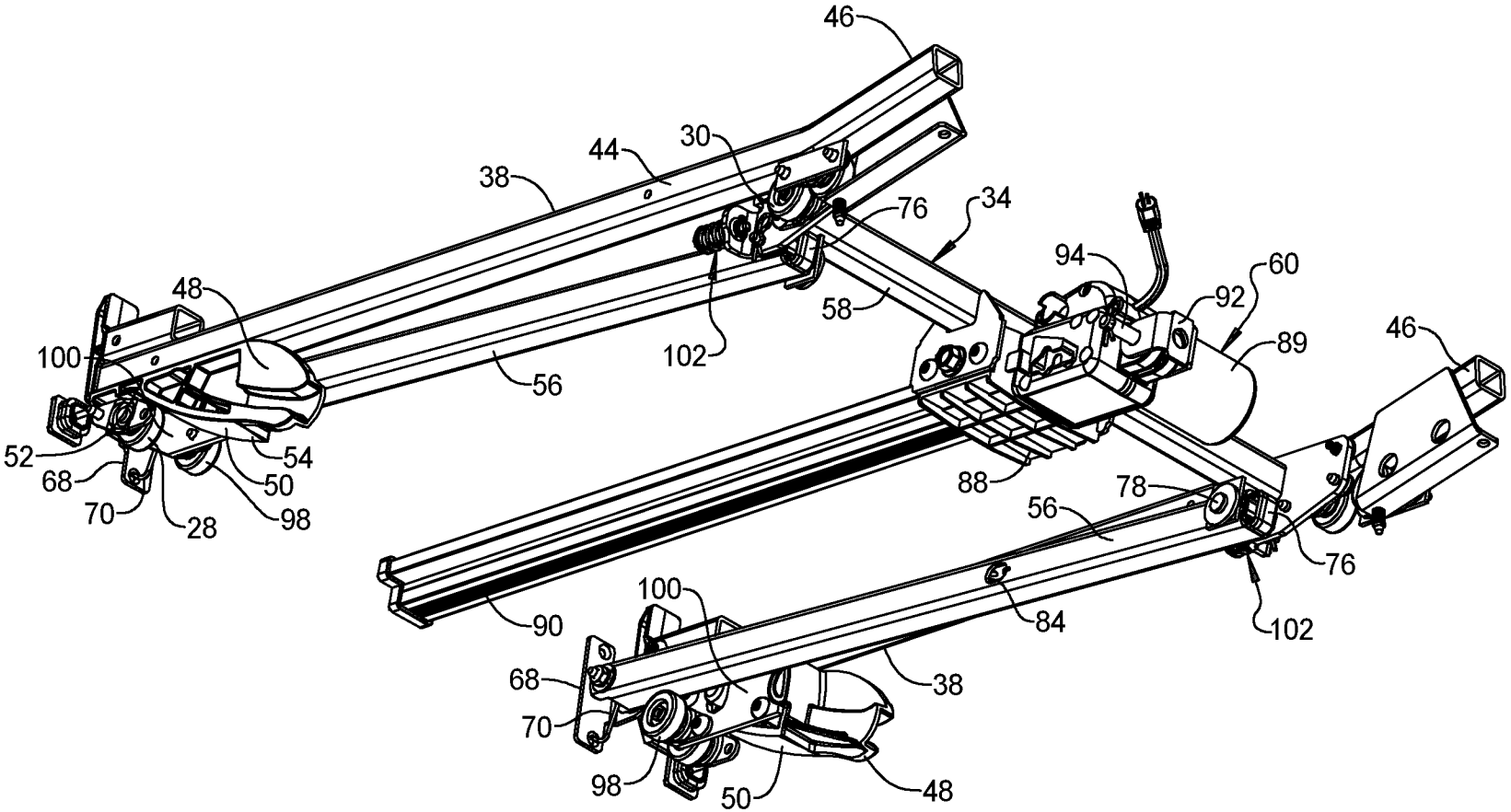
FIG. 17 is a perspective view of a portion of the seat bottom assembly in the nominal position and a portion of the legrest mechanism in the retracted position.
Figure 18:
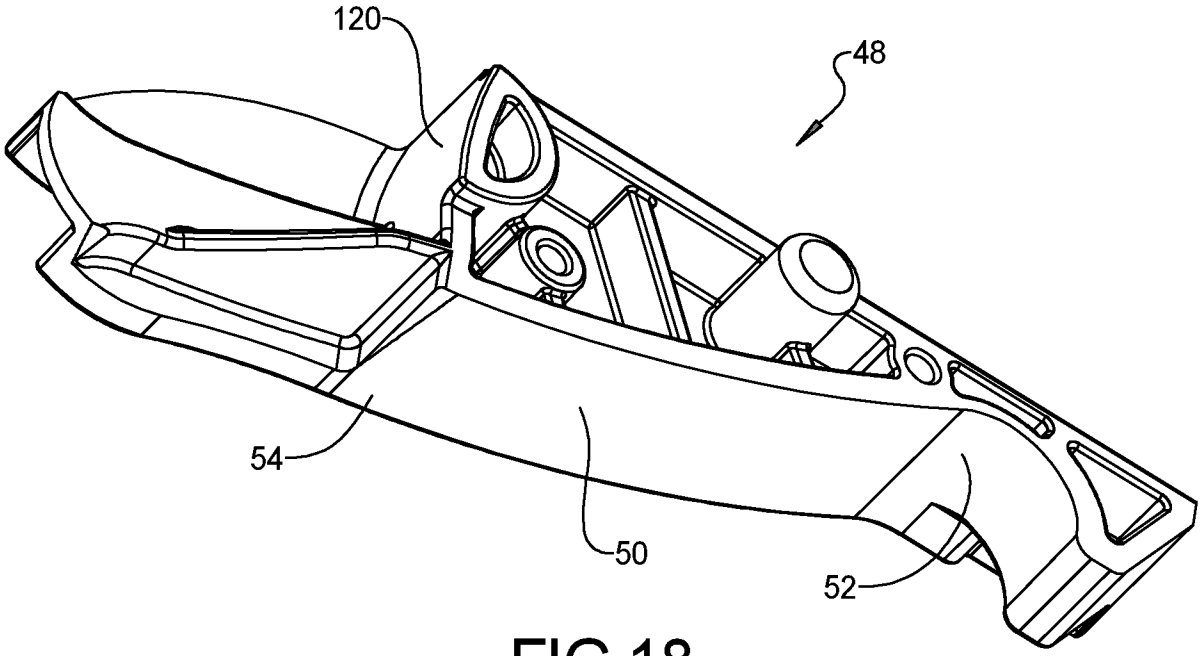
FIG. 18 is a perspective view of a cam of the seat bottom assembly.

The seat bottom assembly 32 may also include a pair of cams 48 (FIGS. 16-18). Each cam 48 is fixedly mounted to a corresponding one of the seat bottom support members 38 (e.g., at or near a front end of the seat bottom support member 38). Each cam 48 may include a sloped or inclined surface 50. The inclined surface 50 includes a front end 52 and a rear end 54 (see FIG. 18). The inclined surface 50 is oriented relative to the seat bottom support member 38 such that the front end 52 of the inclined surface 50 is closer to the seat bottom support member 38 than the rear end 54.

Figure 12:
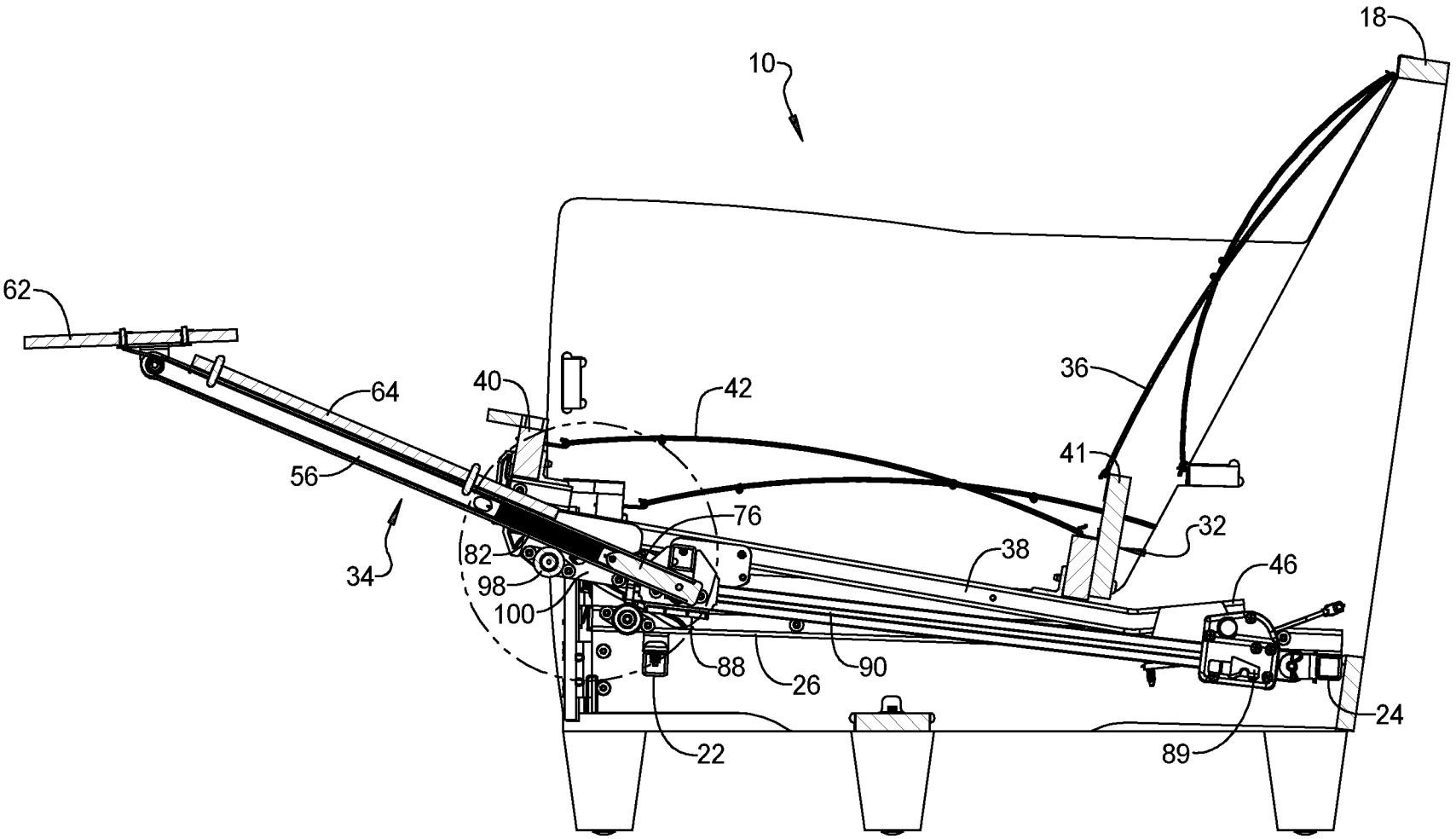
FIG. 12 is a cross-sectional view of the furniture member with the seat bottom assembly in the tilt position and the legrest mechanism in the second extended position.

As described above, the seat bottom assembly 32 is movable between a nominal position (see FIGS. 3 and 8) and a tilt position (see FIG. 12). The seat bottom assembly 32 moves forward and tilts (i.e., the front end of the seat bottom assembly 32 is tipped upward and the rear end of the seat bottom assembly 32 is tipped downward) as it moves from the nominal position to the tilt position. The seat bottom assembly 32 may be rollingly supported by the front and rear wheels 28, 30 mounted to the base support members 26 of the base frame 20. That is, the front wheels 28 may rollingly support the inclined surfaces 50 of the cams 48, and the rear wheels 30 may rollingly support the rear ends of the seat bottom support members 38. When the seat bottom assembly 32 is in the nominal position, the front wheels 28 may be in contact with the front ends 52 of the inclined surfaces 50 of the cams 48, and the rear wheels 30 are in contact with the straight portions 44 of the seat bottom support member 38, as shown in FIGS. 16 and 17. As will be described in more detail below, the seat bottom assembly 32 may move forward along the front and rear wheels 28, 30 from the nominal position to the tilt position. In the tilt position, the front wheels 28 are in contact with the rear ends 54 of the inclined surfaces 50 of the cams 48 and the rear wheels 30 are in contact with the inclined portions 46 of the seat bottom support members 38.

Figure 8:
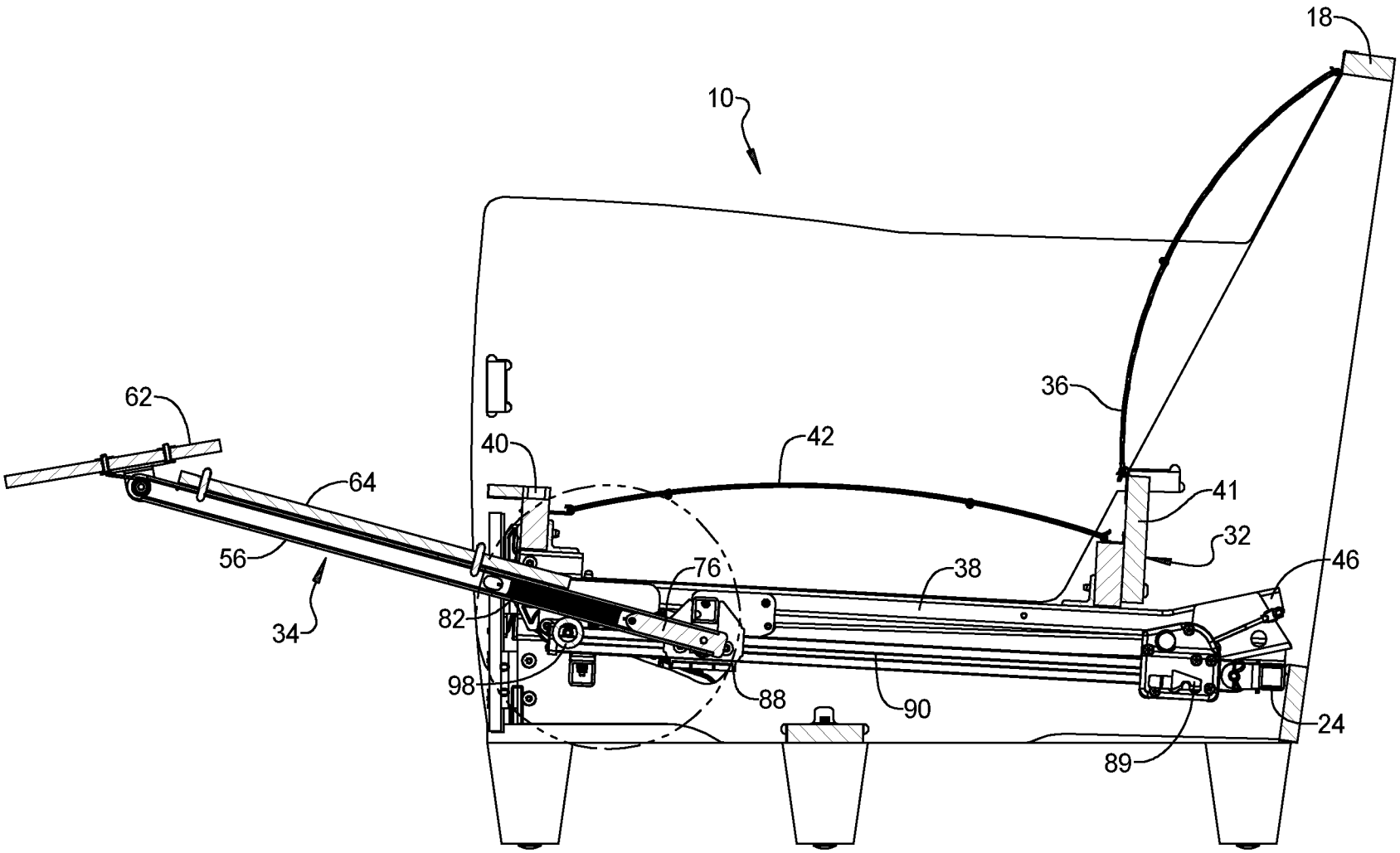
FIG. 8 is a cross-sectional view of the furniture member with the seat bottom assembly in the nominal position and the legrest mechanism in the first extended position.
Figure 19:
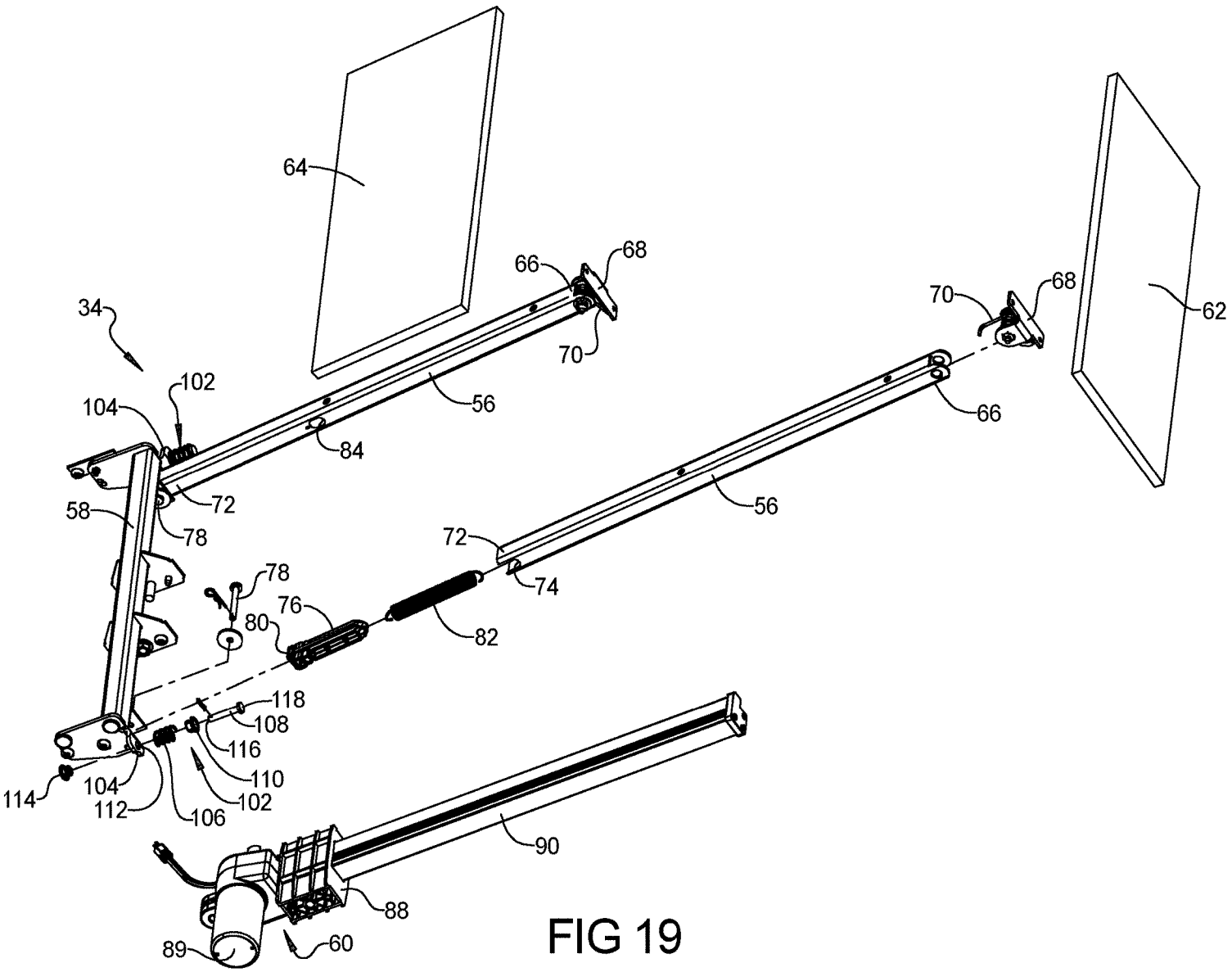
FIG. 19 is a partially exploded perspective view of the legrest mechanism.
Figure 20:
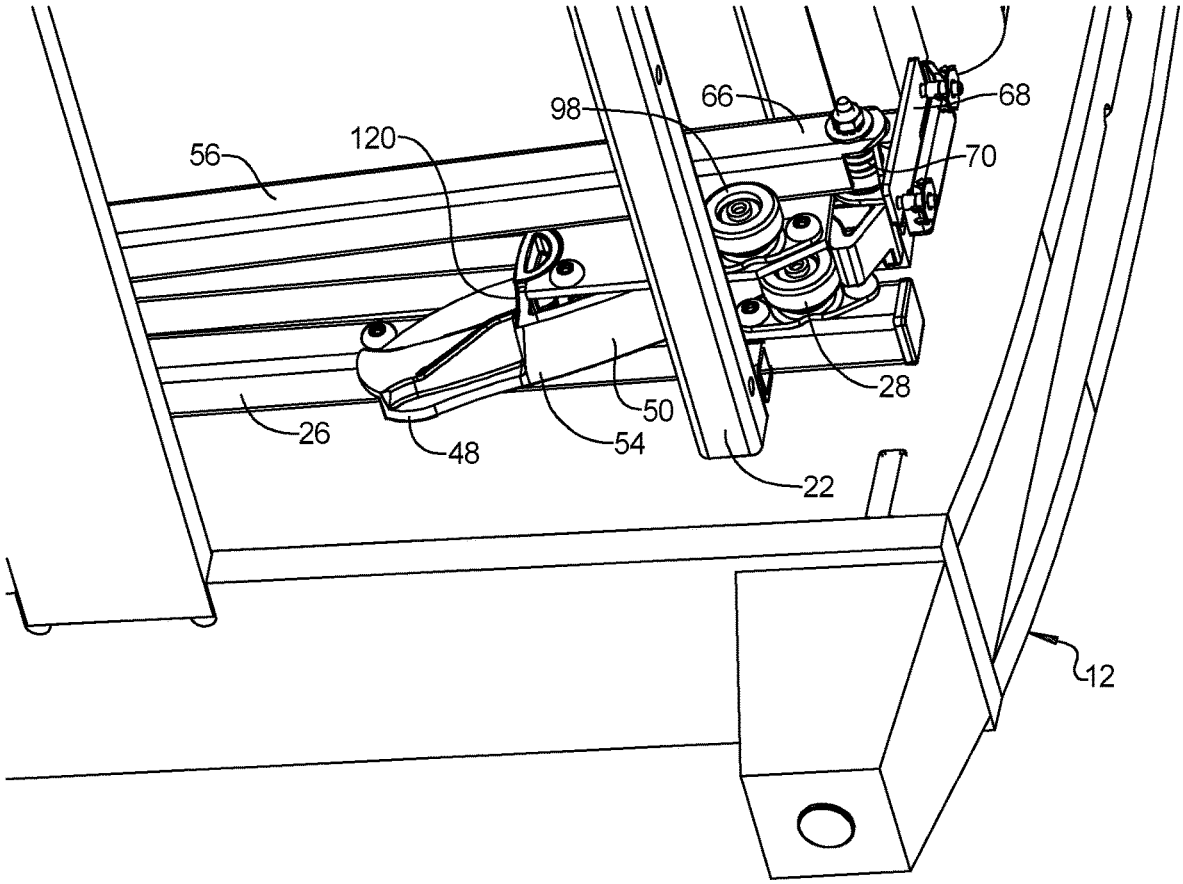
FIG. 20 is a partial perspective view of the furniture member with the seat bottom assembly in the nominal position and the legrest mechanism in the retracted position.

As shown in FIG. 19, the legrest mechanism 34 may include a pair of legrest support members 56, a cross member 58, a motor assembly 60, a legrest platform 62, and an ottoman platform 64. The legrest support members 56 can be hollow beams having first ends 66 pivotably engaging the legrest platform 62 via brackets 68. The pivotable engagement between the brackets 68 and the legrest support members 56 allow the legrest platform 62 to rotate relative to the legrest support member 56 between a stowed position (FIG. 3) and a deployed position (FIGS. 8 and 12). Torsion springs 70 rotationally bias the legrest platform 62 toward the deployed position. Therefore, as the legrest mechanism 34 moves away from the retracted position, the torsion springs 70 will force the legrest platform 62 to move into the deployed position.

Figure 4:
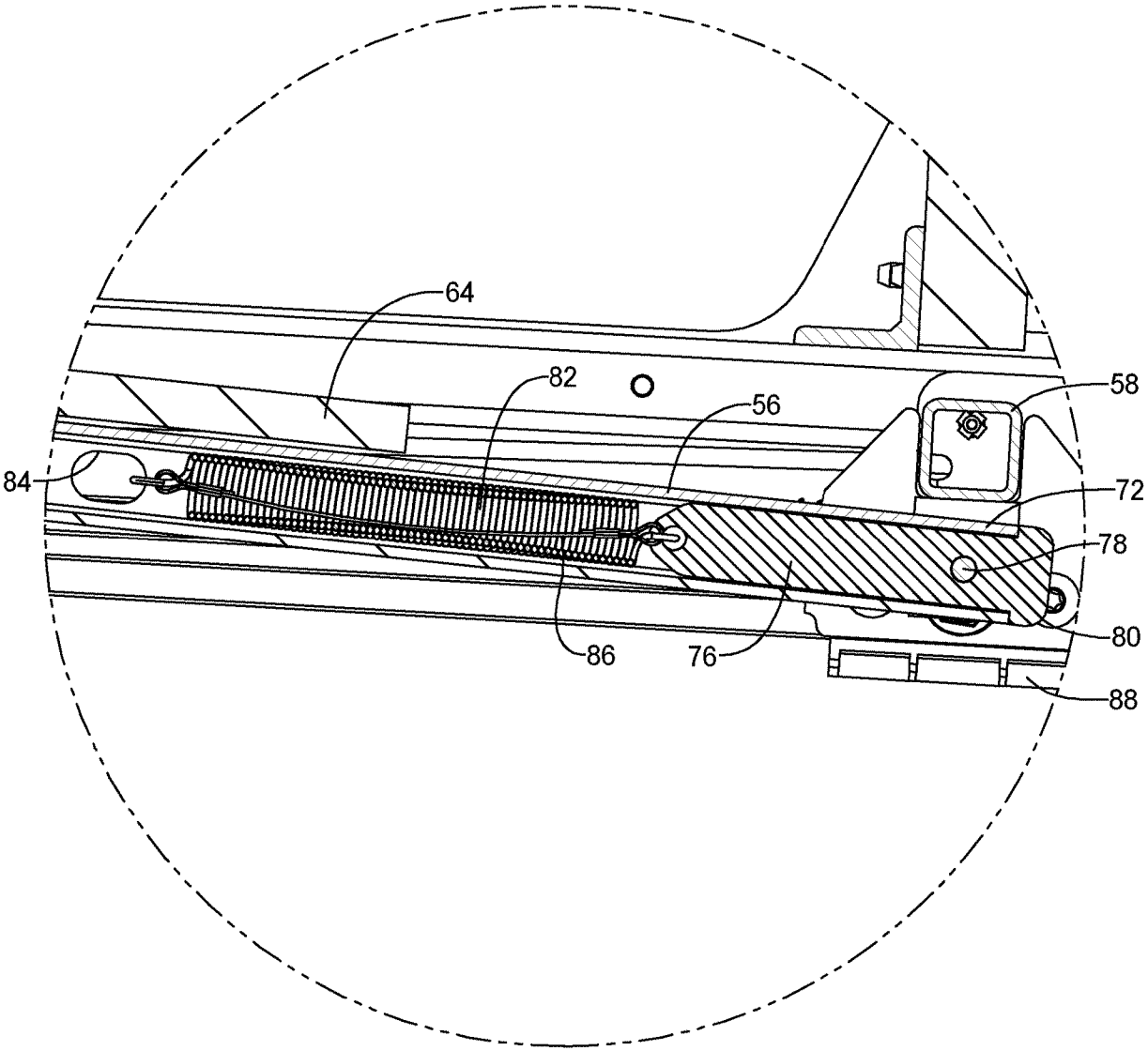
FIG. 4 is a detailed cross-sectional view of a portion of the furniture member in the position of FIGS. 1-3.
Figure 9:
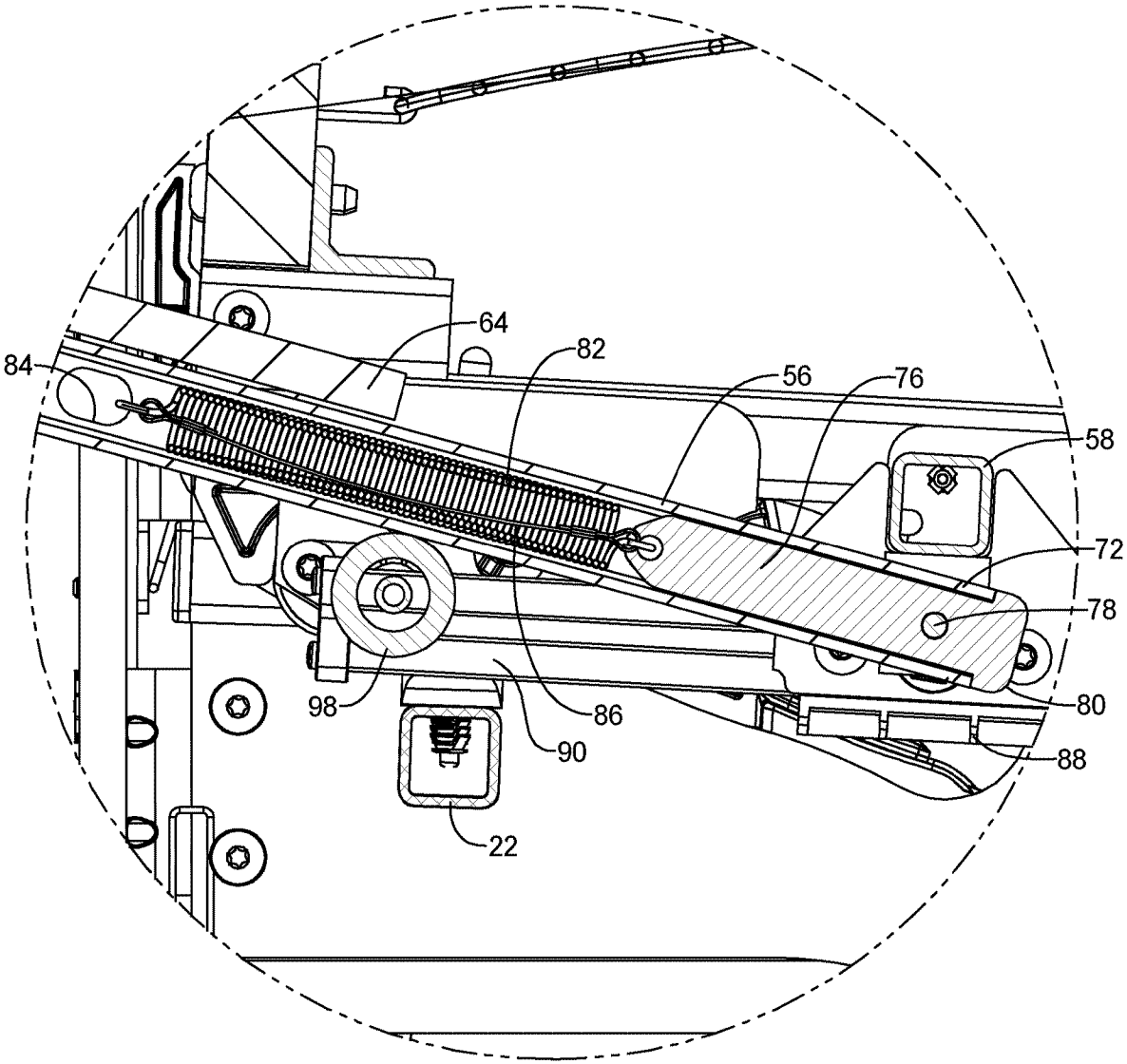
FIG. 9 is a detailed cross-sectional view of a portion of the furniture member in the position of FIGS. 6-8.
Figure 13:
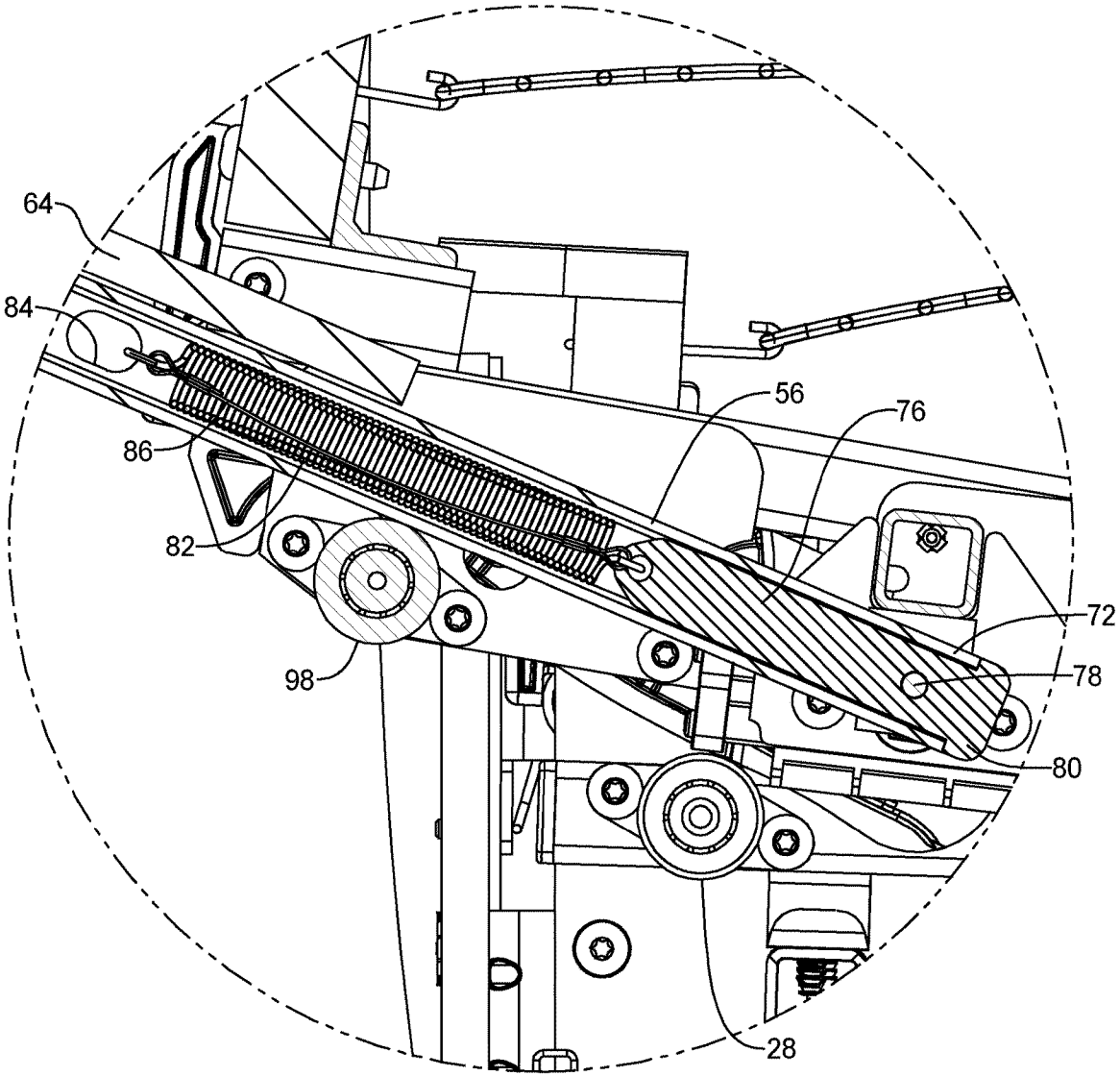
FIG. 13 is a detailed cross-sectional view of a portion of the furniture member in the position of FIGS. 10-12.

As shown in FIG. 19, second ends 72 of the legrest support members 56 include a cutout 74. The second ends 72 of the legrest support members 56 may be movably coupled to the cross member 58 by inserts 76. As shown in FIGS. 4, 9, 13, and 28, the inserts 76 are slidably received inside of the hollow legrest support members 56 through openings in the second ends 72. The inserts 76 are pivotably coupled to the cross member 58 by fasteners or pins 78. The pins 78 may extend through the cutouts 74 in the second ends 72 of the legrest support members 56. The legrest support members 56 are slidably along the lengths of the inserts 76 (compare FIGS. 9 and 28). A flange 80 formed on one end of each insert 76 may limit the range of motion of the legrest support members 56 relative to the inserts 76 (i.e., the flanges 80 may limit the rearward motion of the legrest support members 56 and may prevent the inserts 76 from being entirely received inside of the legrest support members 56 by butting up against the ends 72 of the legrest support members 56, as shown in FIGS. 4, 9, and 13).

As shown in FIGS. 4, 9, and 13, a spring 82 may be received within each of the legrest support members 56. One end of each spring 82 may engage the rim of an aperture 84 in a corresponding one of legrest support members 56, and the other end of each spring 82 may engage a corresponding one of the inserts 76. The springs 82 bias the legrest support members 56 toward the flanges 80 of the inserts 76.

Figure 28:
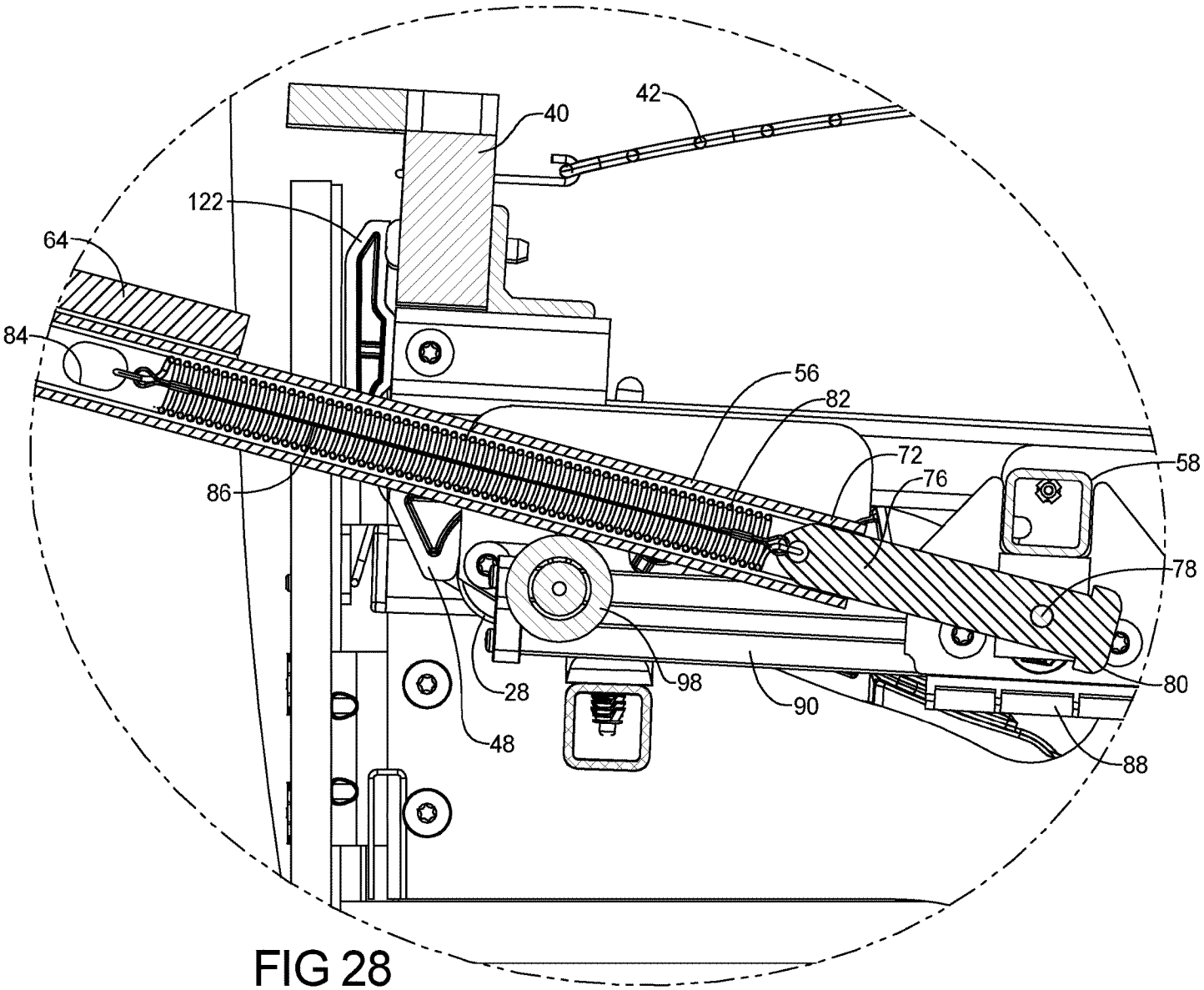
FIG. 28 is a detailed cross-sectional view of a portion of the furniture member with legrest support member of the legrest mechanism displaced relative to an insert of the legrest mechanism.

In some configurations, a cable 86 (e.g., a substantially non-stretchable cable) may be attached to both ends of the spring 82 and limits an amount that the spring 82 can be stretched and limits the range of motion of the legrest support members 56 relative to the inserts 76. When the legrest support members 56 are in contact with the flanges 80 of the inserts 76, the cable 86 is in a slack (i.e., not taut) condition (shown in FIGS. 4, 9, and 13). As the legrest support members 56 move away from the flanges 80, the cable 86 is pulled into a taut condition, as shown in FIG. 28. When the cable 86 is in the taut condition, the cable 86 prevents further stretching of the spring 82 and prevents further movement of the legrest support members 56 away from the flanges 80. In some configurations, the spring 82 does not include a cable 86 attached thereto.

Figure 6:
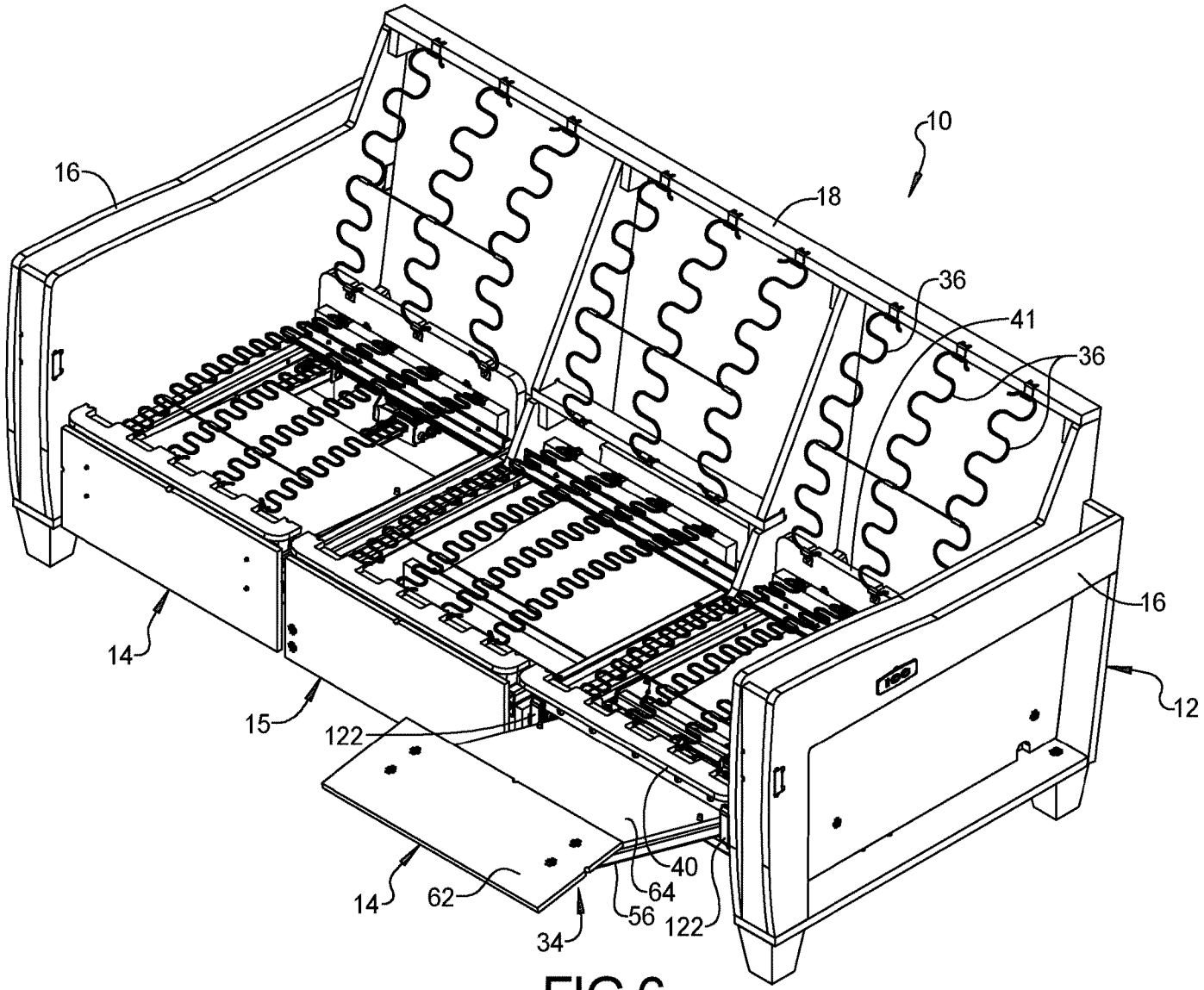
FIG. 6 is a perspective view of the furniture member with the seat bottom assembly in the nominal position and the legrest mechanism in a first extended position.
Figure 7:
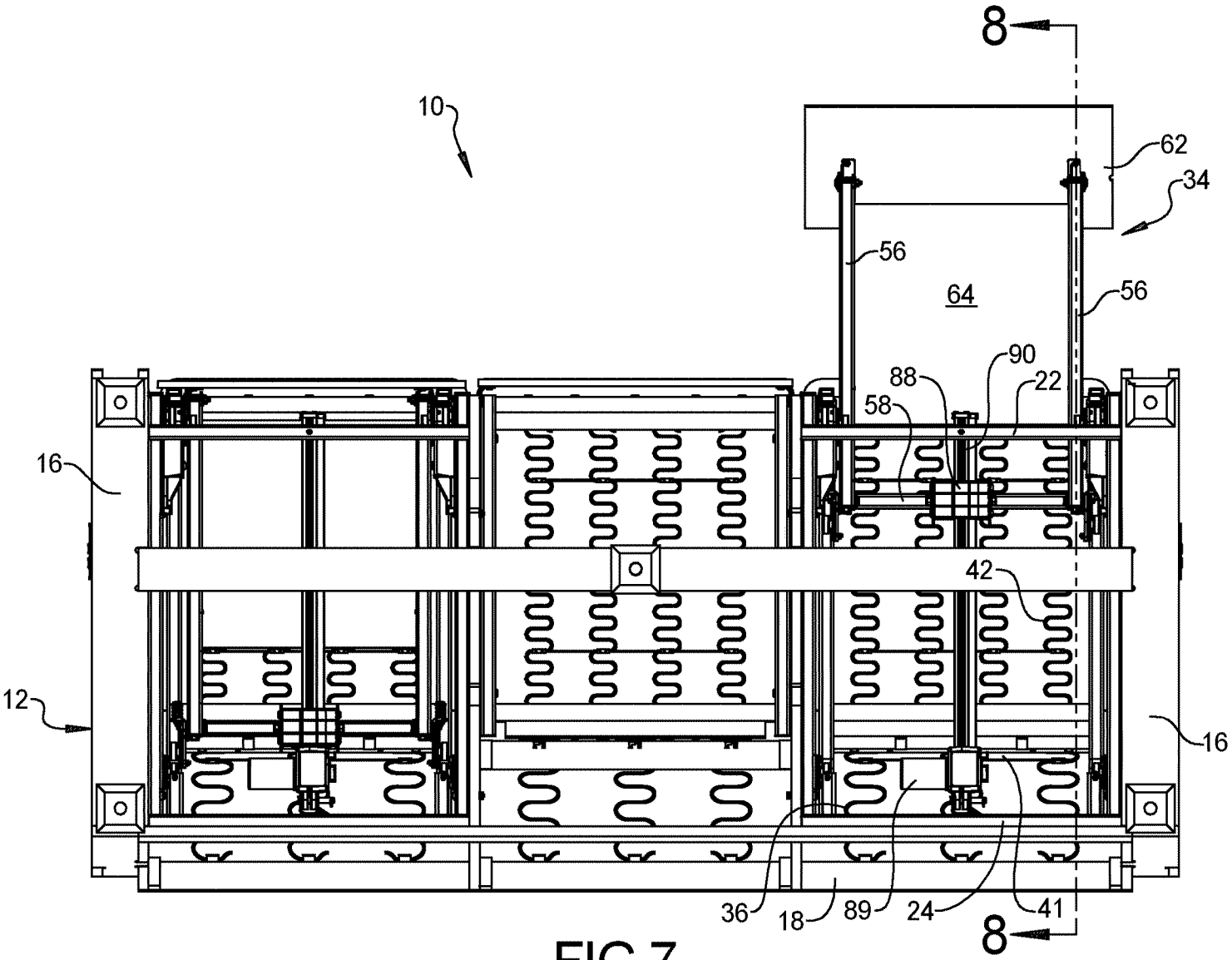
FIG. 7 is a bottom view of the furniture member with the seat bottom assembly in the nominal position and the legrest mechanism in the first extended position.
Figure 10:
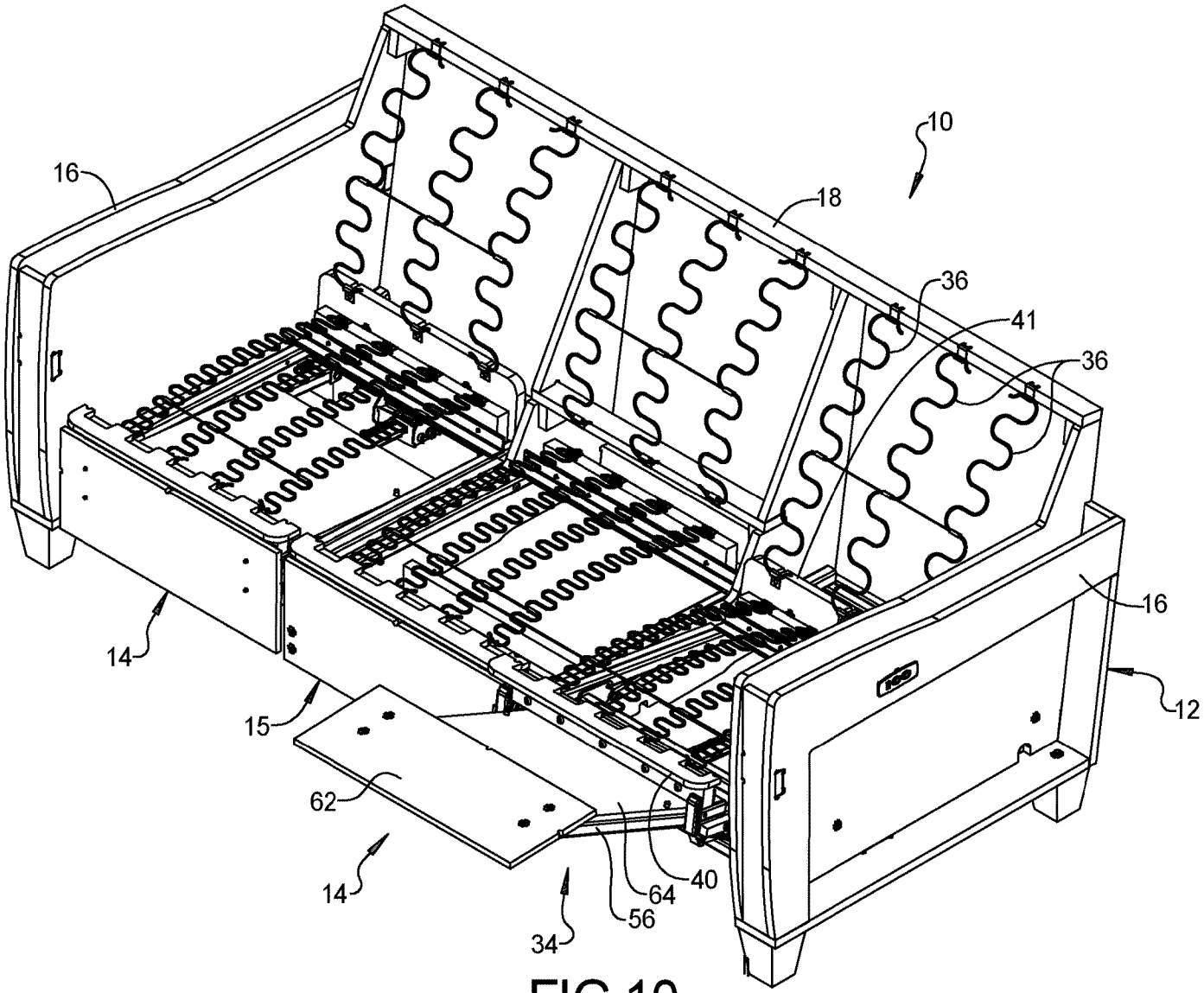
FIG. 10 is a perspective view of the furniture member with the seat bottom assembly in a tilt position and the legrest mechanism in a second extended position.
Figure 11:
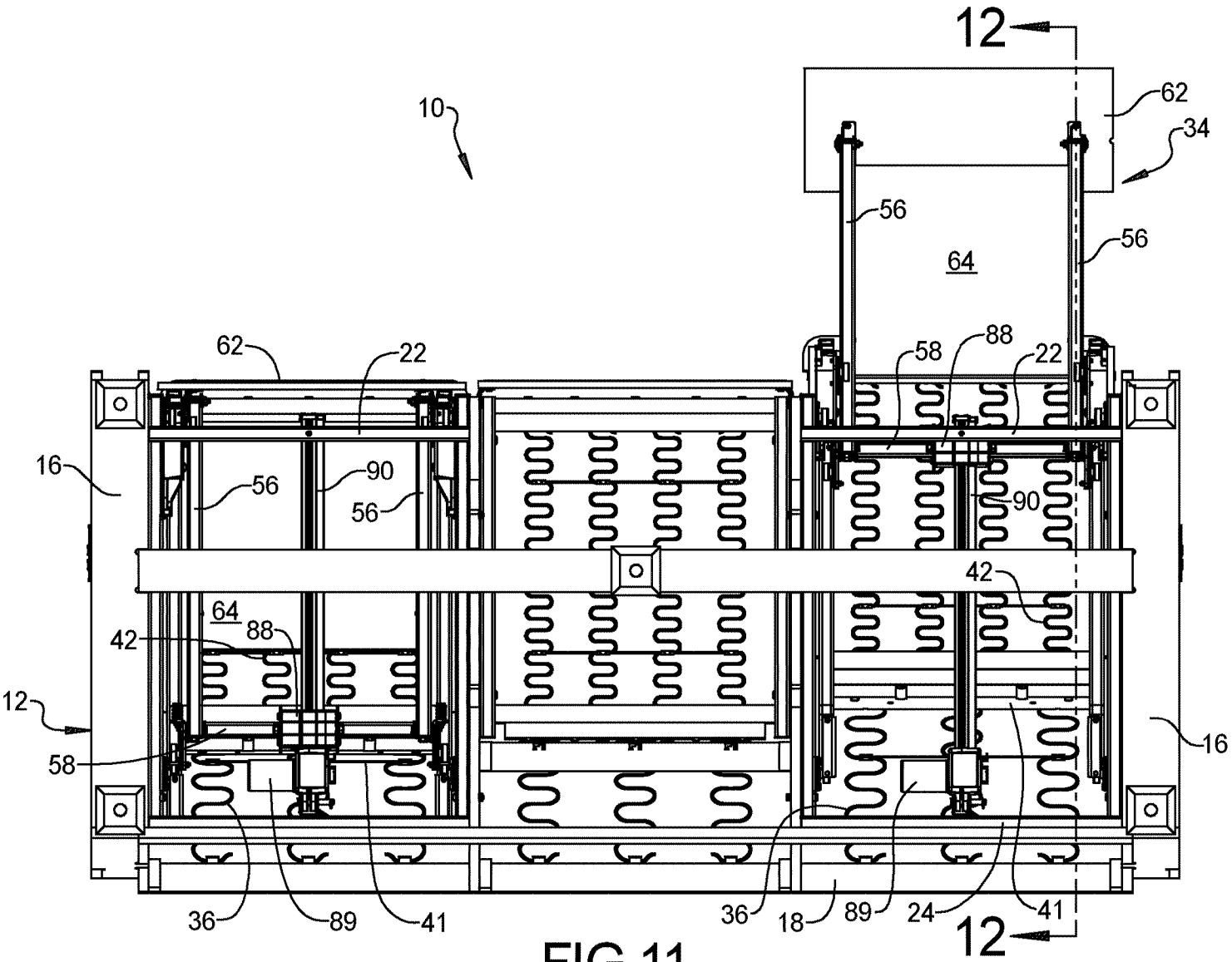
FIG. 11 is a bottom view of the furniture member with the seat bottom assembly in the tilt position and the legrest mechanism in the second extended position.

The ottoman platform 64 may be fixedly mounted to the legrest support members 56 between the first and second ends 66, 72. The ottoman platform 64 may restrict access to inner components of the furniture member 10 and conceal the inner components from a user's view when the legrest mechanism 34 is in the first extended and second extended positions, as shown in FIGS. 6 and 10. In some configurations, a foldable or stretchable piece of upholstery (not shown) can be attached to the ottoman platform 64 and the legrest platform 62 to fill the space between the ottoman platform 64 and the legrest platform 62 and further conceal the inner components.

As described above, the cross member 58 is connected to the legrest support members 56 by the inserts 76 and pins 78. As shown in FIGS. 16 and 17, the cross member 58 is also attached to a slider block 88 of the motor assembly 60. Operation of a motor 89 of the motor assembly 60 causes the slider block 88 to slide along a guide rail 90 attached to the motor 89. As shown in FIG. 16, the motor 89 may be pivotably connected to the rear cross member 24 of the base frame 20 by a bracket 92 and pin 94. The guide rail 90 is also supported by the front cross member 22 when the legrest mechanism 34 is in the retracted position and when the legrest mechanism 34 is in the first extended position. As the legrest mechanism 34 moves into the second extended position, the motor 89 and the guide rail 90 pivot about the pin 94 such that the guide rail 90 is lifted up off of the front cross member 22. That is, the guide rail 90 may rest on a bumper 96 on the front cross member 22 (FIG. 15) when the legrest mechanism 34 is in the retracted position and the first extended position, and the guide rail 90 may be spaced apart from the bumper 96 when the legrest mechanism 34 is in the second extended position (FIG. 14).

Figure 3:
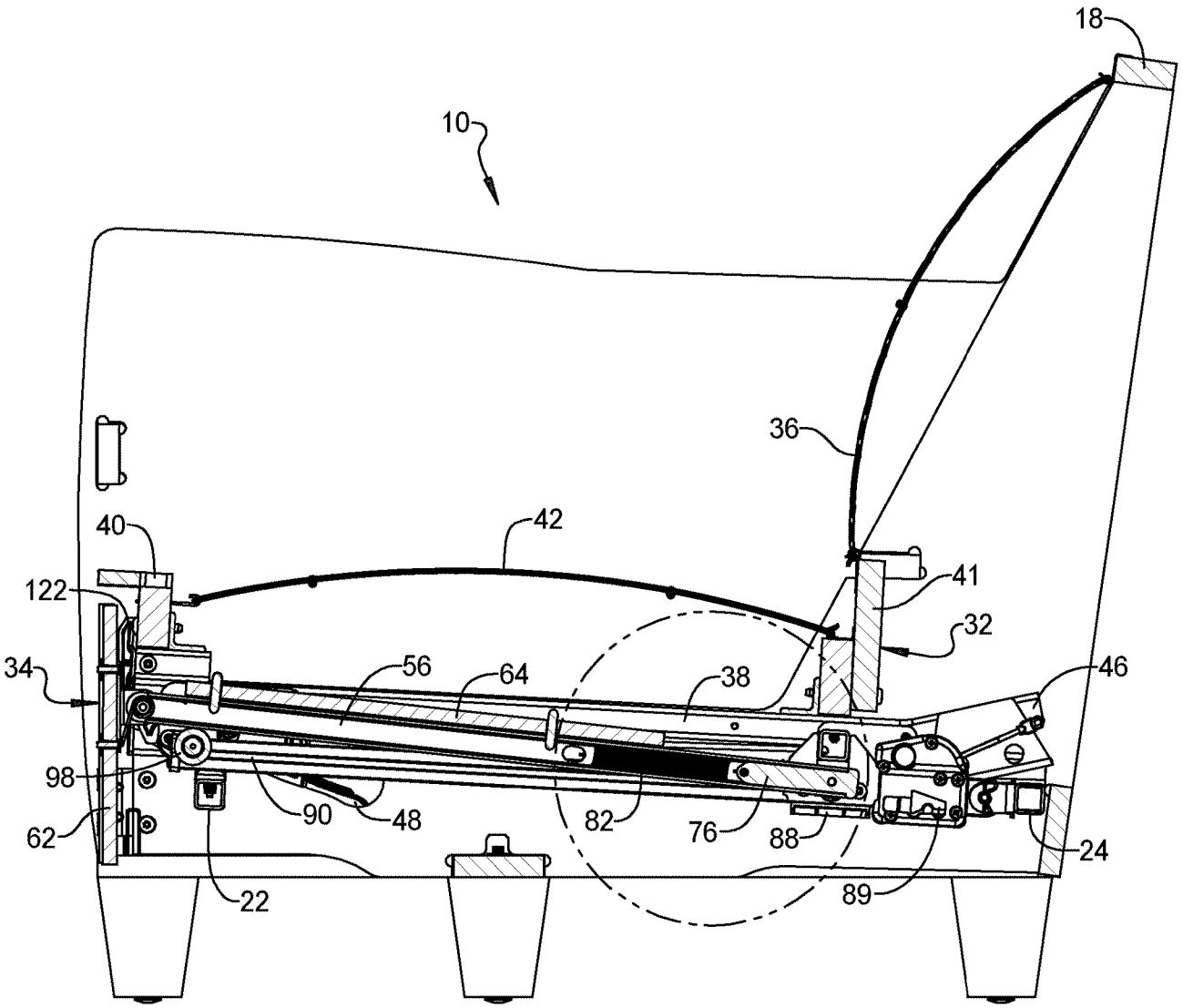
FIG. 3 is a cross-sectional view of the furniture member with the seat bottom assembly in the nominal position and the legrest mechanism in the retracted position.

As shown in FIGS. 14-17, the legrest support members 56 may be rollingly supported by rollers or wheels 98 mounted on brackets 100 that are fixedly attached to the cams 48 and/or the seat bottom support members 38. To move the legrest mechanism 34 among the retracted, first extended, and second extended positions, the motor 89 moves the slider block 88 along the guide rail 90, which moves the legrest support members 56 along the wheels 98 (as shown in FIGS. 3, 8, and 12).

As shown in FIGS. 16, 17, and 19, the cross member 58 of the legrest mechanism 34 also includes a pair of spring-loaded bumpers 102. The bumpers 102 may be mounted on brackets 104 fixed on the ends of the cross member 58. As shown in FIG. 19, each of the bumpers 102 may include a compression spring 106, a pin 108, and a cap 110. The pin 108 may extend through the center of the spring 106 and through an aperture 112 in the bracket 104. A nut 114 may engage a distal end 116 of the pin 108. The cap 110 may engage a head 118 of the pin 108 and an end of the spring 106. The pin 108 can reciprocate within the aperture 112. The spring 106 is disposed between the head 118 of the pin 108 and the bracket 104 and biases the head 118 of the pin 108 away from the bracket 104.

Figure 21:
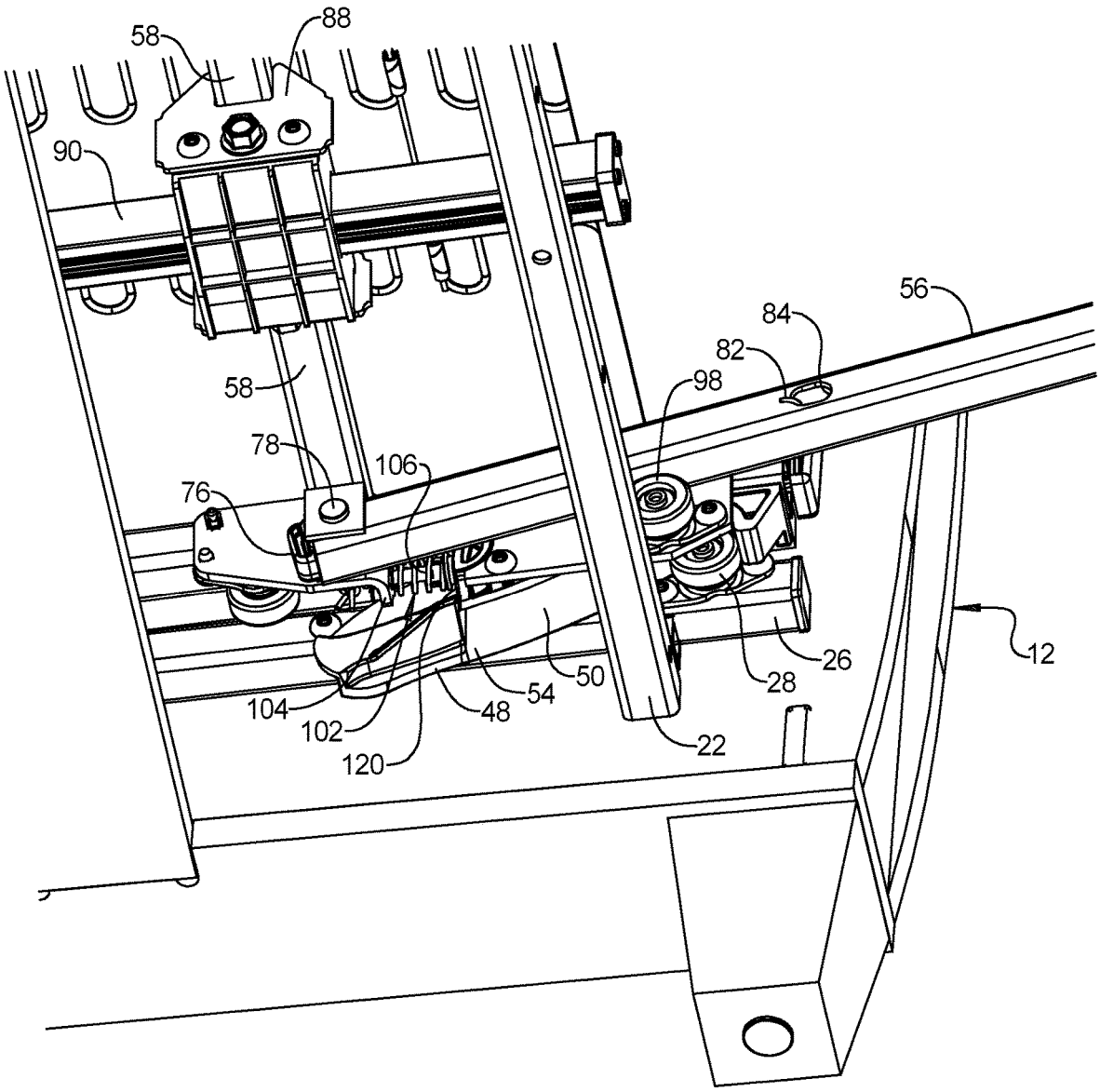
FIG. 21 is a partial perspective view of the furniture member with the seat bottom assembly in the nominal position, the legrest mechanism in the first extended position, and a spring-loaded bumper making initial contact with the cam and in an uncompressed state.
Figure 22:
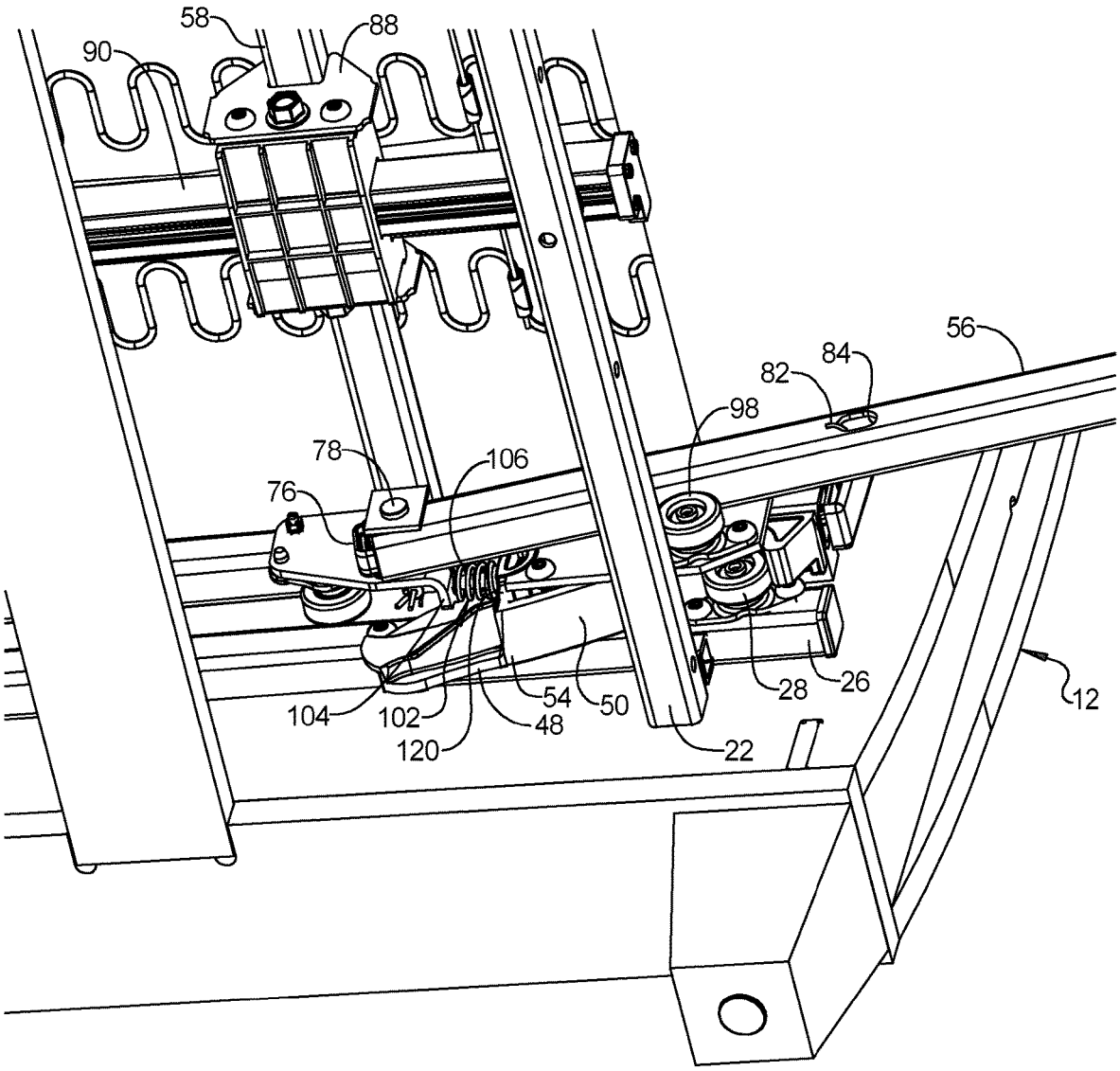
FIG. 22 is a partial perspective view of the furniture member with the seat bottom assembly in the nominal position, the legrest mechanism in the first extended position, and the spring-loaded bumper in contact with the cam and in a compressed state.
Figure 23:
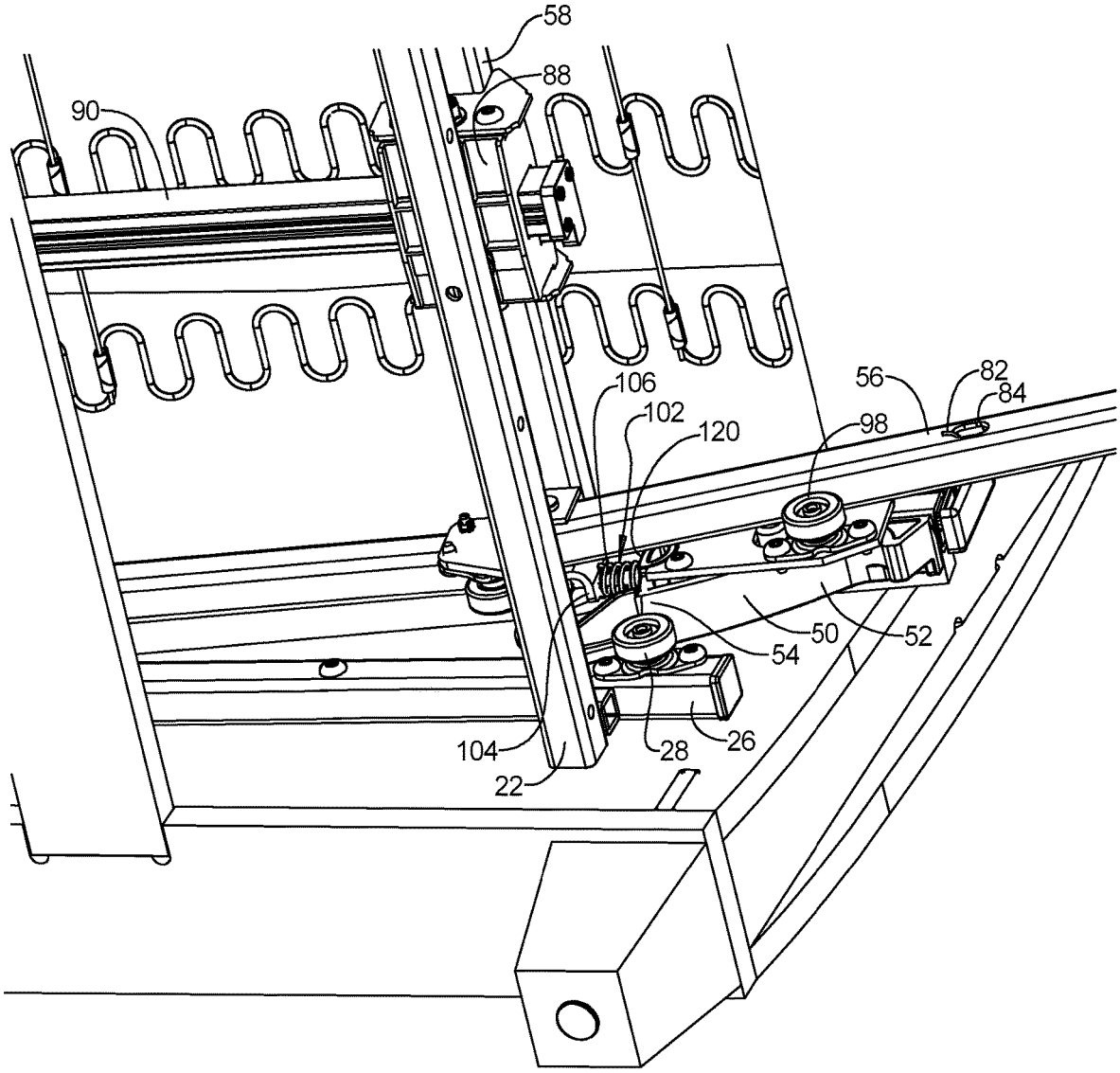
FIG. 23 is a partial perspective view of the furniture member with the seat bottom assembly in the tilt position and the legrest mechanism in the second extended position.
Figure 24:
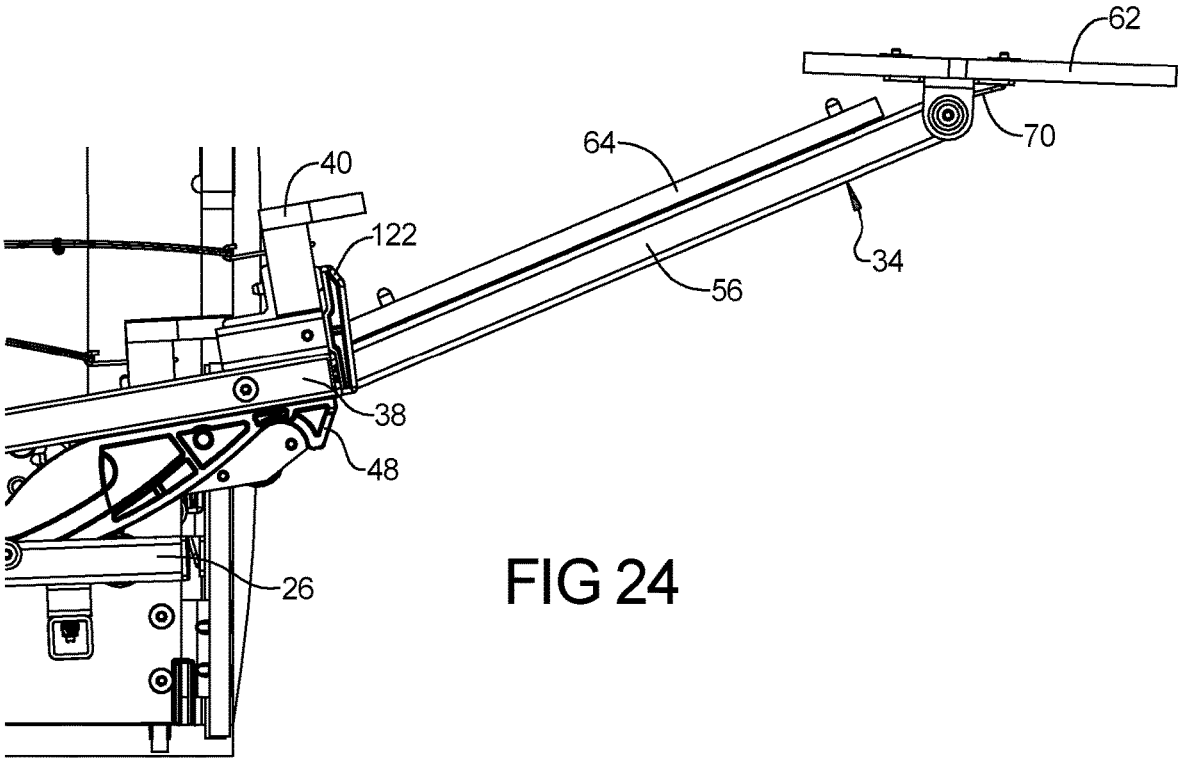
FIG. 24 is a partial side view of the furniture member with the seat bottom assembly in the tilt position and the legrest mechanism in the second extended position.

As shown in FIGS. 5 and 16, the bumpers 102 are spaced apart from (i.e., not in contact with) the cams 48 when the legrest mechanism 34 is in the retracted position. As shown in FIG. 21, when the legrest mechanism 34 is moved into the first extended position, the bumpers 102 come into contact with ledges 120 formed on the cam 48 (also see FIG. 18). As the slide block 88 continues to move the legrest mechanism 34 from the first extended position toward the second extended position, the springs 106 of the bumpers 102 compress and the pins 108 of the bumpers 102 are pushed through the aperture 112 in the bracket 104 (compare FIGS. 21 and 22).

Once the springs 106 are compressed, continued movement of the slide block 88 toward the second extended position will be transmitted to the seat bottom assembly 32. That is, when the springs 106 are sufficiently compressed, the contact between the bumpers 102 and the cams 48 will cause the seat bottom assembly 32 to move forward with the legrest mechanism 34 as the legrest mechanism 34 continues its movement toward the second extended position (compare FIGS. 22 and 23). As the seat bottom assembly 32 is moved forward, the inclined surfaces 50 of the cams 48 move along the wheels 28, thereby causing the seat bottom assembly 32 to tilt relative to the base frame 20.

In this manner, movement of the legrest mechanism 34 relative to the stationary frame assembly 12 from the first extended position to the second extended position causes corresponding movement of the seat bottom assembly 32 relative to the stationary frame assembly 12 from the nominal position (FIG. 8) to the tilt position (FIG. 12).

In some configurations, the bumpers 102 are not spring loaded. In such configurations, the bumpers 102 could be rigid members that contact the cams 48 to transmit movement of the legrest mechanism 34 to the seat bottom assembly 32 as the legrest mechanism 34 moves from the first extended position to the second extended position. In such configurations, there might not be any relative movement between the legrest mechanism 34 and the seat bottom assembly 32 as the legrest mechanism 34 moves between the first and second extended positions and the seat bottom assembly 32 moves between the nominal and tilt positions. However, spring-loading the bumpers 102 may reduce or prevent any jarring that an occupant of the furniture member 10 may feel as the bumpers 102 impact the cams 48 to push the seat bottom assembly 32 toward the tilt position.

As shown in FIG. 12, the forward and tilting movement of the seat bottom assembly 32 into the tilt position moves the rear cross member 41 of the seat bottom assembly 32 forward and downward. Such displacement of the rear cross member 41 stretches and changes the shape of the backrest support springs 36 (see FIGS. 10 and 12). That is, the backrest support springs 36 have a first shape when the seat bottom assembly 32 is in the nominal position (FIGS. 1, 3, 6, and 8), and the backrest support springs 36 have a second shape (different from the first shape) when the seat bottom assembly 32 is in the tilt position (FIGS. 10 and 12). The position of the seat bottom assembly 32 and the shape of the backrest support springs 36 when the seat bottom assembly 32 is in the tilt position put a person sitting on the seat bottom assembly 32 in a more reclined position, which may increase the person's comfort.

In some configurations, upholstery and padding (not shown) can cover the backrest support springs 36 and the arm rest frames 16. A foldable or stretchable piece of upholstery (not shown) can connect the backrest upholstery with the arm rest upholstery to fill the space between the backrest upholstery and the arm rest upholstery while allowing relative movement between the backrest upholstery and the armrest upholstery.

Operation of the motor 89 to move the slider block 88 rearward will move the legrest mechanism 34 from the second extended position to the first extended position and then to the retracted position. As the legrest mechanism 34 moves from the second extended position toward the first extended position, gravity will cause the seat bottom assembly 32 to move from the tilt position toward the nominal position.

Figure 25:
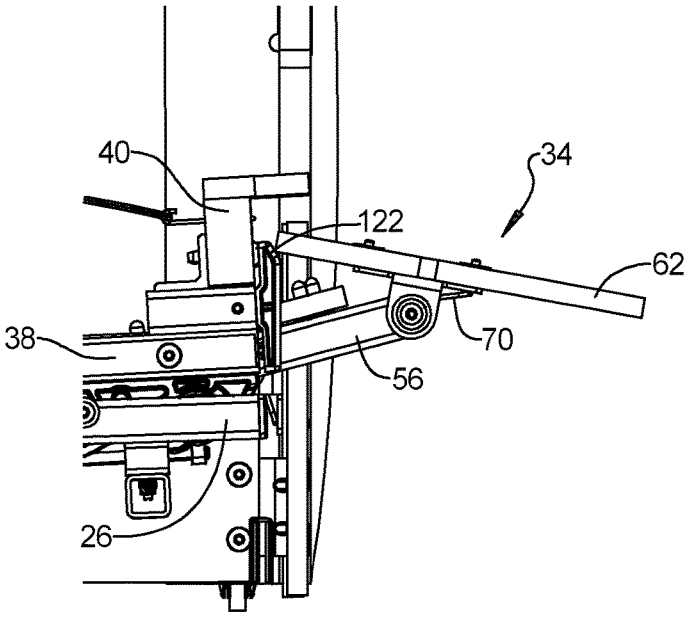
FIG. 25 is a partial side view of the furniture member with the seat bottom assembly in the nominal position and the legrest mechanism approaching the retracted position.
Figure 26:
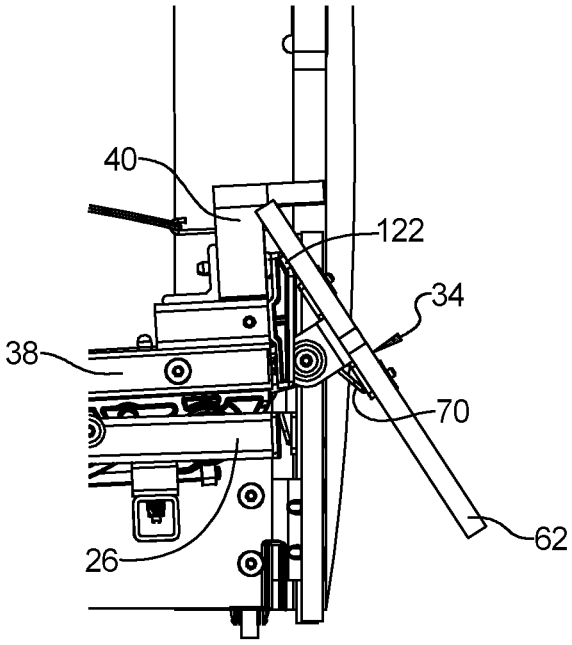
FIG. 26 is a partial side view of the furniture member with the seat bottom assembly in the nominal position and the legrest mechanism further approaching the retracted position.
Figure 27:
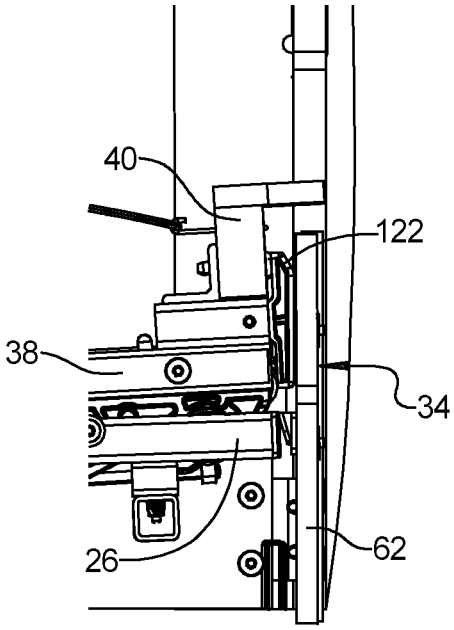
FIG. 27 is a partial side view of the furniture member with the seat bottom assembly in the nominal position and the legrest mechanism in the retracted position.

FIGS. 24-27 show the movement of the legrest mechanism 34 from the second extended position to the retracted position. As shown in FIG. 25, as the legrest mechanism 34 approaches the retracted position, the legrest platform 62 may contact a pair of caps 122 fixedly mounted to the front cross member 40 and/or forward ends of the seat bottom support members 38. Contact between the caps 122 and the legrest platform 62 and continued movement of the legrest mechanism 34 toward the retracted position causes the legrest platform 62 to rotate relative to the legrest support members 56 (against the biasing force of the torsion springs 70) until the legrest platform 62 is flat against the caps 122.

In the event that an obstruction and/or some outside force restricts movement of the legrest platform 62 and legrest support members 56 from moving toward the retracted position while the slide block 88 of the motor assembly 60 is moving rearward, the inserts 76 can slide partially out of the second ends 72 of the legrest support members 56, as shown in FIG. 28. While the inserts 76 are sliding relative to the legrest support members 56, the entire force with which the slider block 88 is being moved rearward is not transmitted to the outside obstruction that is restricting movement of the legrest platform 62 and legrest support members 56. In this manner, the interface between the inserts 76 and the legrest support members 56 prevent the full force of the motor 89 from acting on the obstruction for the range motion of the inserts 76 relative to the legrest support members 56. This allows time for the obstruction to be moved out of the way (i.e., moved out of the path of the legrest platform 62 and legrest support members 56) before the obstruction can be caught between the legrest platform 62 and the seat bottom assembly 32 or the base frame 20.

Figure 29:
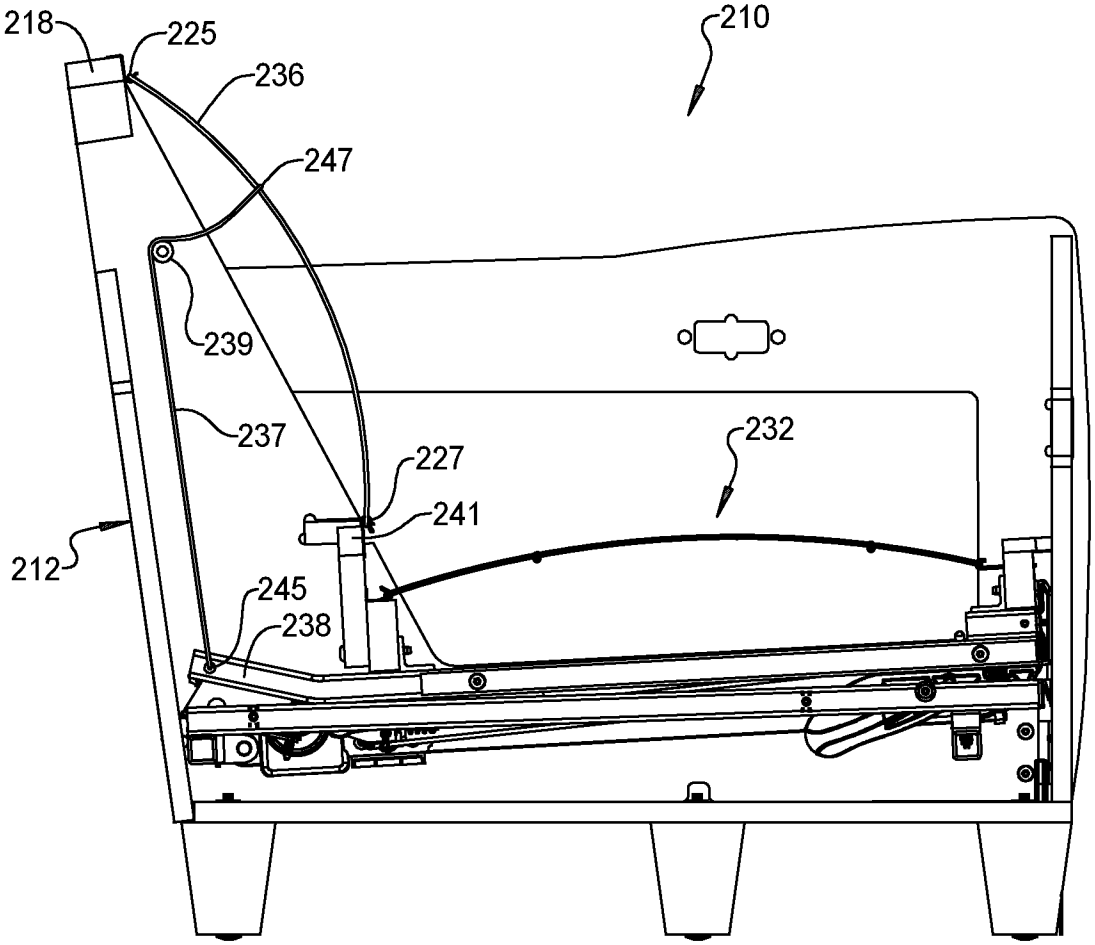
FIG. 29 is a side view of a portion of another furniture member with a seat bottom assembly in a nominal position and a legrest mechanism in a retracted position.
Figure 30:
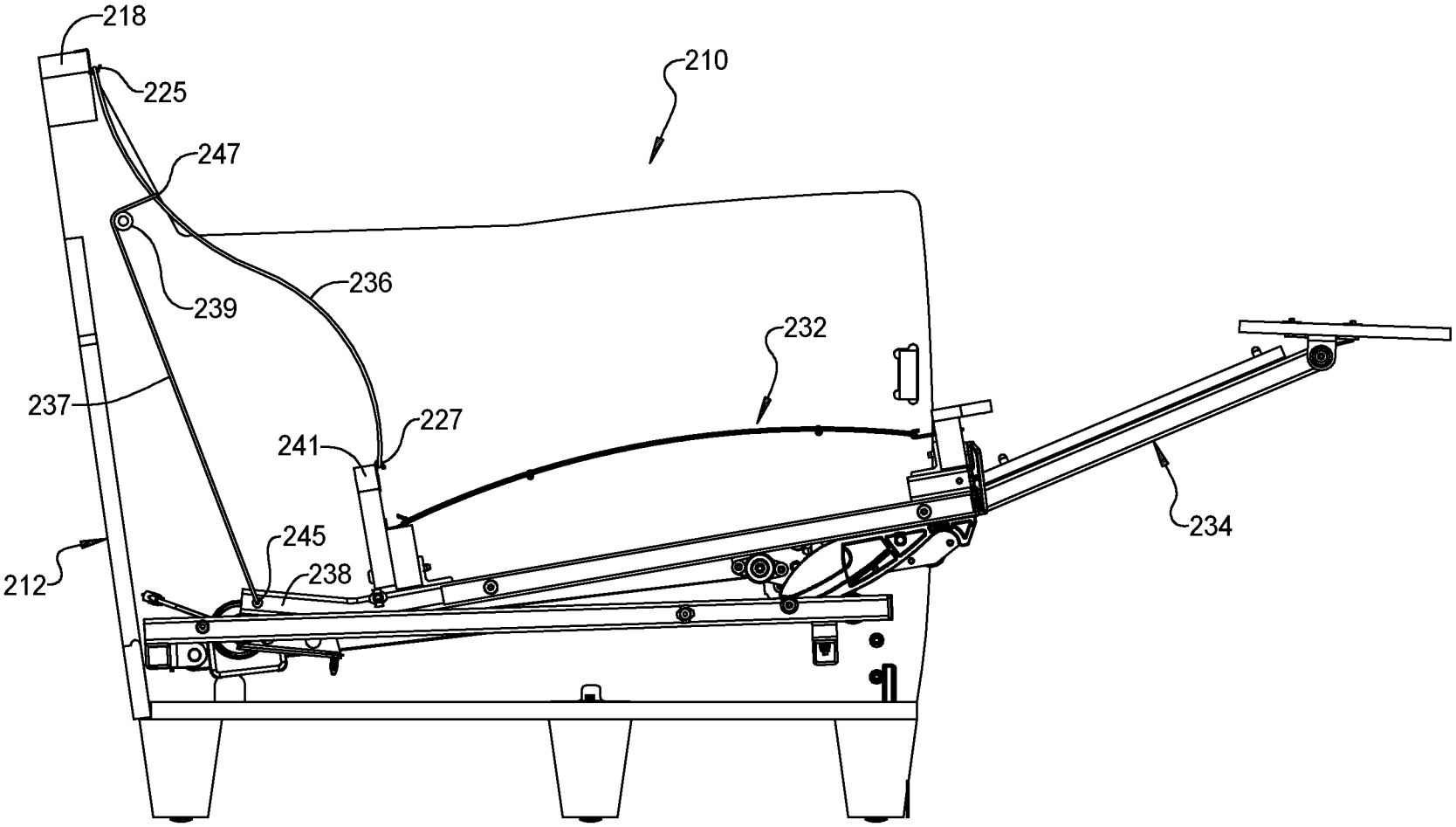
FIG. 30 is a side view of the portion of the furniture member of FIG. 29 with the seat bottom assembly in a tilt position and a legrest mechanism in a second extended position.

Referring now to FIGS. 29 and 30, another furniture member 210 is provided. The furniture member 210 may include a stationary frame assembly 212, a seat bottom assembly 232, a legrest mechanism 234, and one or more backrest support springs 236. The stationary frame assembly 212, seat bottom assembly 232, legrest mechanism 234, and backrest support springs 236 could be similar or identical to the stationary frame assembly 12, seat bottom assembly 32, legrest mechanism 34, and backrest support springs 36 described above, except for any exceptions described below. Therefore, similar features will not be described again in detail.

Like the furniture member 10, the backrest support springs 236 of the furniture member 210 are attached at a first end 225 to a stationary seatback frame 218 and attached at a second end 227 to a rear cross member 241 of the seat bottom assembly 232. A first end 245 of a cable 237 may be attached to a seat bottom support member 238 of the seat bottom assembly 232, and a second end 247 of the cable 237 may be attached to an intermediate portion of the backrest support spring 236 (i.e., a portion between the opposing ends of the backrest support spring 236). The cable 237 may engage one or more pulleys 239 mounted to the stationary frame assembly 212.

When the seat bottom assembly 232 moves from the nominal position (FIG. 29) into the tilt position (FIG. 30), the seat bottom support member 238 pulls the first end 245 of the cable 237 forward and downward relative to the stationary frame assembly 212 and the pulley 239. Pulling on the cable 237 in this manner causes the cable 237 to pull the intermediate portion of the backrest support spring 236 rearward and downward relative to the stationary frame assembly 212 and the ends of the backrest support spring 236, thereby changing the shape of the backrest support spring 236. The position of the pulley 239 and the length of the cable 237 can be chosen to achieve a desired amount and direction of the displacement of the intermediate portion of the backrest support spring 236.

Furthermore, as described above, because the first end 225 of the backrest support spring 236 is attached to the stationary seatback frame 218 and the second end 227 of the backrest support spring 236 is attached to the seat bottom support member 238, movement of the seat bottom assembly 232 between the nominal and tilt positions also moves the second end 227 of the backrest support spring 236 relative to the first end 225, thereby further contributing to the shape change of the backrest support spring 236.

Referring now to FIGS. 31-40, another furniture member 310 is provided. The furniture member 310 may include a stationary frame assembly 312 and one or more movable seat assemblies 314 that are supported by the stationary frame assembly 312 and movable relative to the stationary fame assembly 312. In some configurations, the furniture member 310 may include a stationary seat assembly (e.g., a middle seat assembly disposed between two movable seat assemblies 314; not shown). It will be appreciated that the furniture member 310 could include any number of stationary seat assemblies 15 (e.g., zero, one, or more than one).

The stationary frame assembly 312 could include structure and functionality that is similar or identical to the stationary frame assembly 12 or 212. That is, the stationary frame assembly 312 may include pair of stationary armrest frames 316, a stationary seatback frame 318, one or more base frames (not shown; similar or identical structure and function as base frames 20), and legs 319.

Each movable seat assembly 314 may include a seat bottom assembly 332, a legrest mechanism 334, and one or more backrest support springs 336. The seat bottom assembly 332, legrest mechanism 334, and backrest support springs 336 could include structure and functionality similar or identical to the seat bottom assembly 32, 232, the legrest mechanism 34, 234, and the backrest support springs 36, 236 described above. As described above with respect to the movable seat assemblies 14, the movable seat assemblies 314 are individually movable relative to the stationary frame assembly 312 among a first position (see FIGS. 31 and 32; similar or identical to the position shown in FIG. 1-5 or 29), a second position (similar or identical to the position shown in FIGS. 6-9), and a third position (see FIG. 33; similar or identical to the position shown in FIG. 10-14 or 30) while the stationary frame assembly 312 remains stationary relative to a ground surface (e.g., a floor) upon which the furniture member 310 is disposed. That is, the armrest frames 316, seatback frame 318, base frames, and legs 319 are all fixed relative to each other and remain fixed relative to each other and the ground while the movable seat assemblies 314 move among the first, second and third positions.

As shown in FIGS. 31-35, the furniture member 310 includes seat bottom cushions 333, seatback cushions 337, and armrest cushioning 339. Upholstery (e.g., fabric, leather, etc.) 341 may at least partially cover the cushions 333, 337, 339, legrest platforms 362, mid-ottoman platforms 364, and the stationary frame assembly 312.

Figure 31:
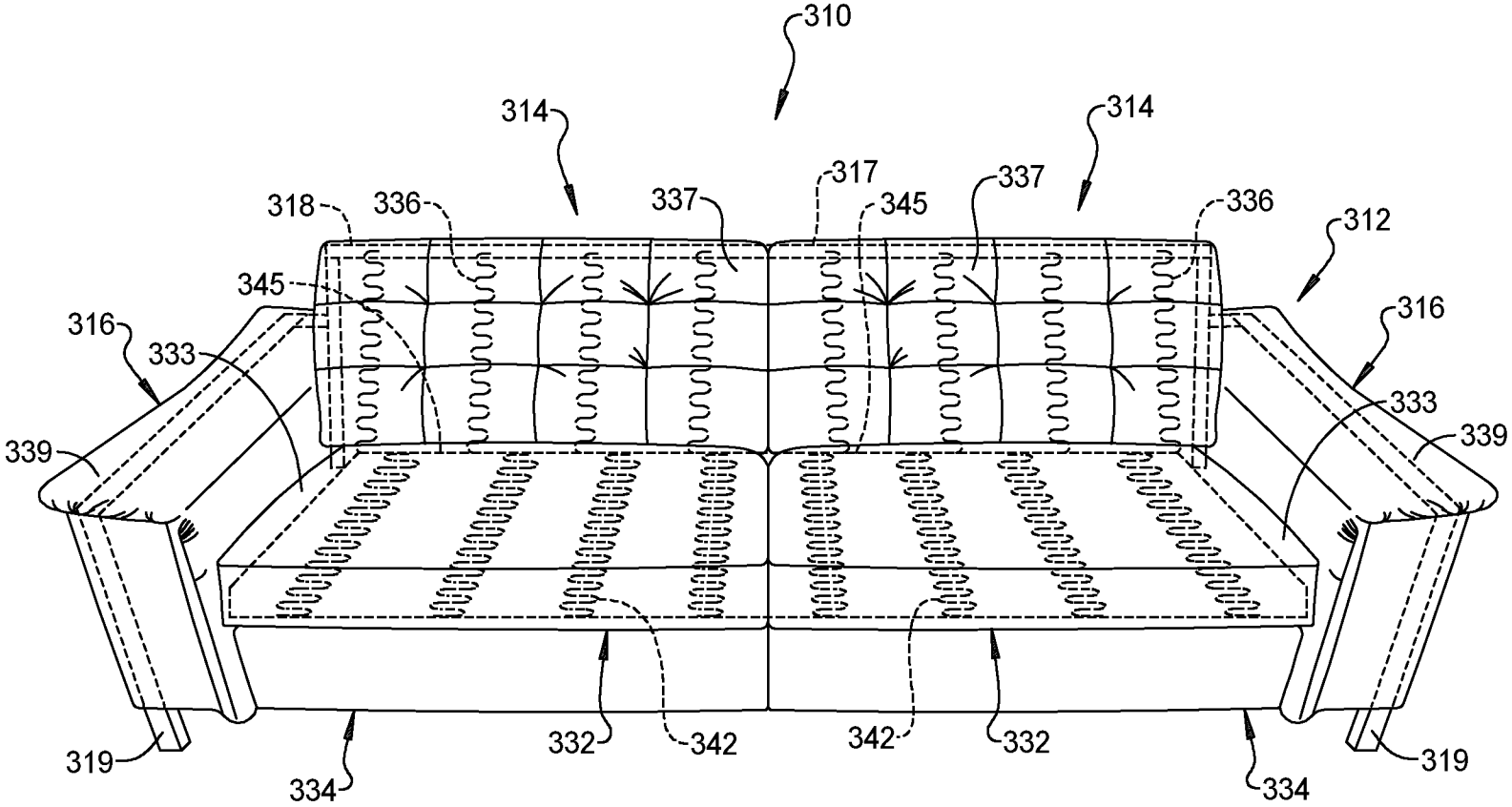
FIG. 31 is a front perspective view of another furniture member having a seat bottom assembly in a nominal position and a legrest mechanism in a retracted position.
Figure 32:
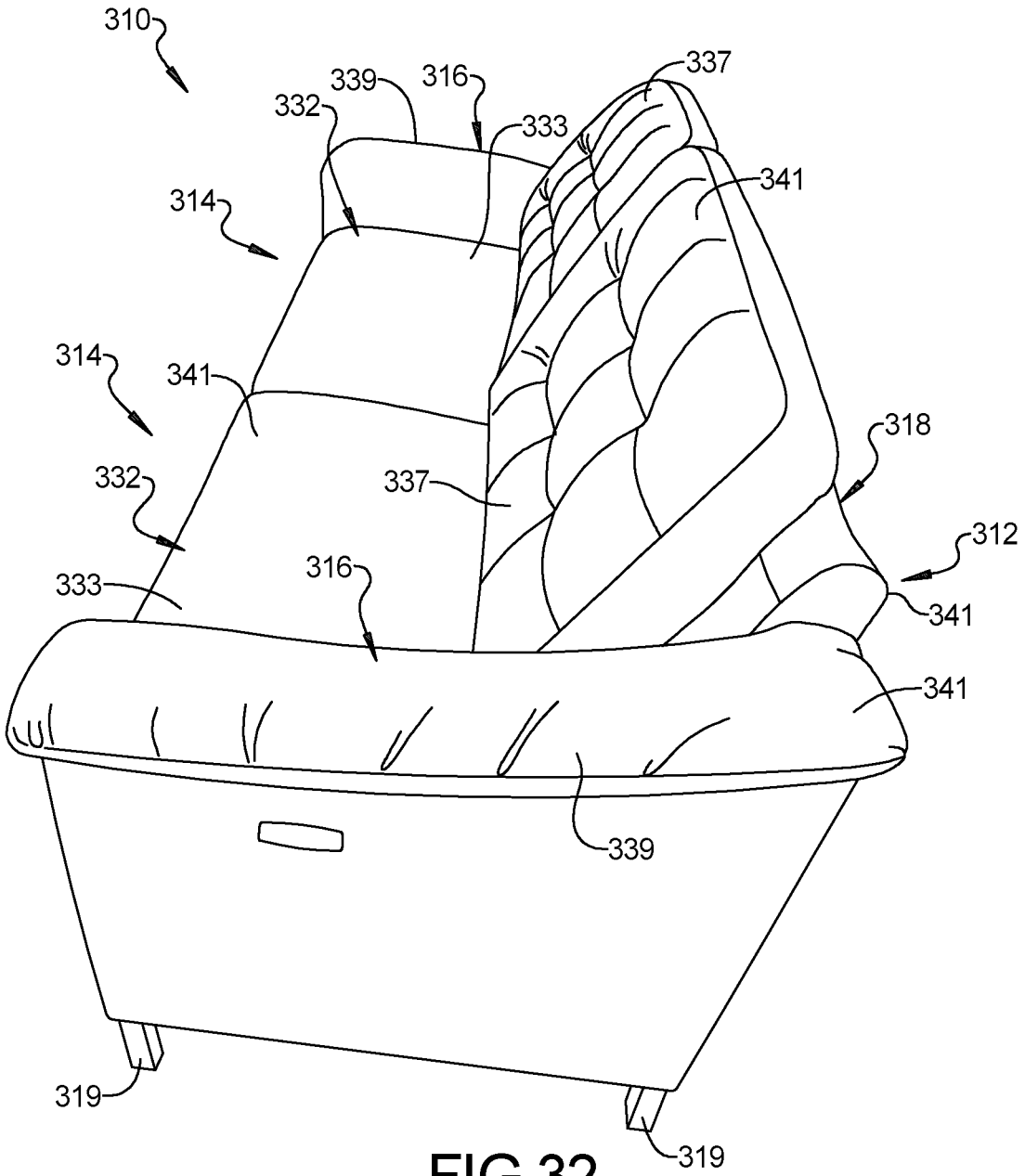
FIG. 32 is a side perspective view of the furniture member of FIG. 31 with the seat bottom assembly in the nominal position and the legrest mechanism in the retracted position.
Figure 33:
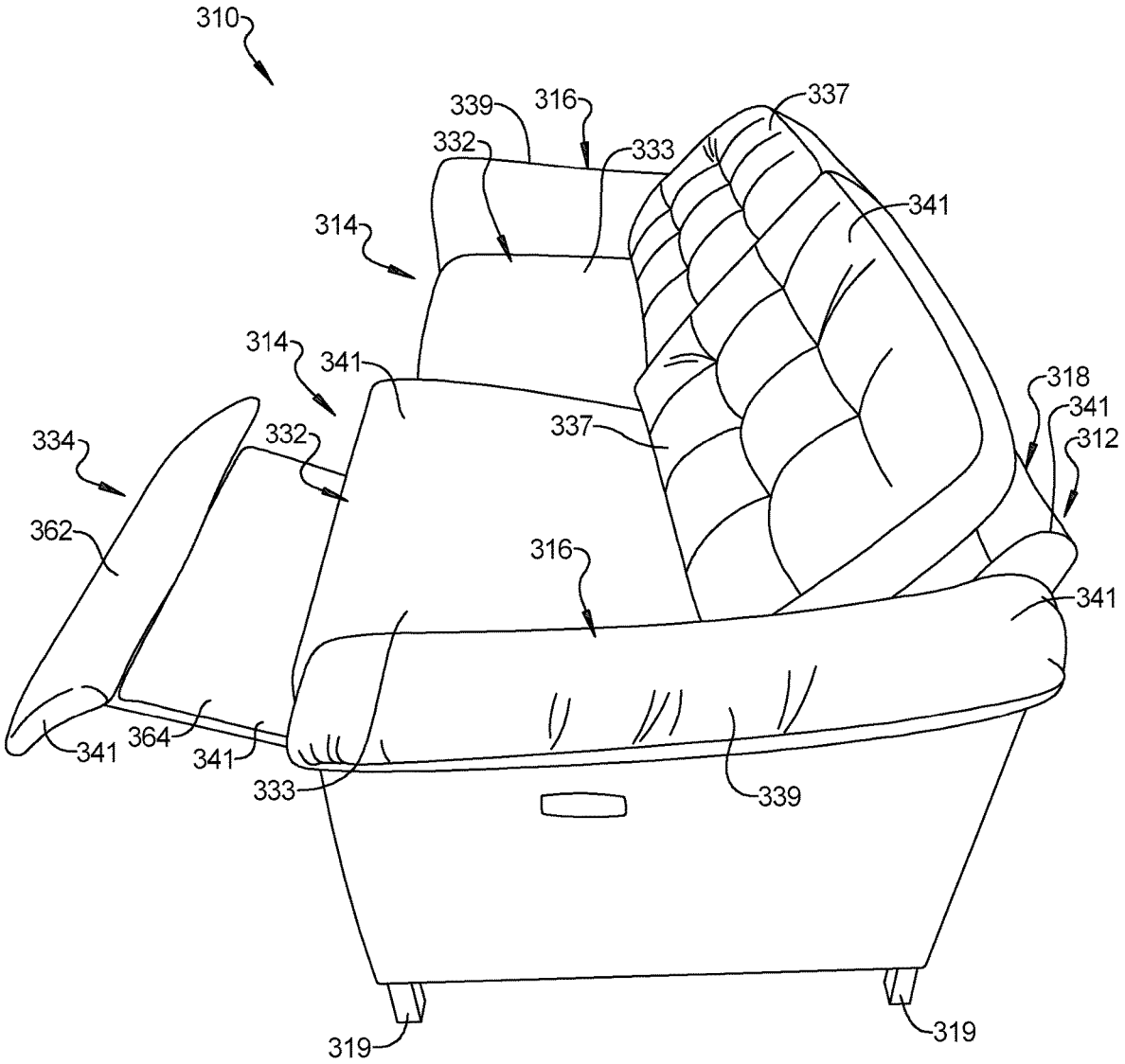
FIG. 33 is a side perspective view of the furniture member of FIG. 31 with the seat bottom assembly in a tilt position and the legrest mechanism in a fully extended position.

Each seat bottom cushion 333 is a part of or disposed on a respective one of the seat bottom assemblies 332 (e.g., on top of seat bottom springs 342, as shown in FIG. 31) and is movable with the respective seat bottom assemblies 332 relative to the stationary frame assembly 312 between the first position (FIGS. 31 and 32) and the third position (FIG. 33). The seatback cushions 337 are each attached to a respective set of backrest support springs 336 and are movable with the respective backrest support springs 336 relative to the stationary frame assembly 312 between the first and third positions.

Figure 34:
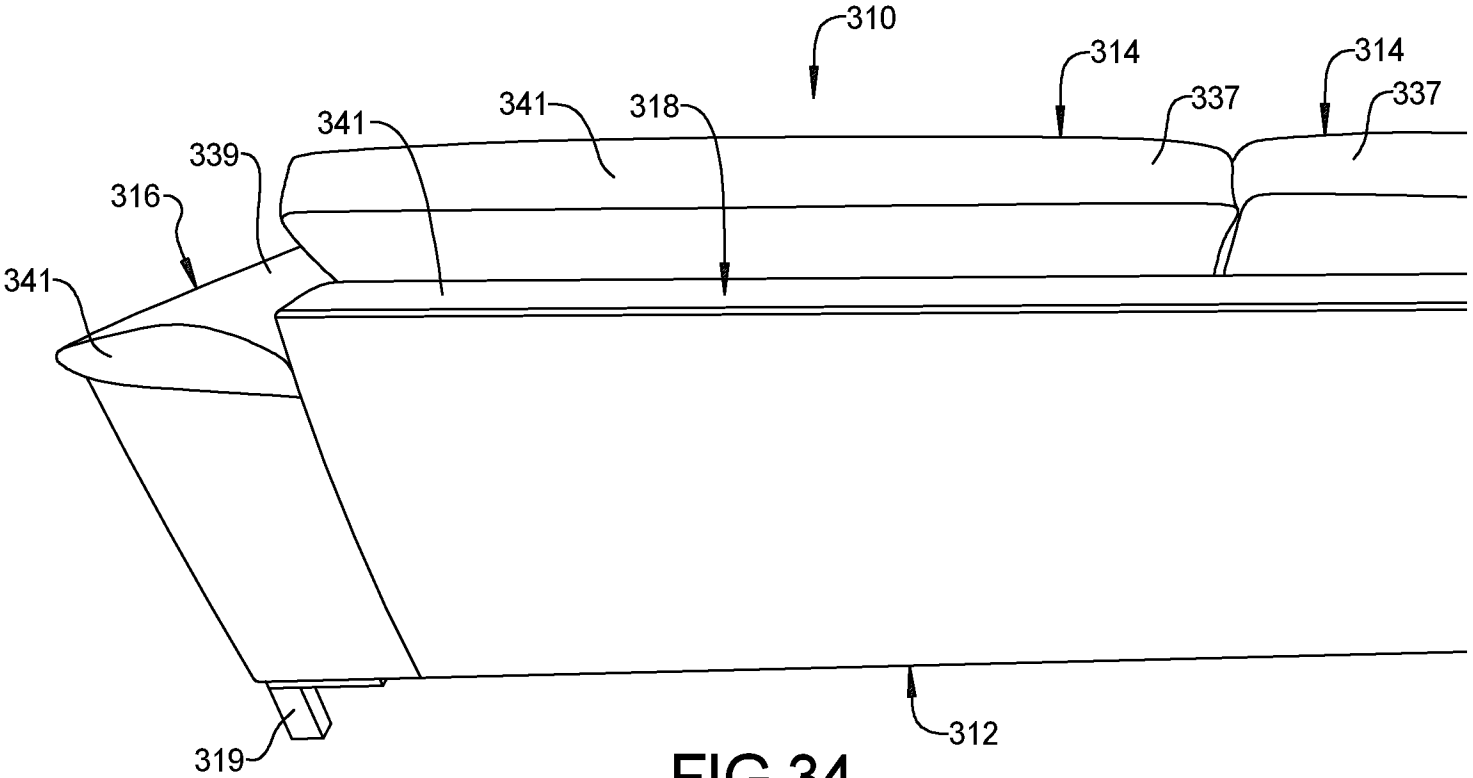
FIG. 34 is a partial rear perspective view of the furniture member in the position shown in FIG. 31.
Figure 37:
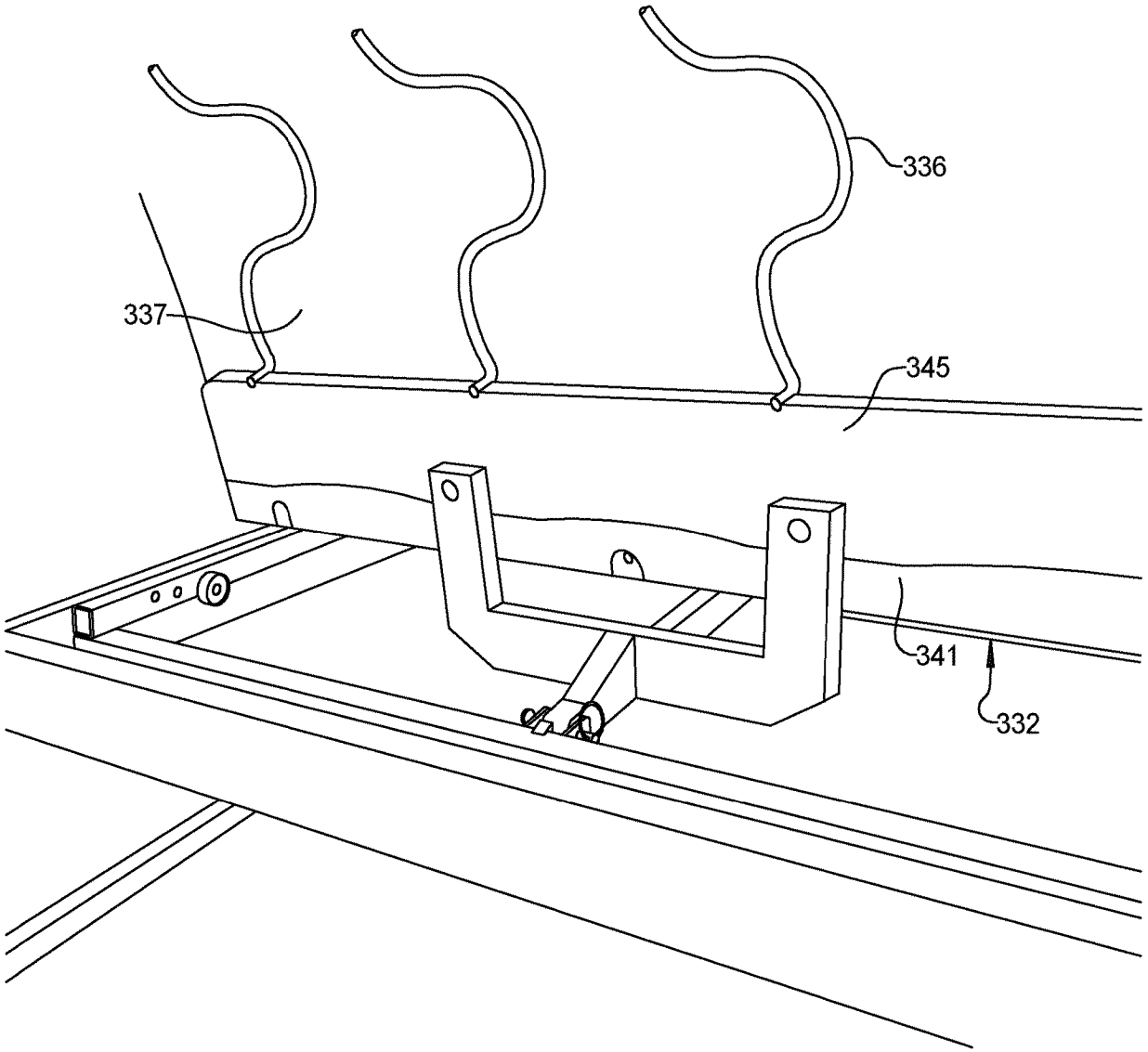
FIG. 37 is a perspective view of a portion of the seat bottom assembly with upholstery attached thereto.
Figure 38:
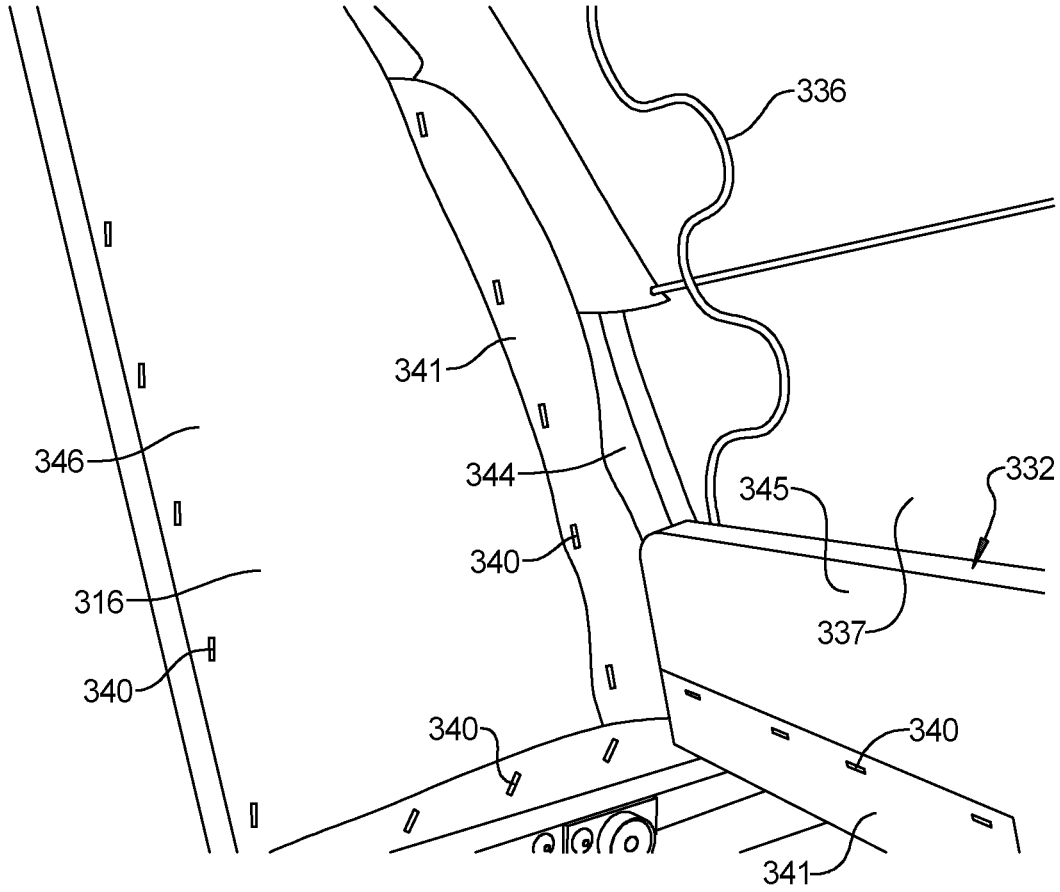
FIG. 38 is a perspective view of a portion of the seat bottom assembly and a portion of an armrest frame with upholstery attached thereto.

The upholstery 341 may be wrapped around the stationary seatback frame 318 (as shown in FIGS. 32-34) and may be connected (e.g., stitched) to upholstery 341 encasing the seatback cushions 337. As shown in FIGS. 37 and 38, upholstery 341 may extend between the backrest support springs 336 and the seatback cushions 337 and may be fixed to rear cross members 345 (similar or identical to rear cross member 41 described above) of the seat bottom assemblies 332 and to the armrest frames 316 by staples 340 (shown in FIG. 38). The upholstery 341 may include portions 344 that extend between and are attached to the armrest frame 316 and the seatback cushion 337. The portions 344 are stretchable and/or foldable to allow movement of the backrest support springs 336 and seatback cushions 337 relative to the stationary frame assembly 312. The portions 344 are hidden from view when the furniture member 310 is fully assembled and upholstered. The portions 344 also prevent a person sitting or lying on the furniture member 310 from accessing a cavity 346 behind the backrest support springs 336.

As described above, since the armrest frames 316, stationary seatback frame 318, and legs 319 are fixed relative to each other and remain stationary relative to the ground, the aesthetic appearance of the armrest frames 316, stationary seatback frame 318, and legs 319 can be made to match or resemble the aesthetic appearance of conventional stationary furniture. That is, unlike some motion sofas, the furniture member 310 does not have split lines (gaps) between the seatback frame 318 and the armrest frames 316 to accommodate relative movement therebetween (see FIG. 34). As with the furniture members 10, 210, since the seatback frame 318 remains stationary while the seat assemblies 314 move amongst the first, second and third positions, the furniture member 310 can be positioned within a room with the seatback frame 318 abutting a wall of the room (or abutting another stationary object such as a table) without hindering the motion of the seat assemblies 314. Furthermore, since split lines are not needed, the seatback frame 318 can be or include (if desired) a single, continuous upper seatback rail 317 (similar or identical to the seatback frames 18, 218) that spans the entire distance between the armrest frames 316, and one single sheet of upholstery can cover the seatback frame 318 and span the entire distance between the armrest frames 316. In some configurations, the upper seatback rail 317 may be the uppermost member of the stationary frame assembly 312. Unlike the furniture member 310, conventional motion sofas with reclining seatbacks would need to include split lines between each seatback and armrest frame and split lines between seatbacks of adjacent seat assemblies to allow for movement of the seatbacks.

Figure 39:
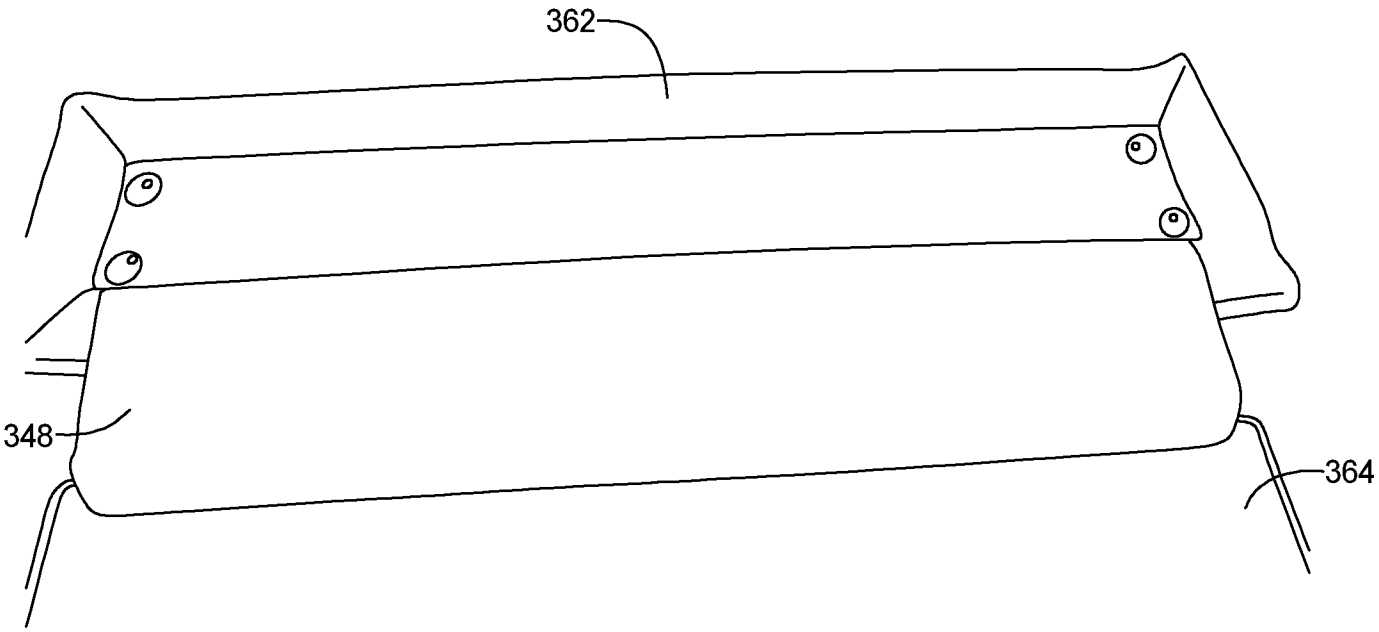
FIG. 39 is a perspective view of a portion of a legrest assembly including a legrest platform, a mid-ottoman platform, and upholstery connected thereto.
Figure 40:
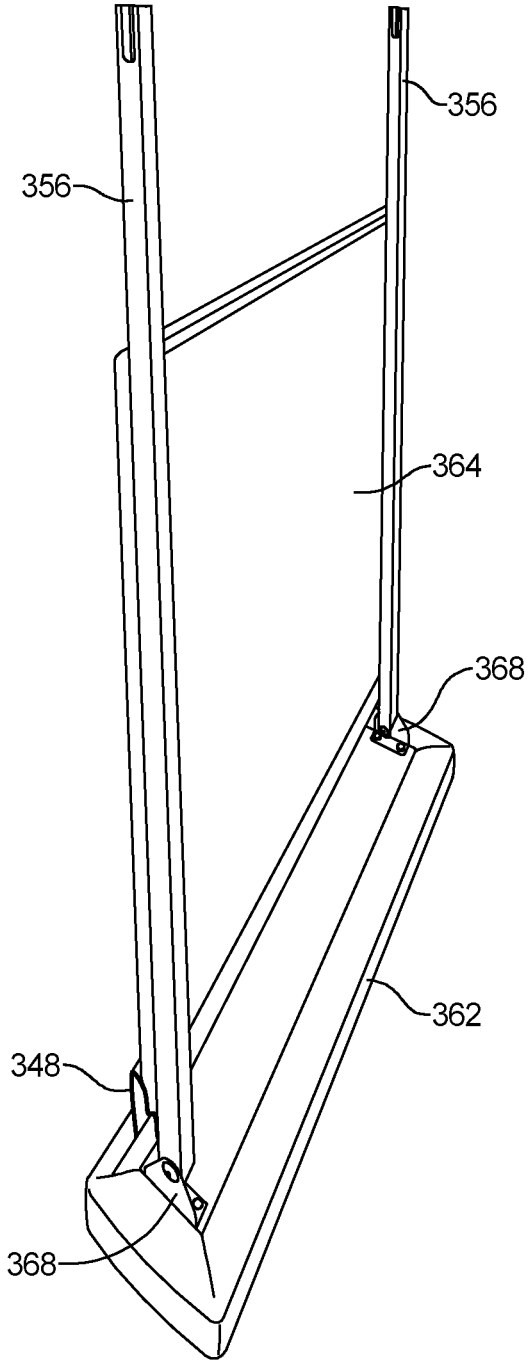
FIG. 40 is a perspective view of a portion of the legrest assembly including the legrest platform, the mid-ottoman platform, upholstery connected to the legrest platform and mid-ottoman platform, and legrest support members connected to the legrest platform.

As shown in FIGS. 39 and 40, another foldable and/or stretchable upholstery portion 348 may be attached (e.g., via staples) to and extend between the mid-ottoman platform 364 and the legrest platform 362. The portion 348 folds and unfolds (and/or stretches and unstretches) as the legrest platform 362 rotates relative to the mid-ottoman platform 364. As described above, brackets 368 (similar or identical to brackets 68) may be attached (e.g., via screws or other fasteners) to the legrest platform 362, and legrest support members 356 (similar or identical to legrest support members 56) are rotatable coupled to the brackets 368, as shown in FIG. 40. The mid-ottoman platform 364 may be attached to the legrest support members 356 by fasteners (e.g., Christmas tree fasteners).

Figure 35:
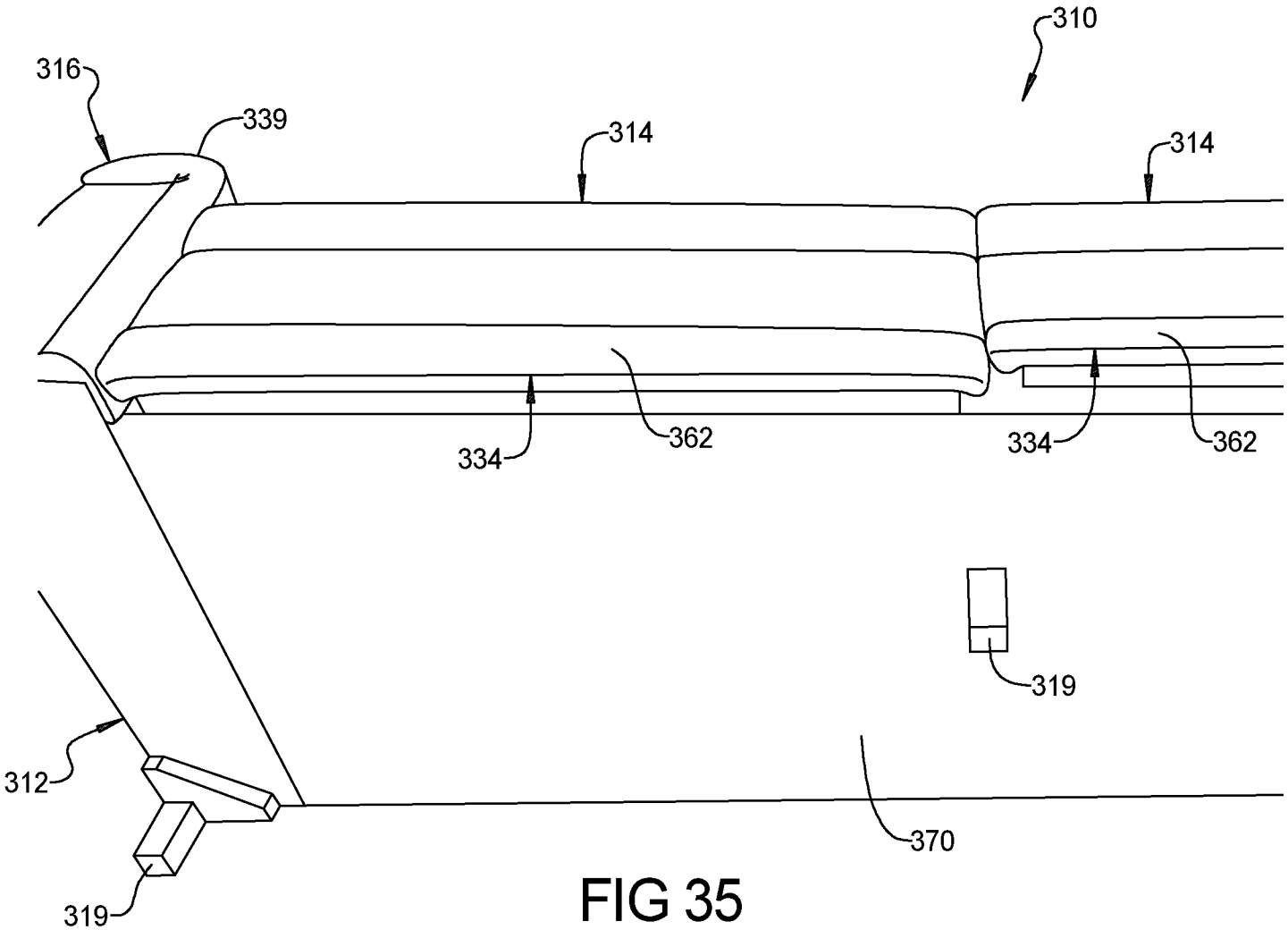
FIG. 35 is a partial bottom perspective view of the furniture member in the position shown in FIG. 31.
Figure 36:
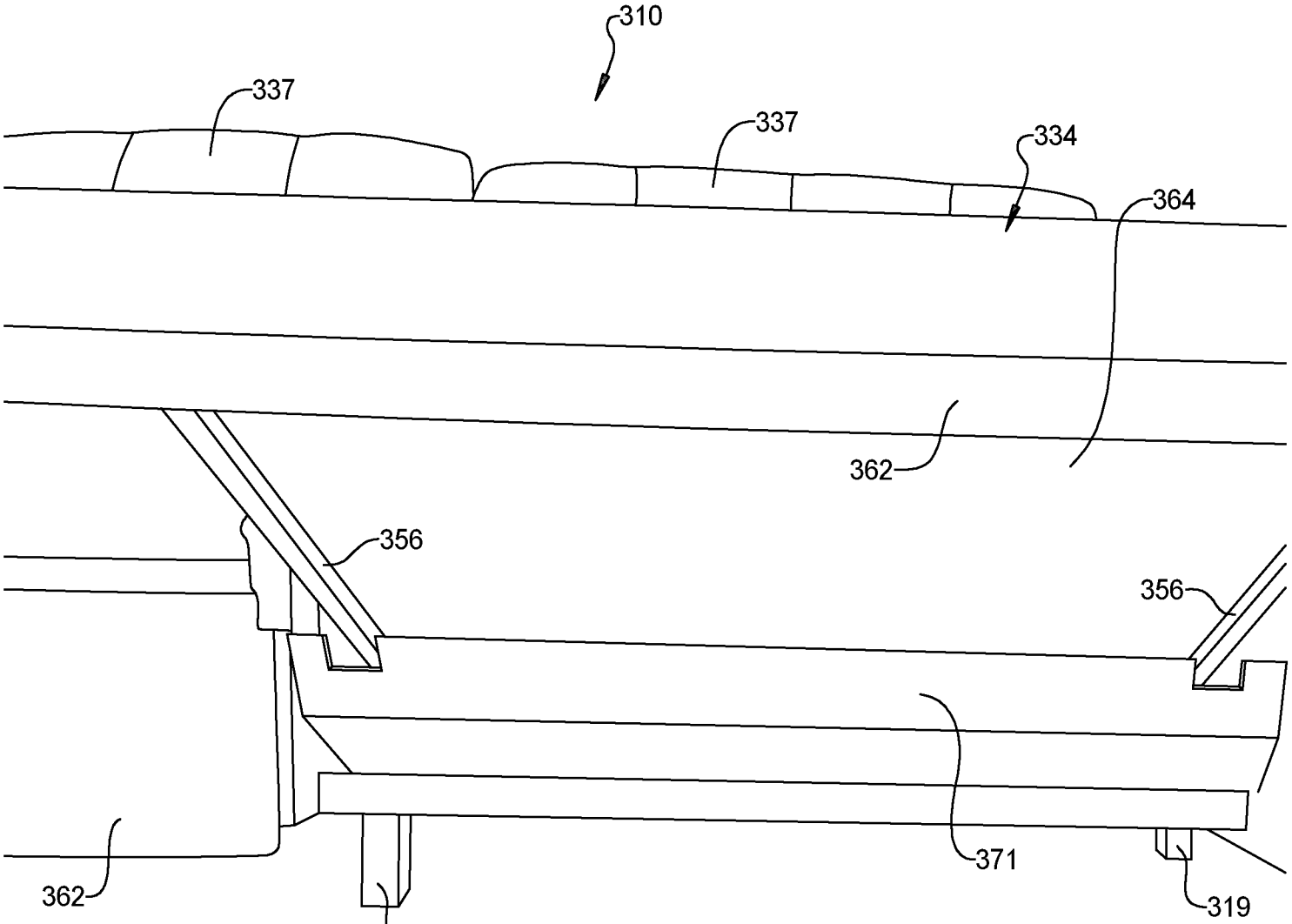
FIG. 36 is a partial front perspective view of the furniture member in the position shown in FIG. 33.

As shown in FIG. 35, the bottom of the furniture member 310 can include a dust cover 370 (e.g., a sheet of fabric or upholstery) that hides the linkages, mechanisms and actuators (motors) that move the seat bottom assemblies 332 and legrest mechanisms 334. As shown in FIG. 36, a cover member 371 may also shield the linkages, mechanisms and actuators from view when the legrest mechanism 334 is in the extended position. The cover member 371 can be formed from a relatively rigid plastic material, for example, or another suitable material.

Figure 41:
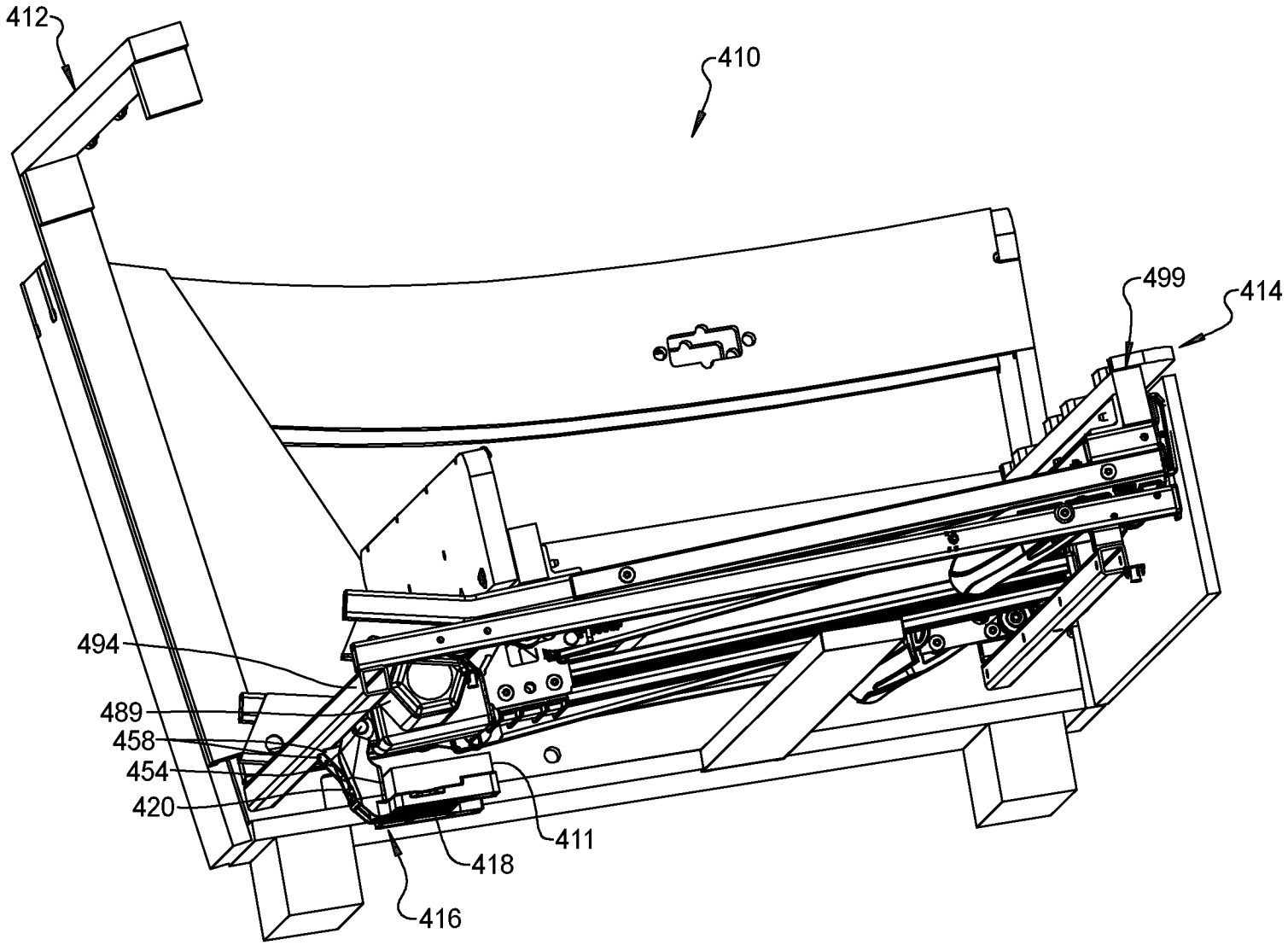
FIG. 41 is a partial perspective view of another furniture member having a battery tray assembly.

Referring now to FIG. 41, another furniture member 410 is provided. The furniture member 410 may include a stationary frame assembly 412 and one or more movable seat assemblies 414 that are supported by the stationary frame assembly 412 and movable relative to the stationary fame assembly 412. The structure and function of the stationary frame assembly 412 and seat assembly 414 may be similar or identical to the stationary frame assembly 10, 210, 310 and seat assemblies 14, 214, 314 described above. Therefore, similar features will not be described again in detail.

Figure 45:
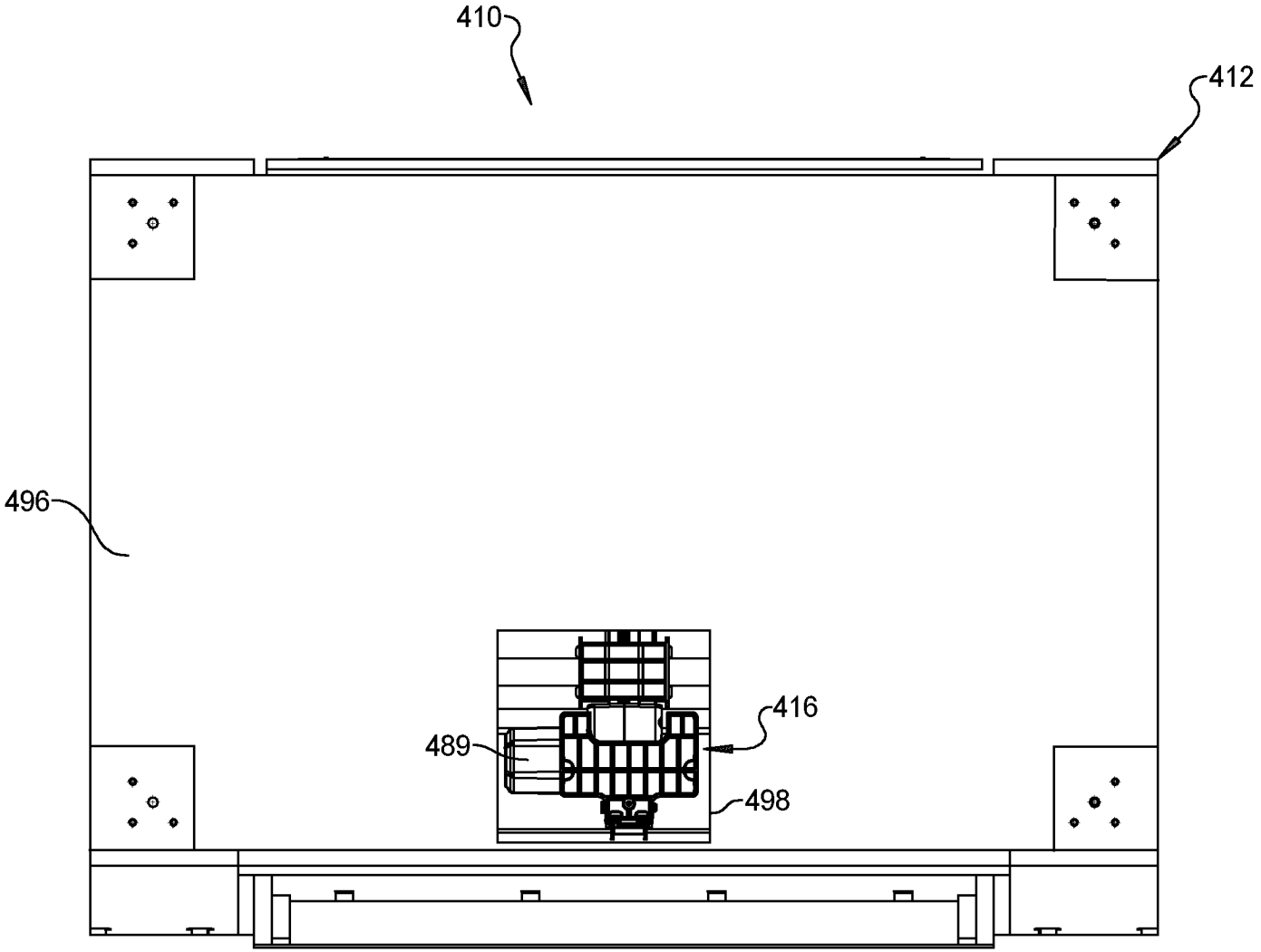
FIG. 45 is a bottom view of the furniture member of FIG. 41.

As shown in FIGS. 41 and 45, the furniture member 410 may also include a battery (or power supply) tray assembly 416. As described in more detail below, the battery tray assembly 416 may be attached to and hang down from an underside of the furniture member 410 and may house a battery 411 (shown schematically in FIG. 41) or other power supply that may power a motor 489 (FIGS. 41 and 46) or actuator that drives the seat assembly 414 among its various positions.

Figure 42:
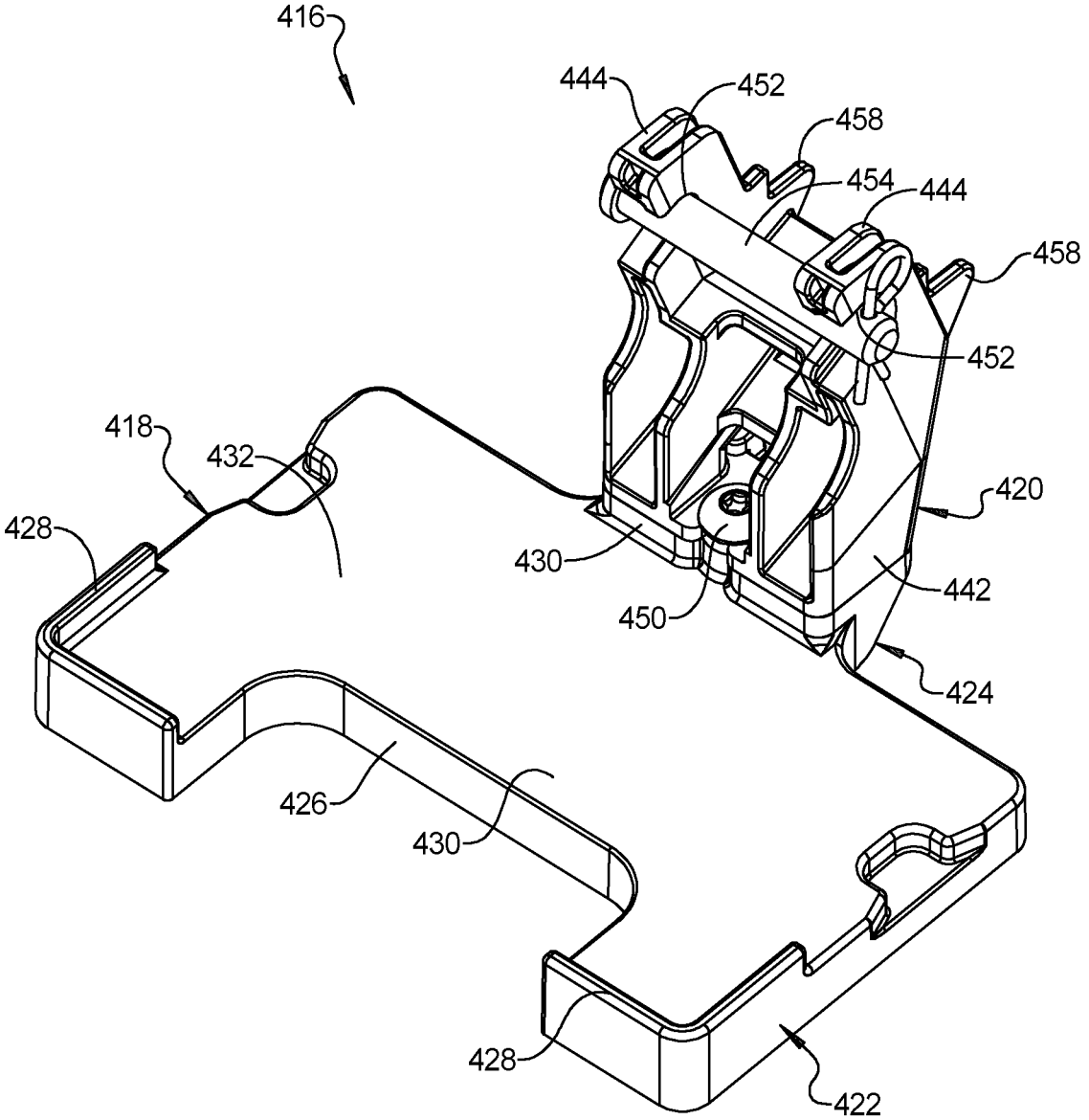
FIG. 42 is a perspective view of the battery tray assembly.
Figure 43:
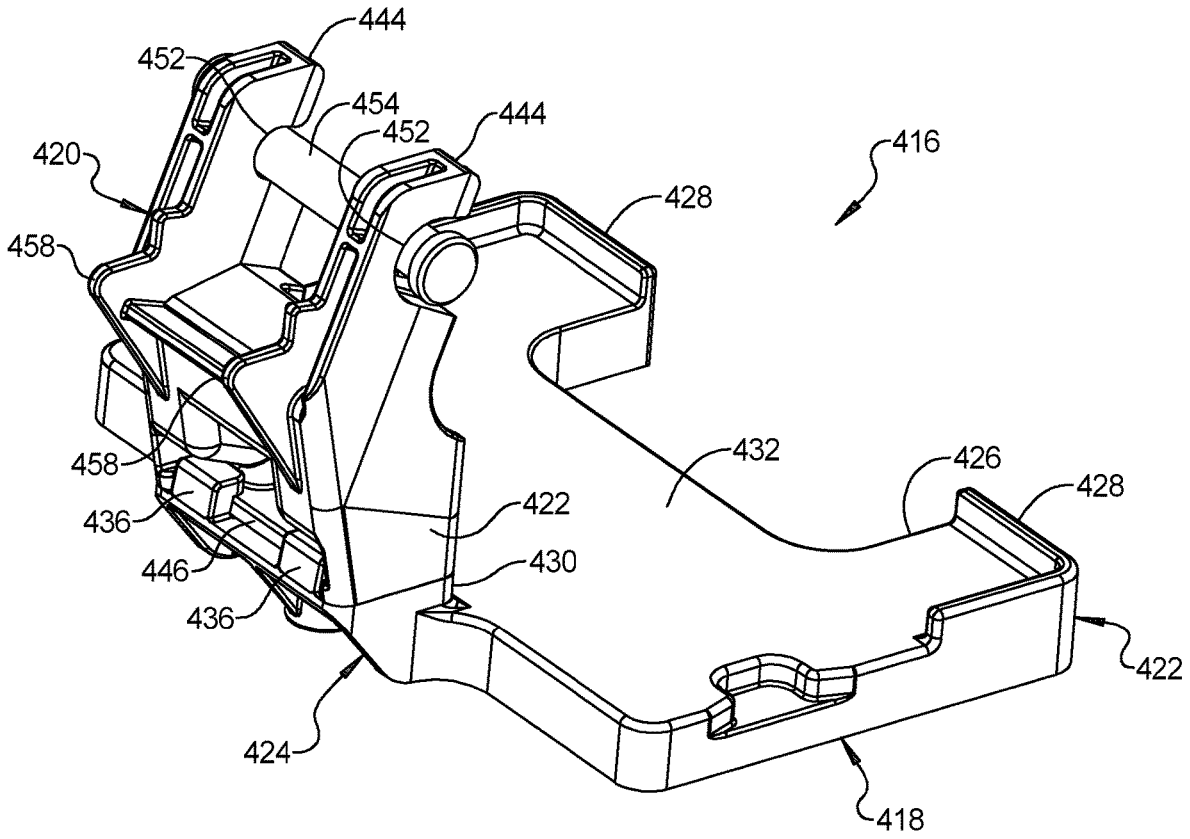
FIG. 43 is another perspective view of the battery tray assembly.
Figure 44:
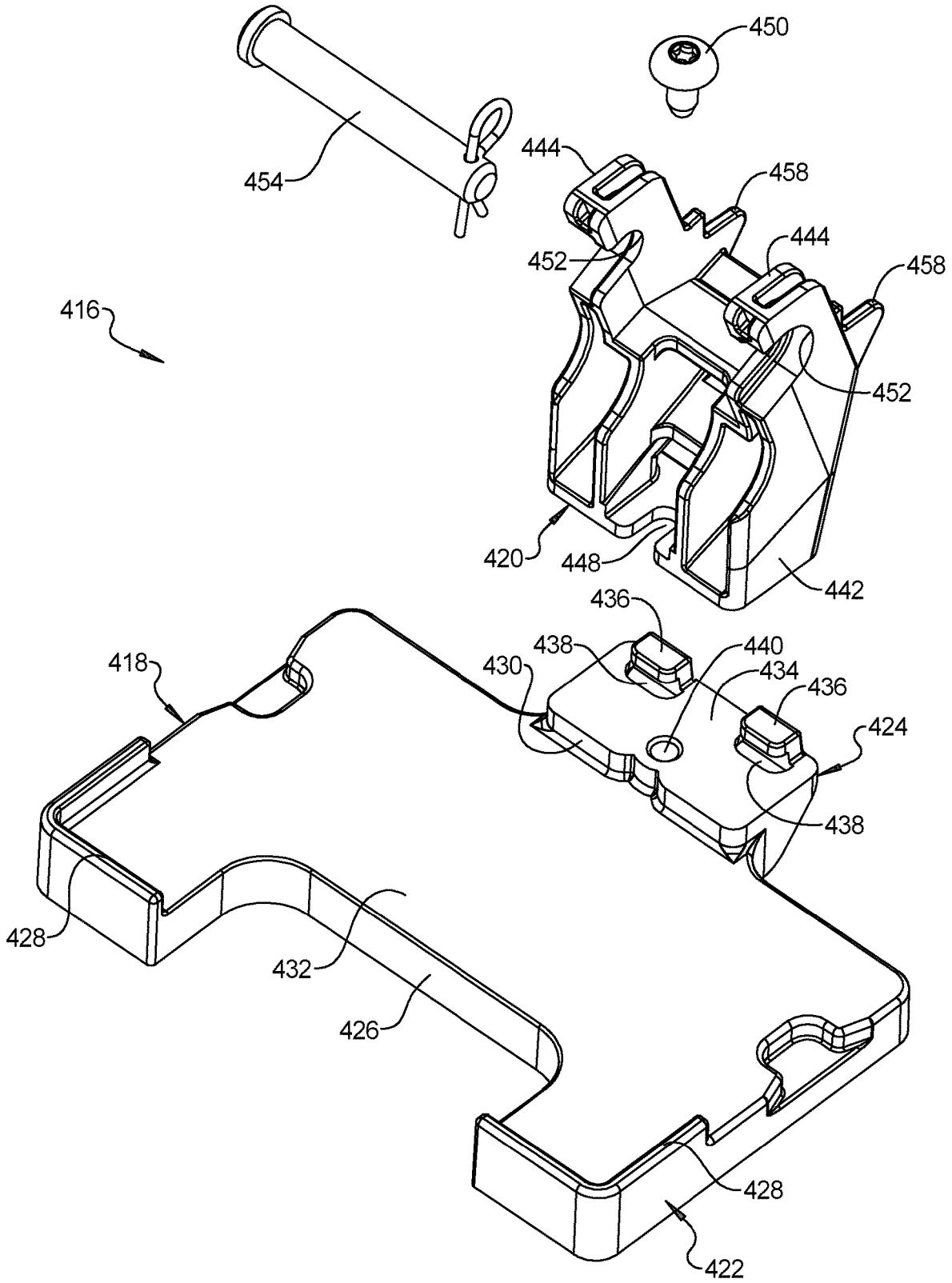
FIG. 44 is an exploded view of the battery tray assembly.

As shown in FIGS. 42-44, the battery tray assembly 416 may include a shelf 418 and a bracket 420. The shelf 418 may include a body 422 and a mounting flange 424 extending outward from the body 422. The body 422 may be a generally rectangular member having a cutout 426 and lips 428. The lips 428 and an edge 430 of the mounting flange 424 may cooperate to retain the battery 411 that may be placed on a shelf surface 432 of the body 422.

As shown in FIG. 44, the mounting flange 424 may be cantilevered off of the body 422 and may include a mounting surface 434 that may be generally perpendicular to the edge 430. The mounting surface 434 may include a pair of tabs 436 (FIG. 44) extending therefrom. The tabs 436 may include a generally L-shaped profile. Slots 438 may be formed in the mounting surface 434 adjacent respective tabs 436. An aperture 440 may also extend through the mounting surface 434.

As shown in FIG. 44, the bracket 420 may include a base 442 and a pair of mounting hooks or ears 444 extending from the base 442. As shown in FIGS. 42 and 43, the base 442 may be mounted on the mounting surface 434 of the shelf 418. As shown in FIG. 43, the base 442 may include one or more ribs or ledges 446 that engage the tabs 436 of the mounting flange 424. As shown in FIG. 44, the base 442 may include a slot or aperture 448 that may be aligned with the aperture 440 in the mounting flange 424 when the bracket 420 is mounted on the mounting flange 424. A fastener 450 may extend through the aperture 448 in the base 442 and threadably engage the aperture 440 in the mounting flange 424, as shown in FIG. 42. In this manner, the fastener 450 and the tabs 436 cooperate to fix the bracket 420 to the shelf 418. In some configurations, the base 442 may include tabs (not shown) that are received in the slots 438 in the mounting flange 424. Such tabs on the base 442 may cooperate with the fastener 450 and/or the tabs 436 to fix the bracket 420 to the shelf 418.

Figure 46:
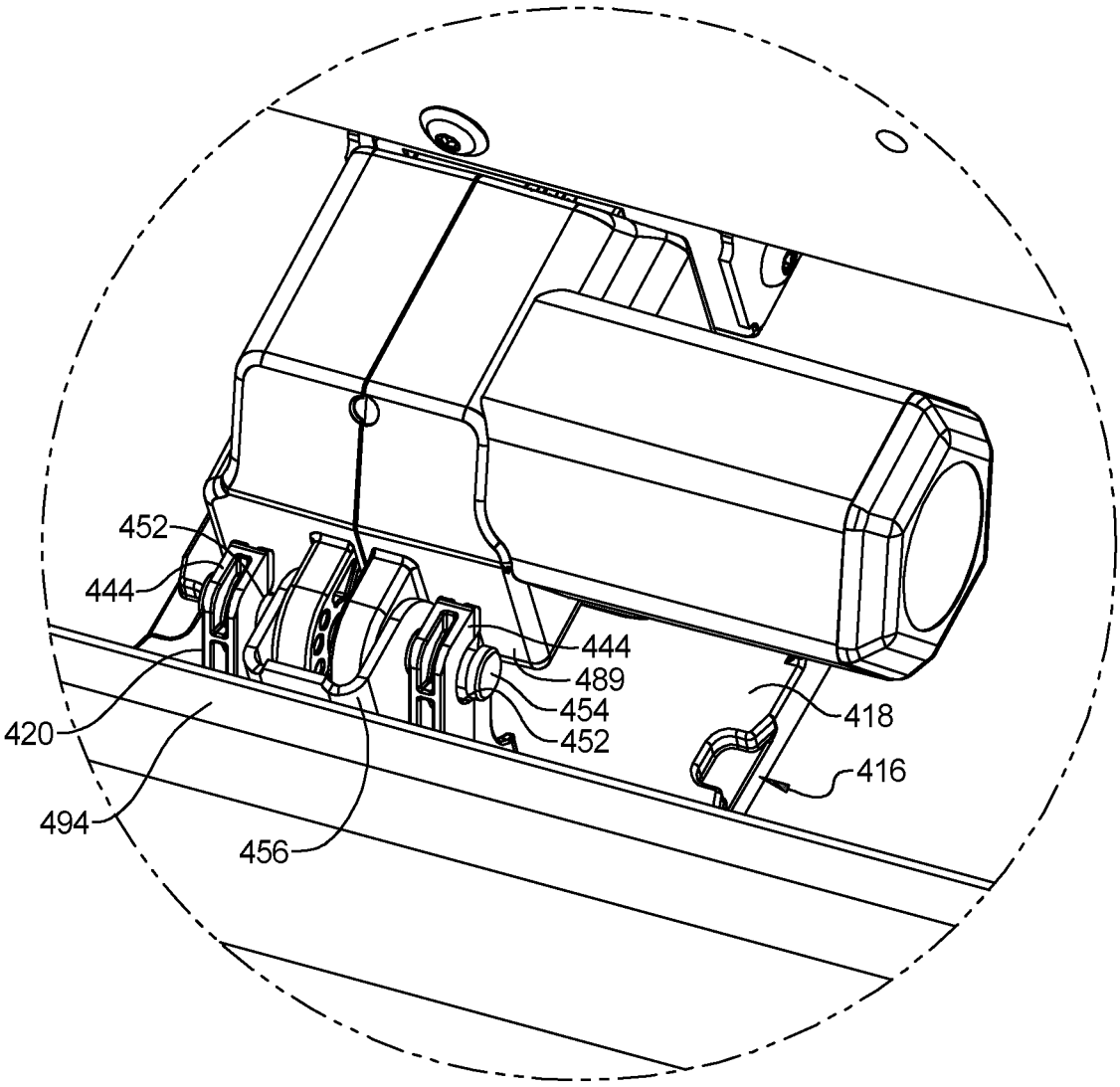
FIG. 46 is a perspective view of the battery tray assembly mounted to a motor bracket pin of the furniture member.

As shown in FIGS. 42, 43, and 46, the ears 444 include slots 452 that receive a motor bracket pin 454 (similar or identical structure and function as pin 94). As shown in FIG. 46, the motor bracket pin 454 engages a motor bracket 456 (similar or identical structure and function as bracket 92) to rotatably couple the motor 489 to a rear cross member 494 (similar or identical structure and function as rear cross member 24) of the stationary frame assembly 412. The bracket 420 may also include a pair of protrusions 458 that may abut the rear cross member 494 when the battery tray assembly 416 is in the fully assembled position relative to the frame assembly 412 (as shown in FIG. 41). Interference between the protrusions 458 and the rear cross member 494 prevents rotation of the battery tray assembly 416 about the motor bracket pin 454.

To install the battery tray assembly 416 onto the furniture member 410, the ears 444 may be hooked onto the motor bracket pin 454 (i.e., with the motor bracket pin 454 received in slots 452) such that the motor bracket 456 is disposed between the ears 44. The battery tray assembly 416 can then be rotated about the motor bracket pin 454 until the protrusions 458 contact the rear cross member 494 of the stationary frame assembly 412.

Figure 47:
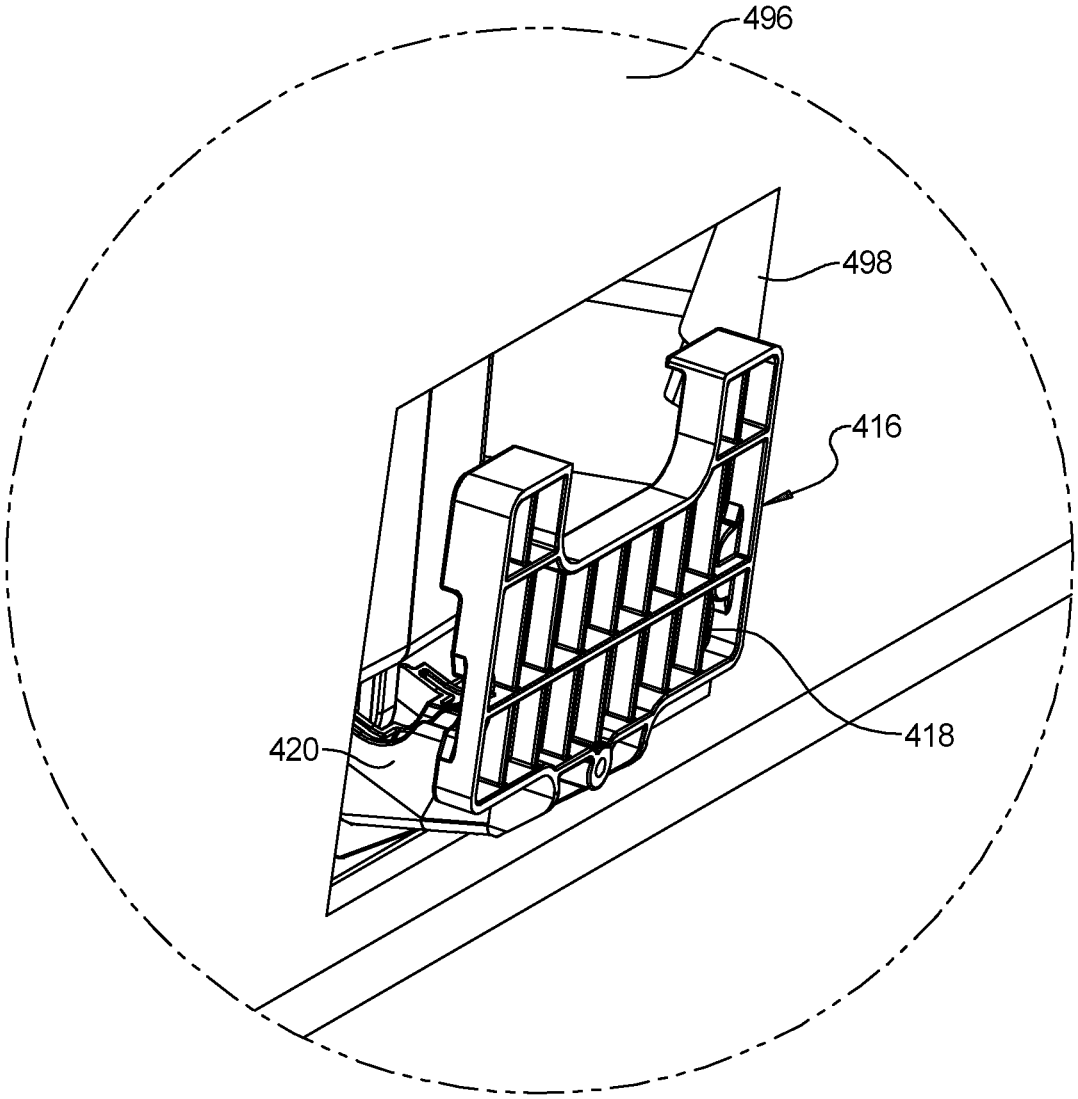
FIG. 47 is a partial bottom perspective view of the furniture member with the battery tray assembly mounted thereto.

As shown in FIGS. 45 and 47, the furniture member 410 may include a dust cover 496 (similar or identical structure and function as the dust cover 370). The dust cover 496 may include an opening 498 that provides access to the battery tray assembly 416. In some configurations, the battery tray assembly 416 may protrude slightly through the opening 498. In other configurations, the battery tray assembly 416 may be disposed entirely between seat bottom assembly 499 (similar or identical structure and function as seat bottom assembly 32, 232, 332) and the dust cover 496.

The battery tray assembly 416 could be installed on any of the furniture members 10, 210, 310 in the same or similar manner as described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a stationary frame assembly including a stationary base frame, a pair of stationary armrest frames and a stationary seatback frame that is fixed relative to the stationary base frame and the stationary armrest frames; and a seatback cushion including upholstery attached to at least one of the stationary armrest frames, wherein the upholstery includes a portion disposed between the at least one of the stationary armrest frames and the seatback cushion, and wherein the portion of the upholstery is expandable to allow movement of the seatback cushion relative to the stationary base frame, the stationary armrest frames and the stationary seatback frame between an upright position and a reclined position.

2. The furniture member of claim 1, further comprising a seat bottom assembly supported by the stationary base frame and movable relative to the stationary base frame between a nominal position and a tilted position.

3. The furniture member of claim 2, further comprising another seat bottom assembly and another seatback cushion, wherein the seat bottom assemblies are movable between the nominal and tilted positions independently of each other, wherein the seatback cushions are movable independently of each other between the upright and reclined positions, and wherein the stationary seatback frame includes a single, continuous seatback rail that extends from one of the stationary armrest frames to the other of the stationary armrest frames such that the furniture member lacks split lines between the seatback cushions and lacks split lines between the seatback cushions and the stationary armrest frames.

4. The furniture member of claim 3, wherein the seatback rail is disposed vertically higher than the stationary armrest frames.

5. The furniture member of claim 2, wherein the seatback cushion moves between the upright and reclined positions in response to movement of the seat bottom assembly between the nominal and tilted positions.

6. The furniture member of claim 5, further comprising backrest support springs that flex in response to movement of the seat bottom assembly between the nominal and tilted positions, wherein the seatback cushion is mounted to the backrest support springs.

7. The furniture member of claim 6, wherein each of the backrest support springs includes a first end and a second end, wherein the first end fixedly attached to the stationary seatback frame, and wherein the second end is movable relative to the stationary seatback frame in response to movement of the seat bottom assembly between the nominal and tilted positions.

8. The furniture member of claim 7, wherein the second end of each of the backrest support springs is fixedly attached to the seat bottom assembly.

9. The furniture member of claim 8, wherein the stationary base frame includes a plurality of rollers, wherein the seat bottom assembly is supported by the stationary base frame and is rollingly movable on the plurality of rollers relative to the stationary base frame and the stationary seatback frame between the nominal and tilted positions.

10. The furniture member of claim 9, further comprising a legrest mechanism supported by the stationary base frame and movable relative to the stationary base frame and the stationary seatback frame among a retracted position, a first extended position and a second extended position.

11. The furniture member of claim 10, wherein a portion of the legrest mechanism is spaced apart from the seat bottom assembly when the legrest mechanism is in the retracted position, wherein the portion of the legrest mechanism contacts the seat bottom assembly when the legrest mechanism is in the first extended position and pushes the seat bottom assembly from the nominal position to the tilted position as the legrest mechanism moves from the first extended position to the second extended position.

12. The furniture member of claim 10, wherein the legrest mechanism includes a legrest platform, a mid-ottoman platform, and legrest upholstery attached to and extending between the legrest platform and the mid-ottoman platform, and wherein the legrest upholstery folds and unfolds as the legrest platform rotates relative to the mid-ottoman platform.

13. A furniture member comprising:

a stationary frame assembly having a motor bracket pin;

a motor pivotably mounted to the motor bracket pin;

a battery electrically connected to the motor; and a battery tray assembly including a bracket and a shelf, the bracket pivotably engaging the motor bracket pin, the shelf attached to the bracket and defining a shelf surface configured to support the battery.

14. The furniture member of claim 13, wherein the battery tray assembly is disposed below a seat bottom assembly of the furniture member and hangs downward from the motor bracket pin.

15. The furniture member of claim 14, wherein the bracket includes a base and a pair of ears extending from the base, wherein the ears include slots that rotatably receive the motor bracket pin, and wherein the base is attached to the shelf.

16. The furniture member of claim 15, wherein the bracket includes a protrusion that abuts a cross member of the stationary frame assembly, and wherein contact between the protrusion and the cross member restricts rotation of the battery tray assembly relative to the stationary frame assembly.

17. The furniture member of claim 16, wherein the motor engages the motor bracket pin between the ears.

18. The furniture member of claim 17, further comprising a dust cover attached to the stationary frame assembly below the seat bottom assembly, wherein the dust cover includes an aperture providing access to the battery tray assembly.

19. The furniture member of claim 18, wherein the shelf includes a plurality of lips that at least partially define a periphery of the shelf surface.

20. The furniture member of claim 13, further comprising a seat bottom assembly and a legrest mechanism, wherein the motor drives movement of the seat bottom assembly and the legrest mechanism relative to the stationary frame assembly.

* * * * *